US005194348A

United States Patent [19]

Morigaki et al.

[11] Patent Number: 5,194,348

[45] Date of Patent: Mar. 16, 1993

[54] COLOR PHOTOGRAPHS AND METHOD FOR PREPARATION OF THE SAME

[75] Inventors: Masakazu Morigaki; Nobuo Seto; Osamu Takahashi; Hideaki Naruse, all of Kanagawa, Japan

[73] Assignee: Fuji Photo Film Co., Ltd., Kanagawa, Japan

[21] Appl. No.: 462,930

[22] Filed: Jan. 12, 1990

Related U.S. Application Data

[63] Continuation of Ser. No. 82,253, Aug. 5, 1987, abandoned.

[30] Foreign Application Priority Data

Aug. 5, 1986 [JP] Japan ..... 61-183919

[51] Int. Cl.[5] ..... G03C 7/26; G03C 7/32

[52] U.S. Cl. ..... 430/17; 430/372; 430/551; 430/607; 430/613; 430/614

[58] Field of Search ..... 430/372, 490, 551, 607, 430/617, 623, 217, 17, 214, 614

[56] References Cited

U.S. PATENT DOCUMENTS

| | | | |
|---|---|---|---|
| 3,876,428 | 4/1975 | Marin et al. | 430/372 |
| 4,204,867 | 5/1980 | Kaffner et al. | 430/376 |
| 4,297,438 | 10/1981 | Haseler et al. | 430/377 |
| 4,622,287 | 11/1986 | Umemoto et al. | 430/551 |
| 4,732,845 | 3/1988 | Keiji et al. | 430/551 |
| 4,734,358 | 3/1988 | Takada et al. | 430/607 |
| 4,738,919 | 4/1988 | Krauss et al. | 430/551 |

FOREIGN PATENT DOCUMENTS 104641 6/1984 Japan .

*Primary Examiner*—Richard L. Schilling
*Attorney, Agent, or Firm*—Sughrue, Mion, Zinn, Macpeak & Seas

[57] ABSTRACT

Disclosed in a color photograph containing a storability-improving compound capable of forming a chemical bond with an aromatic amine series color developing agent that remains in a photographic material after having been processed for color development to give a chemically inactive and substantially colorless compound in at least one photographic layer on a support. Also disclosed is a method for preparation of color photographs wherein a photographic material containing a silver halide emulsion layer and a color image-forming coupler capable of forming a dye by an oxidation-coupling reaction with an aromatic amine series color developing agent, as coated on a support, is imagewise exposed to light and then subjected to photographic processing, comprising carrying out the photographic processing in the presence of the afore described storability-improving compound. By the use of the storability-improving compound, the color images formed on the color photographs do not fade when stored for long periods of time.

23 Claims, No Drawings

COLOR PHOTOGRAPHS AND METHOD FOR PREPARATION OF THE SAME

This is a continuation of application Ser. No. 07/082,253 filed Aug. 5, 1987, now abandoned.

FIELD OF THE INVENTION

The present invention relates to color photographs and a method for preparation of the same, and more precisely, to color photographs and a method for preparation of color photographs having improved storability by chemically inactivating aromatic amine developing agents that exist in silver halide photographic materials after color development with storability improving agents.

BACKGROUND OF THE INVENTION

Silver halide color photographic materials are imagewise exposed and developed with an aromatic amine series color developing agent, and the resulting oxidation product of the developing agent is reacted with a color image-forming coupler (hereinafter referred to as "coupler") in the material to give color images. In color photographic materials, in general, combinations of a yellow coupler, a cyan coupler and a magenta coupler are used.

In 1912, Fisher, et al. discovered the fundamental of color development, and various improvements of the color development system have heretofore been noticeably effected. In particular, various improvements and studies have been extensively effected including, for example, shortening of development time, simplification of processing steps, re-use of waste solutions in development, reduction of the amount of replenishers, processing without water, removal of benzyl alcohol in consideration of preservation of the environment, etc.

However, there still are many problems with conventional technical means. For instance, in actual development processing, a fresh processing solution is not used for each development procedure but the developer is replenished in accordance with the amount of the materials to be developed, and the replenishment of the developer causes some problems in the development procedure.

In general, a development processing solution comprises a color developer, a stop solution, a bleaching solution, a fixer or a blix, etc., and the processing temperature is high, being about 31° C. to 43° C. Accordingly, the developing agent is decomposed when used for a long period of time or is oxidized by contact with air, or some components in the photographic materials as processed are dissolved out and precipitate in the processing solution during the processing of the materials, or the processing solution sticks to the materials as processed and is carried over into the next bath together with the materials, whereby the composition of the processing solution will often vary. A processing solution thus run for a long period of time becomes a so-called running solution. Under such situations, replenishment of deficient chemical components is effected and removal of undesired components is also effected, but these treatments are not satisfactory. Further, in the rinsing step, the amount of the rinsing water to be used is desired to be reduced or the rinsing step is desired to be effected without water because of a shortage of water resources, rise in city water costs, and other economical and environmental reasons. In such water-free treatment, however, inorganic components such as thiosulfates, sulfites or meta-bisulfites present in the processing solution as well as organic components such as a developing agent present in the developer solution enter into or adhere onto the photographic materials processed.

Further, in view of the deterioration of the composition of the treating solution as it is used, the reduction of the amount of the rinsing water in the rinsing step and the water-free processing step, it is evident that the amount of the components of the processing solution which enter into or adhere onto the photographic materials processed tends to increase remarkably.

On the other hand, regarding couplers to be incorporated into photographic materials, development of couplers capable of forming sharp cyan, magenta or yellow dyes with less side-absorption is being effected so as to attain a good color reproduction, and at the same time, development of highly active couplers capable of being color-developed in a short period of time is also being effected. Further, development of new additives capable of effectively inducing the excellent characteristics of these couplers is also being effected. Unfortunately, however, the newly induced characteristics often cause deterioration of the storability of the color photographs due to the reaction with the components of the processing solution that remain in the photographic materials after being processed.

It is known that the components of the processing solution that remain in the photographic materials after development, especially the developing agent which is an aromatic primary amine compound and compounds derived therefrom, cause the deterioration of the fastness of the image formed, for example, because of the influence of light, heat, moisture, oxygen, etc., during storage for a long period of time, or the compounds themselves self-couple or convert into colored substances by the action of any coexisting materials to form so-called "stains". This ia a fatal defect in color photographs.

On the other hand, various studies have been made relating to the prevention of image deterioration and stain prevention, apart from the above-mentioned technical means. For instance, various technical ideas have been proposed, including the selective use of hardly color-fading couplers, the use of a anti-fading agent for preventing the color images formed from fading under light, and the use of an ultraviolet absorbent for preventing the color images formed from being deteriorated by ultraviolet rays.

In particular, the effect of preventing image deterioration by the use of an anti-fading agent is remarkable, and for example, hydroquinones, hindered phenols, tocopherols, chromans, coumarans and compounds derived from these compounds by etherifying the phenolic hydroxyl group therein (U.S. Pat. Nos. 3,935,016, 3,930,866, 3,700,455, 3,764,337, 3,432,300, 3,573,050 and 4,254,216, British Patents 2,066,975 and 1,326,889, Japanese Patent Publication No. 30462/76, etc.), etc. are known as anti-fading agents.

However, these compounds are still insufficient to provide images of high quality, although the compounds are accepted as having the effect of anti-fading agents for preventing the fading or discoloration of image dyes formed. In addition, these compounds often cause variation in the hue of color images, generation of fog, occurrence of dispersion insufficiency or even formation of fine crystals in coated emulsions, and therefore, these compounds cannot be said to be able to display all-around effect for photographic use.

Recently, certain kinds of amine series compounds have been proposed to be effective for the prevention of stains, for example, in U.S. Pat. Nos. 4,463,085 and 4,483,918, Japanese Patent Application (OPI) Nos. 218445/84 and 229557/84, etc. (the term "OPI" as used herein refers to a "published unexamined Japanese patent application"). However, none of these conventional compounds has been sufficient for attaining the object.

On the other hand, it is known to add a 1-aryl-3-pyrazolidone derivative, especially a precursor thereof, to layers of photographic materials, for example, in U.S. Pat. Nos. 4,358,525, 4,465,762 and 4,522,917, Japanese Patent Application (OPI) Nos. 52055/80, 5330/80, 40245/82, 104641/84 and 121328/84, etc. However, these compounds have, when added, the defect of deteriorating the light-fastness of the photographic materials, and especially, the color-faded degree of remarkable for 3-alkoxycarbonyloxy-2-pyrazolidone derivatives.

SUMMARY OF THE INVENTION

Accordingly, one object of the present invention is to provide a method for preparation of color photographs whose white background parts do not fade even when stored or placed on exhibition for along period of time.

Another object of the present invention is to provide color photographic materials capable of forming color images, after being color developed, bleached and fixed, which do not deteriorate or fade by the color developing agent that remains in the photographic material.

Still another object of the present invention is to provide a method for forming color images in color photographic materials, which are free from any harmful side-effects, such as image deterioration or stain generation, caused by aromatic amine color developing agents that remain in the photographic materials, even when the photographic materials are processed with processing solutions from which a noticeable amount of components of the processing solutions would enter into or adhere onto the photographic materials processed, such as processing solutions under a running state, rinsing solutions containing a small amount of water or water-free solutions, substantially benzyl alcohol-free color developers, etc. or other processing solutions which would be a burden on color development.

The present inventors repeatedly studied various matters and as a result have found that the above-mentioned objects can effectively be attained by incorporating a storability-improving compound into a color photograph to be obtained by imagewise exposure, color development and bleaching and fixation of a color photographic material which contains a color image-forming coupler capable of forming a dye by an oxidation-coupling reaction of the silver halide emulsion layer as coated on the support of the material and an aromatic amine series color developing agent, in any stage of during the production of the photographic material, or during or after the color development, the storability-improving compound being able to form a chemical bond with the aromatic amine series developing agent to give a chemically inactive and substantially colorless compound.

The present invention was achieved on the basis of the above-described discovery.

Specifically, the subject matter of the present invention resides in a color photograph which contains a storability-improving compound capable of forming a chemical bond with an aromatic amine series color developing agent (preferably under the condition of a pH of 8 or less), that remains in the photograph after the color development thereof, to give a chemically inactive and substantially colorless compound, in at least one photographic layer on the support of the photograph.

DETAILED DESCRIPTION OF THE INVENTION

The aromatic amine series color developing agents as referred to herein include aromatic primary, secondary and tertiary amine compounds, and more precisely, there may be mentioned phenylenediamine series compounds and aminophenol series compounds. Typical examples of these compounds are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-methyl-2-amino-N,N-diethylaniline, 4-methyl-2-amino-N-ethyl-N-β-methanesulfonamidoethylaniline, 2-amino-N-ethyl-N-β-hydroxyethylaniline, 3-methyl-4-methyl-amino-N-ethyl-N-β-hydroxyethylaniline, 3-methyl-4-dimethylamino-N-ethyl-N-β-methanesulfonamidoethylaniline, 3-methyl-4-butylamino-N,N-diethylaniline, 3-methyl-4-acetylamino-N-ethyl-N-β-hydroxyethylaniline, 3-methyl-4-methanesulfonamido-N-ethyl-N-β-methanesulfonamidoethylaniline, 3-methyl-4-benzylamino-N-ethyl-N-β-methanesulfonamidoethylaniline, 3-methyl-4-cyclohexylamino-N-ethyl-N-methylaniline and their sulfates, hydrochlorides, phosphates, p-toluenesulfonates, tetraphenylborates and p-(t-octyl)benzenesulfonates, as well as o-aminophenol, p-aminophenol, 4-amino-2-methylphenol, 2-amino-3-methylphenol, 2-hydroxy-3-amino-1,4-dimethylbenzene, etc.

In addition, the compounds described in L.F.A. Mason's *Photographic Processing Chemistry* (by Focal Press), pages 226–229 (1966), U.S. Pat. Nos. 2,193,015 and 2,592,364, Japanese Patent Application (OPI) No. 64933/73, etc. can also be used.

The compounds capable of forming a chemical bond with the aromatic amine series color developing agent after color development to give a chemically inactive and substantially colorless compound are preferably those represented by the following general formulae (I) and (II):

$$R_1\text{-}(A)_n\text{-}X \qquad \text{(I)}$$

$$R_2\text{-}\underset{\underset{B}{|}}{C}=Y \qquad \text{(II)}$$

In the formulae, $R_1$ and $R_2$ each represents an aliphatic group, an aromatic group or a heterocyclic group; X represents a group capable of reacting with an aromatic amine developing agent to be removed; A represents a group capable of reacting with an aromatic amine developing agent to form a chemical bond; n represents 1 or 0; B represents a hydrogen atom, an aliphatic group, an aromatic group, a heterocyclic group, an acyl group or a sulfonyl group; Y represents a group capable of accelerating the addition of an aromatic amine developing agent to the compound of the formula (II); and $R_1$ and X, and Y and $R_2$ or B may be bonded together to form a cyclic structure (e.g., a cyclic acid anhydride, a succinimido ring, etc.

In the reaction for forming a chemical bond with the remaining aromatic amine developing agent, a substitution reaction and an addition reaction are typical reactions.

Among the compounds of the formulae (I) and (II) capable of reacting with the remaining aromatic amine series color developing agent, those of the formula (I) are preferred, more preferably compounds capable of reacting at a secondary reaction rate constant $k_2$ (80° C.) with p-anisidine of from 1.0 liter/mol.sec. to $1\times10^{-5}$ liter/mol.sec, most preferably compounds capable of reacting at a secondary reaction rate constant $k_2$ (80° C.) with p-anisidine of from $1\times10^{-1}$ liter/mol.sec to $1\times10^{-4}$ liter/mol.sec.

If the constant $k_2$ is larger than 1.0 liter/mol.sec., the compounds themselves are unstable and easy to react with gelatin or water to decompose. On the other hand, if the constant $k_2$ is smaller than $1\times10^{-5}$ liter/mol.sec., the reaction rate in the reaction with the remaining aromatic amine developing agent is low, and as a result, the prevention of the side-effect of the remaining aromatic amine developing agent, which is the object of the present invention, tends to be reduced.

The method for measurement of the constant $k_2$ is explained in the examples to follow hereinafter.

The substituents in the compounds of the formulae (I) and (II) are explained in greater detail below.

The aliphatic group represented by $R_1$, $R_2$ and B means a linear, branched or cyclic alkyl, alkenyl or alkynyl group, which may optionally be substituted by substituent(s). The aromatic group represented by $R_1$, $R_2$ and B means either of a carbon-cyclic aromatic group (such as a phenyl group, a naphthyl group, etc.) and a heterocyclic aromatic group (such as a furyl group, a thienyl group, a pyrazolyl group, a pyridyl group, an indolyl group, etc.), which may be either a mono-cyclic system or a condensed cyclic system (such as a benzofuryl group, a phenanthridinyl group, etc.). Further, these aromatic rings can optionally have substituent(s).

The heterocyclic group represented by $R_1$, $R_2$ and B is preferably a group having a 3-membered to 10-membered cyclic structure which is composed of carbon, oxygen, nitrogen, sulfur and/or hydrogen atoms, and the hetero-ring itself may be a saturated ring or an unsaturated ring and may further be substituted by substituent(s) (for example, a coumarinyl group, a pyrrolidyl group, a pyrrolinyl group, a morpholinyl group, etc.).

X represents a group capable of reacting with an aromatic amine developer to be removed and is preferably a group linked with A via an oxygen atom, a sulfur atom or a nitrogen atom (such as a 3-pyrazolyloxy group, a 3H-1,2,4-oxadiazolin-5-oxy group, an aryloxy group, an alkoxy group, an alkylthio group, an arylthio group, a substituted N-oxy group, etc.) or a halogen atom. When X is a halogen atom, n is 0.

A represents a group capable of reacting with an aromatic amine developing agent to form a chemical bond and is, for example, a group containing a low electron density atom. This includes, for example,

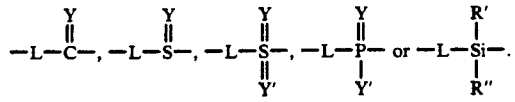

In these groups, L represents a single bond, an alkylene group,

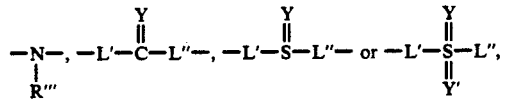

for example, a carbonyl group, a sulfonyl group, a sulfinyl group, a hydroxycarbonyl group, a phosphonyl group, a thiocarbonyl group, an aminocarbonyl group, a silyloxy group, etc.

Y has the same meaning as Y in the formula (II), and Y' has the same meaning as Y.

R' and R'' may be the same or different and each represents —L'''—$R_0$.

$R_0$ has the same meaning as $R_1$. R''' represents a hydrogen atom, an aliphatic group (such as a methyl group, an isobutyl group, a t-butyl group, a vinyl group, a benzyl group, an octadecyl group, a cyclohexyl group, etc.), an aromatic group (such as a phenyl group, a pyridyl group, a naphthyl group, etc.), a heterocyclic group (such as a piperidinyl group, a pyranyl group, a furanyl group, a chromanyl group, etc.), an acyl group (such as an acetyl group, a benzoyl group, etc.) or a sulfonyl group (such as a methanesulfonyl group, a benzenesulfonyl group, etc.).

L', L'' and L''' each represents —O—, —S— or

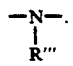

In particular, A is preferably a divalent group as represented by

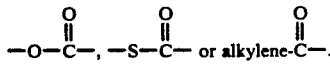

The storability-improving compound used in the present invention is different from the 3-alkoxycarbonyloxy-2-pyrazolidone derivative such as a development accelerator.

More preferable examples of the compound represented by the general formula (I) are those represented by the following general formulae (I-a), (I-b), (I-c) and (I-d) and which react with p-anisidine at a secondary reaction rate constant $k_2$ (80° C.) within the range of $1\times10^{-1}$ liter/mol.sec to $1\times10^{-5}$ liter/mol.sec:

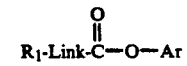

(I-a)

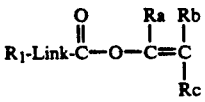

(I-b)

-continued (I-c)

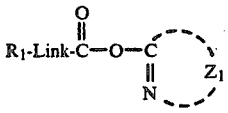

(I-d)

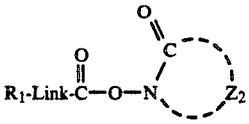

where $R_1$ has the same meaning as $R_1$ in formula (I); Link is a single bond or —O—; Ar denotes an aromatic group having the same meaning as defined for $R_1$, $R_2$ and B, except that no group useful as a photographic reducing agent such as a hydroquinone derivative or a catechol derivative will be released as a result of reaction with an aromatic amine series developing agent; Ra, Rb and Rc which may be the same or different each represents a hydrogen atom, or an aliphatic group, an aromatic group or a heterocyclic group having the same meaning as defined for $R_1$, $R_2$ and B; Ra, Rb and Rc may further represent an alkoxy group, an aryloxy group, a heterocyclic oxy group, an alkylthio group, an arylthio group, a heterocyclic thio group, an amino group, an alkylamino group, an acyl group, an amino group, a sulfonamido group, a sulfonyl group, an alkoxycarbonyl group, a sulfo group, a carboxyl group, a hydroxyl group, an acyloxy group, a ureido group, a urethane group, a carbamoyl group or a sulfamoyl group, provided that Ra and Rb, or Rb and Rc, may combine to form a 5- to 7-membered hetero ring, which hetero ring may be further substituted by a substituent, or form a spiro ring, a bicyclo ring or the like, or may be fused with an aromatic ring; $Z_1$ and $Z_2$ denotes the non-metallic atomic group necessary for forming a 5- to 7-membered hetero ring, which hetero ring may be further substituted by a substituent, or form .a spiro ring, a bicyclo ring or the like, or may be fused with an aromatic ring, except that $Z_1$ is not such a group that it will release a coupler, a 1-phenyl-3 pyrazolide as a result of reaction with an aromatic amine series developing agent.

Compounds of formulae (I-a) to (I-d), in particular, compounds of formula (I-a), may be adjusted to have a secondary reaction rate $k_2$ (80° C.) with p-anisidine in the range of from $1\times10^{-1}$ liter/mol.sec to $1\times10^{-5}$ liter/mol.sec by selecting appropriate substituents if Ar is a carbon-ring based aromatic group. Depending on the type of group denoted by $R_1$, the total of the Hammett's $\sigma$ value of the individual substituents is preferably at least 0.2, more preferably at least 0.4, most preferably at least 0.6.

If compounds of formula (I-a) or (I-b) are added during the manufacture of light-sensitive materials, the total number of carbon atoms in the compounds per se is preferably at least 13, and the more the carbon atoms that are present, the better.

In order to attain the objects of the present invention, the compound of formula (I) is preferably such that it will not decompose during development or subsequent processing.

Y in the formula (II) is preferably an oxygen atom, a sulfur atom, =N—R''$_4$ or

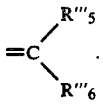

In the said groups, R'''$_4$, R'''$_5$ and R'''$_6$ each represents a hydrogen atom, an aliphatic group (such as a methyl group, an isopropyl group, a t-butyl group, a vinyl group, a benzyl group, an octadecyl group, a cyclohexyl group, etc.), an aromatic group (such as a phenyl group, pyridyl group, a naphthyl group, etc.), a heterocyclic group (such as a piperidyl group, a pyranyl group, a furanyl group, a chromanyl group, etc.), an acyl group (such as an acetyl group, a benzoyl group, etc.) or a sulfonyl group (such as a methanesulfonyl group, a benzenesulfonyl group, etc.), and R'''$_5$ and R'''$_6$ may be bonded together to form a cyclic structure.

Typical examples of these compounds are set forth below, but the compounds for use in the present invention are not whatsoever limited by them.

(I-1)

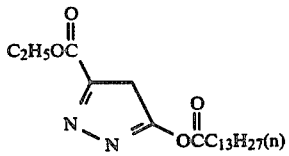

(I-2)

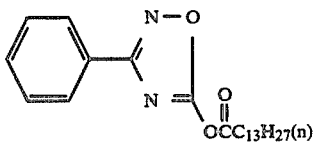

(I-3)

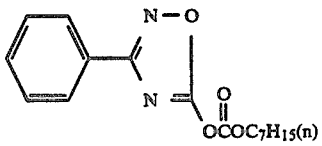

(I-4)

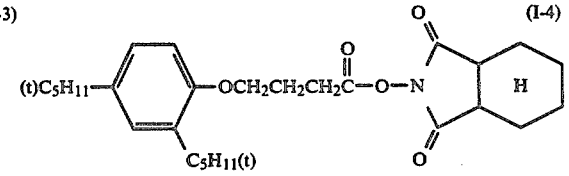

(I-5)

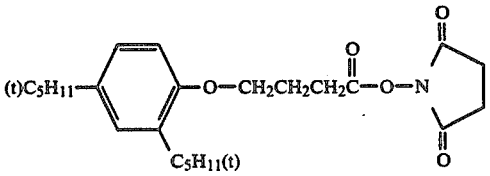

(I-6)

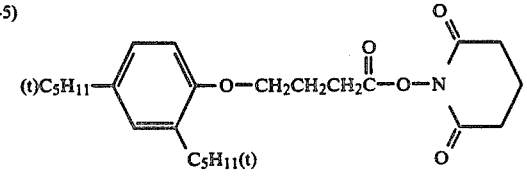

-continued
(I-7)
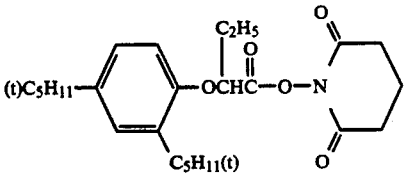
(I-8)
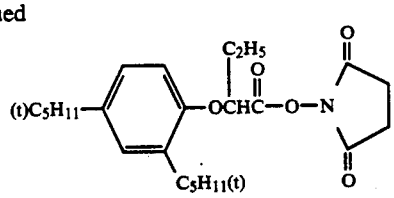
(I-9)
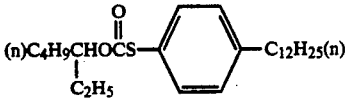
(I-10)
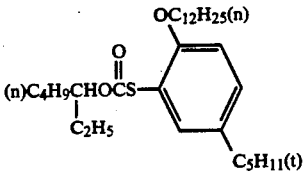
(I-11)
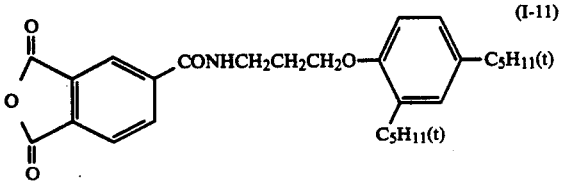
(I-12)
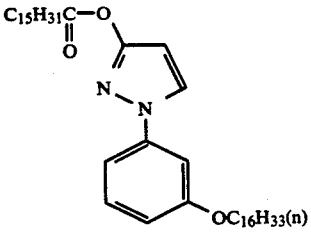
(I-13)
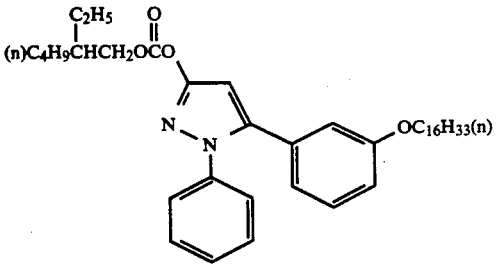
(I-14)
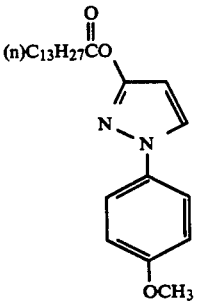
(I-15)
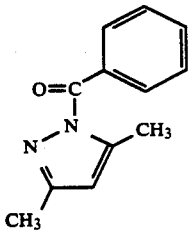
(I-16)
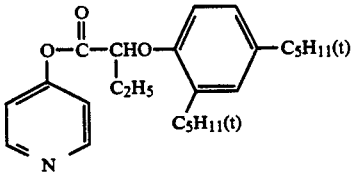
(I-17)
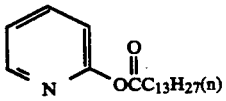
$(n)C_{18}H_{37}Br$
(I-18)
$(n)C_{18}H_{37}I$
(I-19)
(I-20)
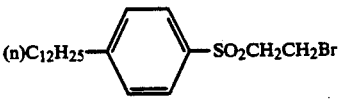
(I-21)
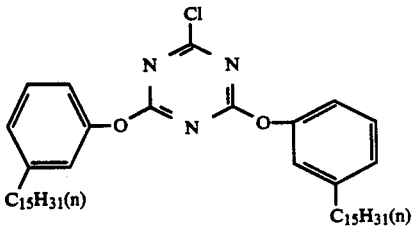
(I-22)
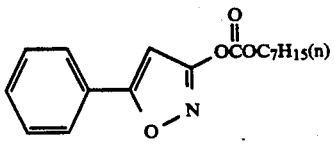

-continued
(I-23)
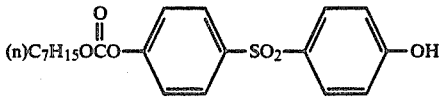
(I-24)
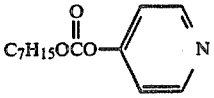
(I-25)
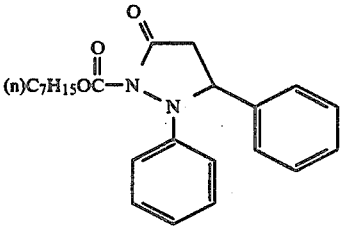
(I-26)
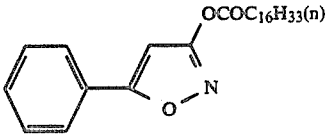
(I-27)
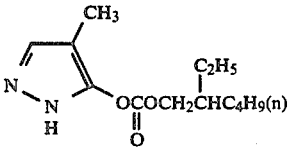
(I-28)
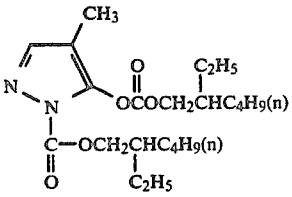
(I-29)
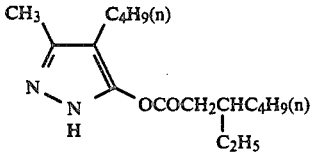
(I-30)
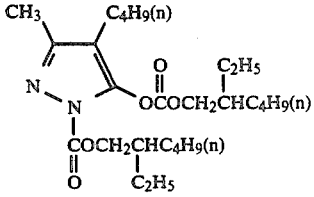
(I-31)
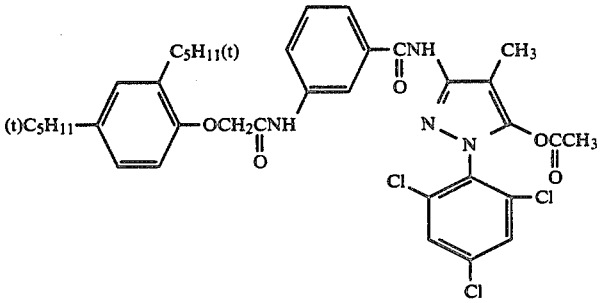
(I-32)
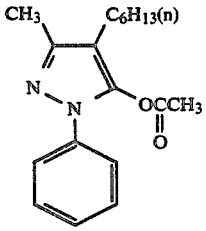
(I-33)
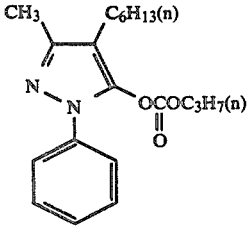
(I-34)
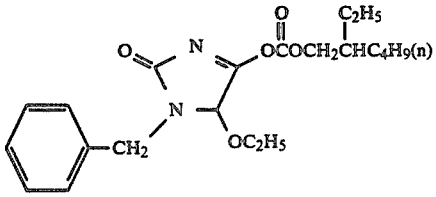
(I-35)
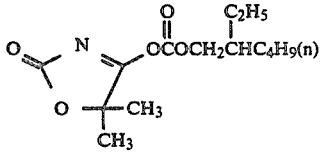

-continued
(I-36)
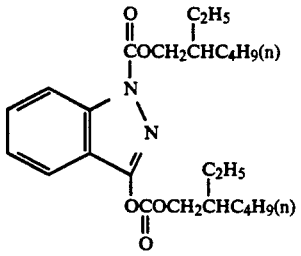
(I-37)
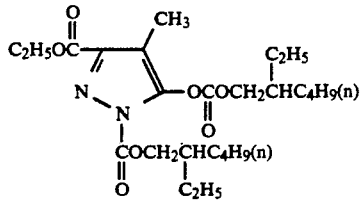
(I-38)
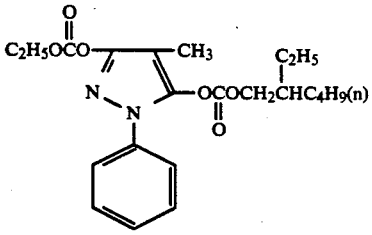
(I-39)
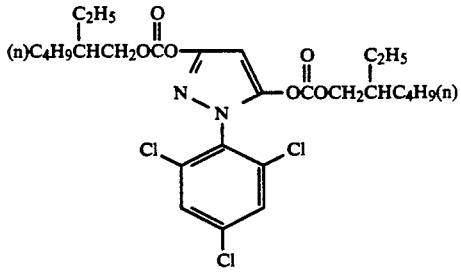
(I-40)
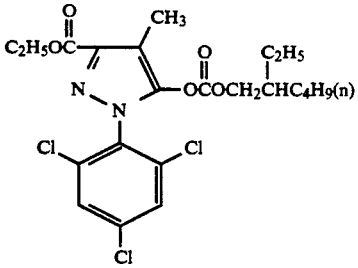
(I-41)
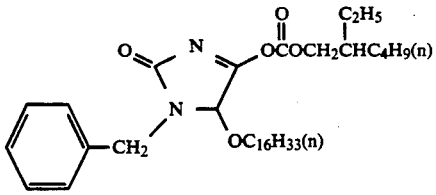
(I-42)
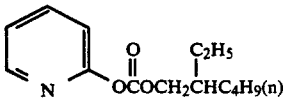
(I-43)
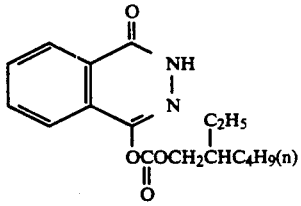
(I-44)
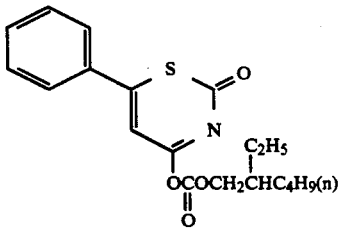
(I-45)
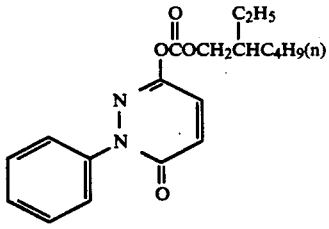
(I-46)
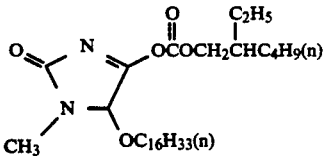
(I-47)
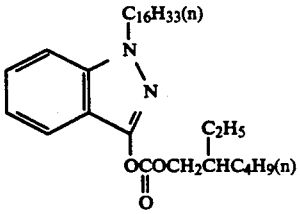
(I-48)
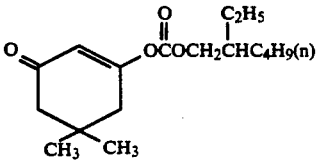
(I-49)
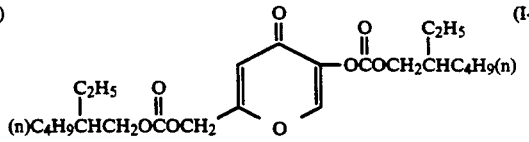

-continued
(I-50)
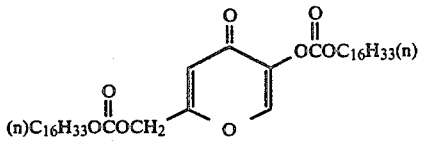
(I-51)
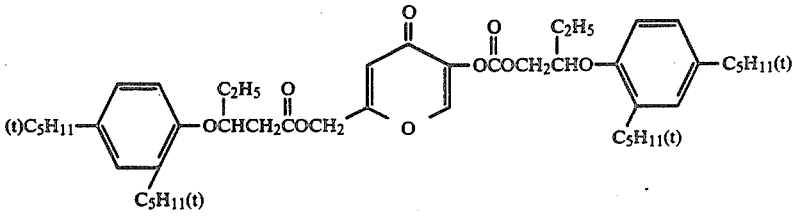
(I-52)
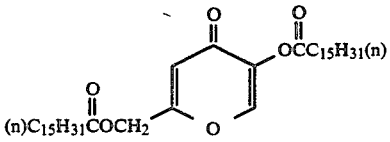
(I-53)
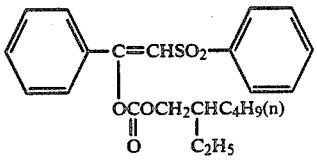
(I-54)
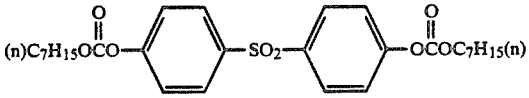
(I-55)
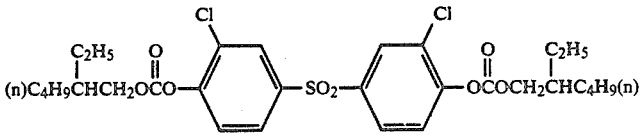
(I-56)
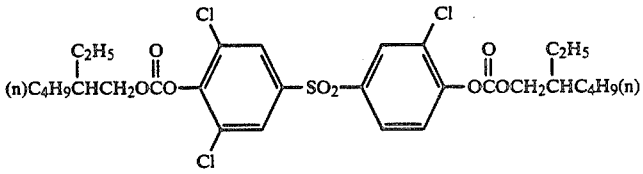
(I-57)
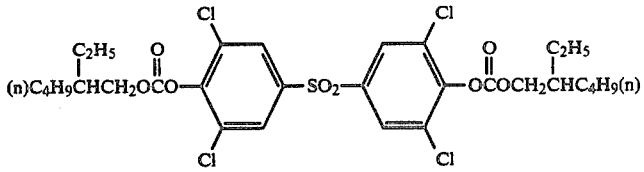
(I-58)
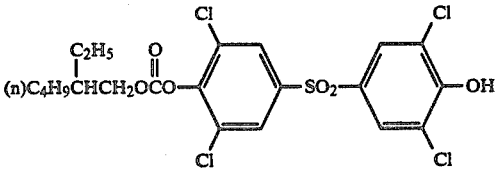
(I-59)
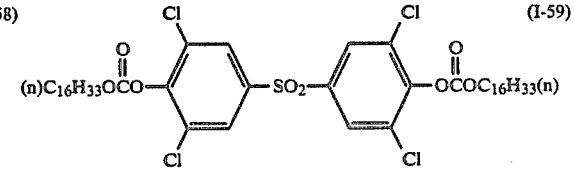
(I-60)
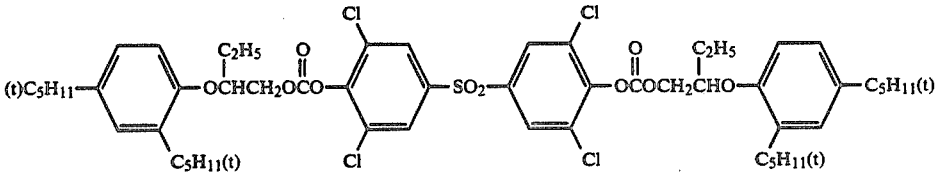

-continued
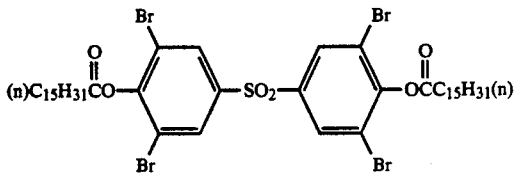
(I-61)
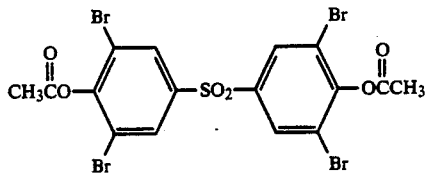
(I-62)
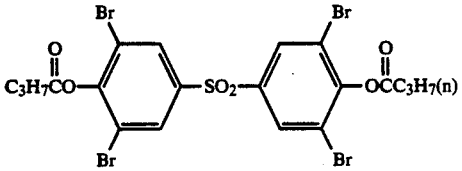
(I-63)
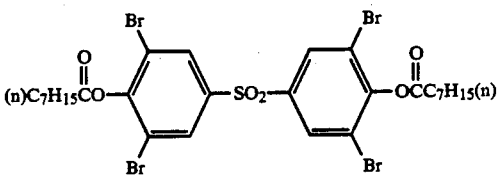
(I-64)
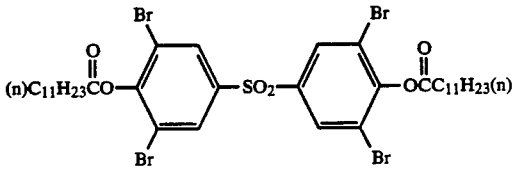
(I-65)
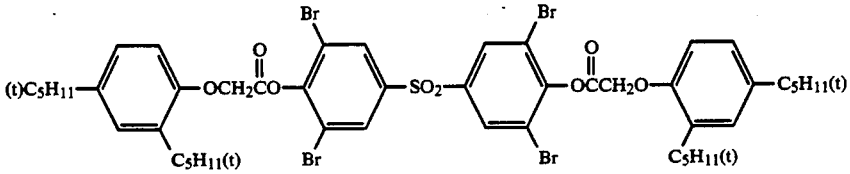
(I-66)
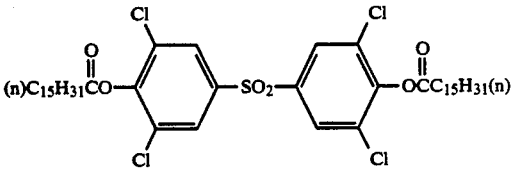
(I-67)
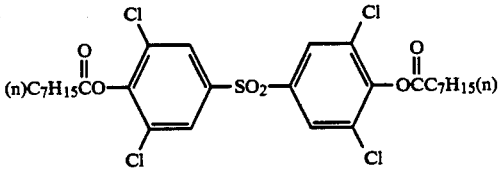
(I-68)
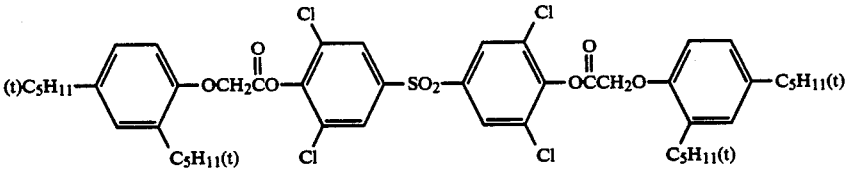
(I-69)
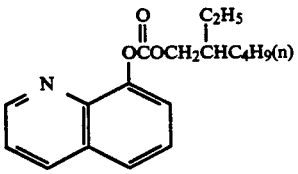
(I-70)
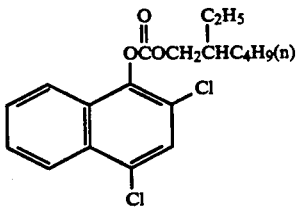
(I-71)
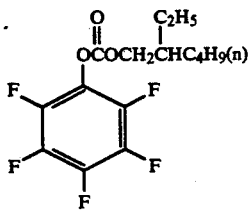
(I-72)
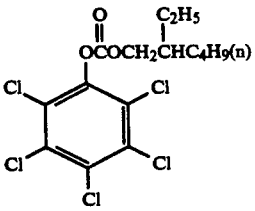
(I-73)

-continued
(I-74)
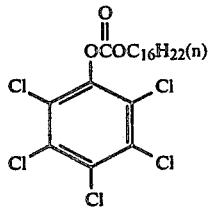
(I-75)
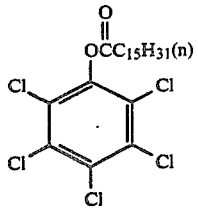
(I-76)
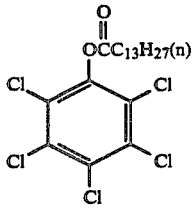
(I-77)
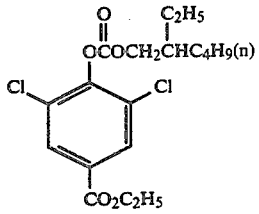
(I-78)
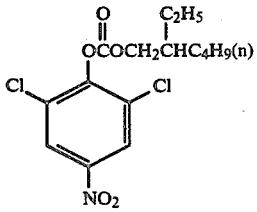
(I-79)
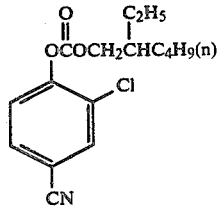
(I-80)
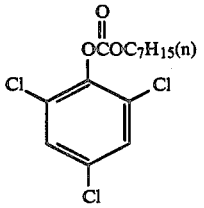
(I-81)
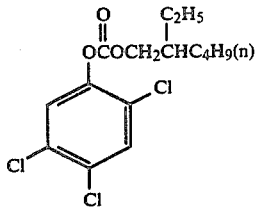
(I-82)
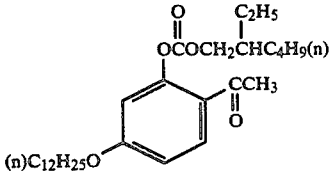
(I-83)
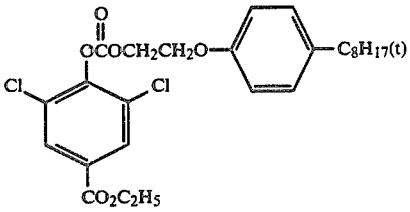
(I-84)
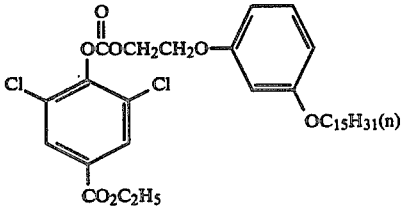
(I-85)
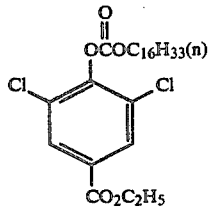
(I-86)
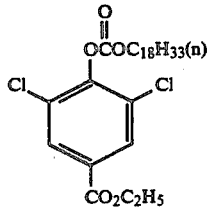
(I-87)
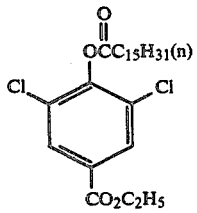

-continued
(I-88)
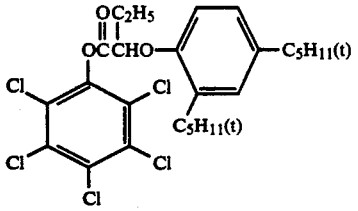
(I-89)
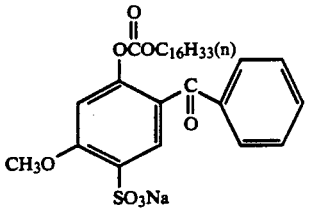
(I-90)
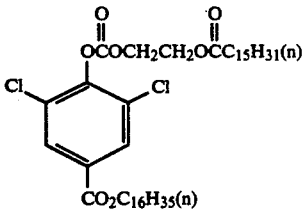
(I-91)
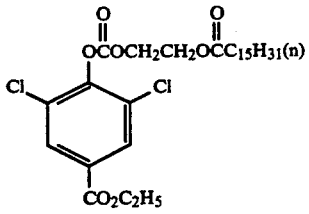
(I-92)
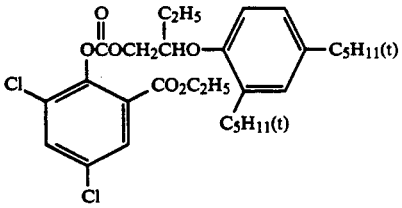
(I-93)
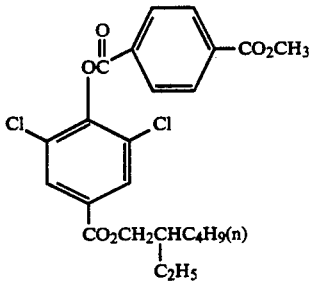
(I-94)
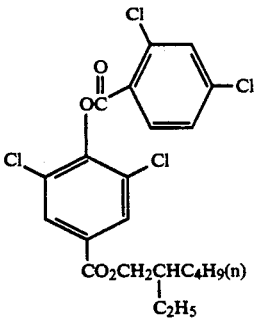
(I-95)
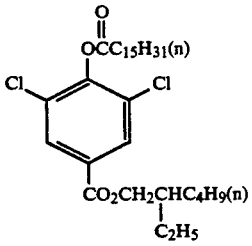
(I-96)
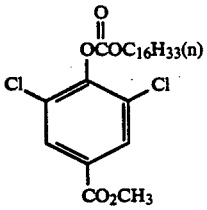
(I-97)
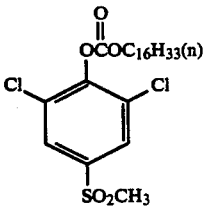
(I-98)
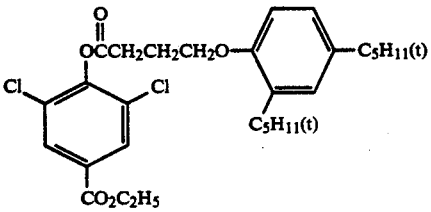
(I-99)
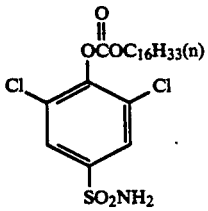

-continued
(I-100)
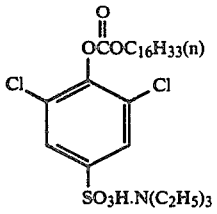
(I-101)
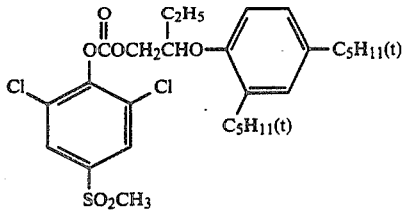
(I-102)
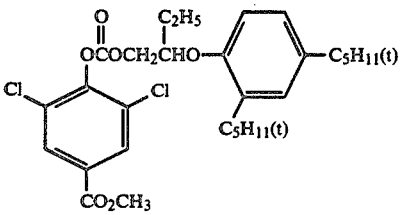
(I-103)
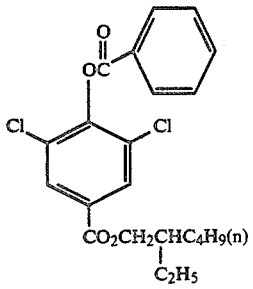
(I-104)
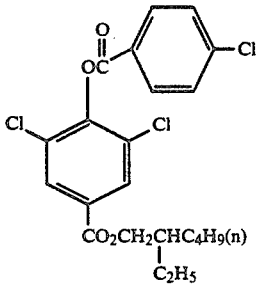
(I-105)
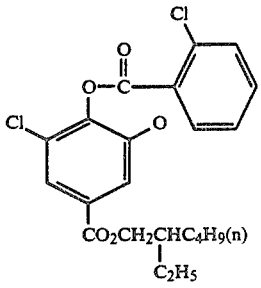
(I-106)
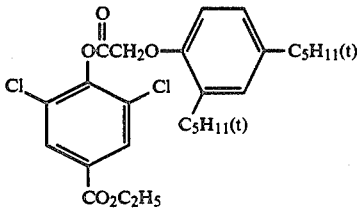
(I-107)
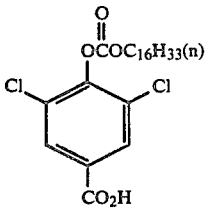
(I-108)
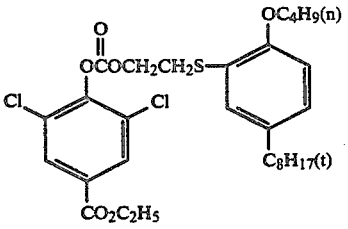
(I-109)
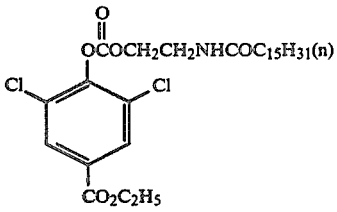
(I-110)
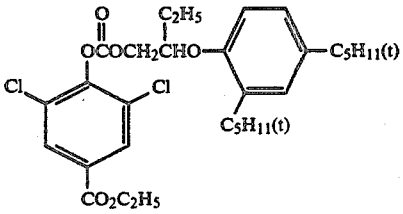
(I-111)
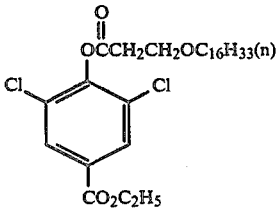

-continued
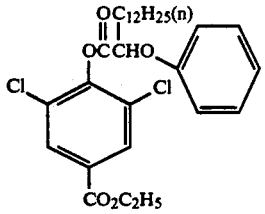
(I-112)
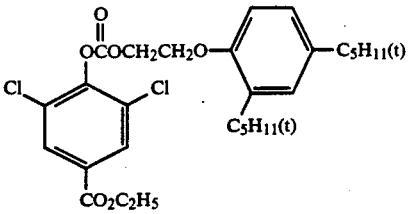
(I-113)
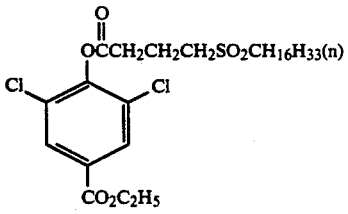
(I-114)
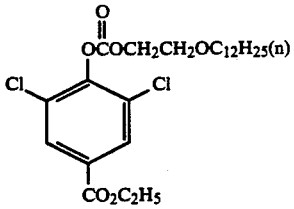
(I-115)
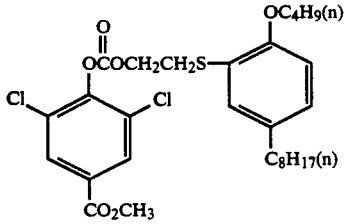
(I-116)
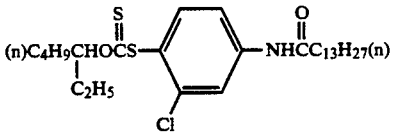
(I-117)
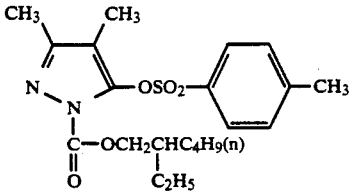
(I-118)
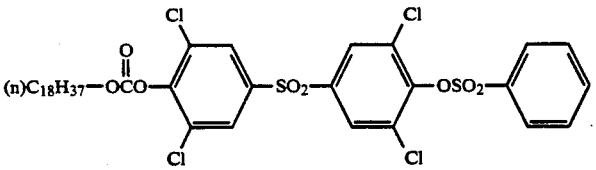
(I-119)
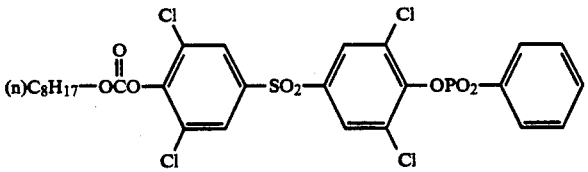
(I-120)
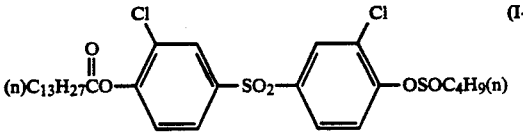
(I-121)
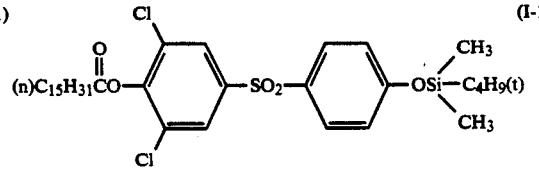
(I-122)

-continued (I-123)

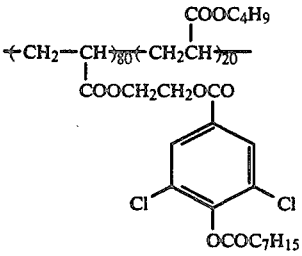

(I-124)

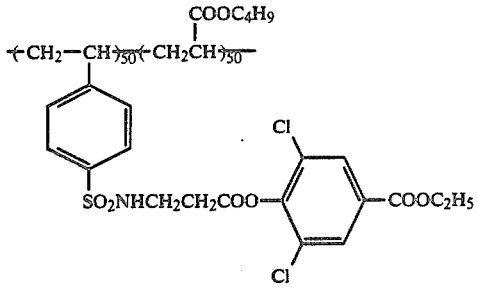

(I-125)

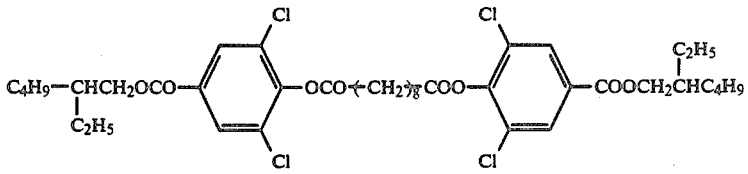

(I-126)

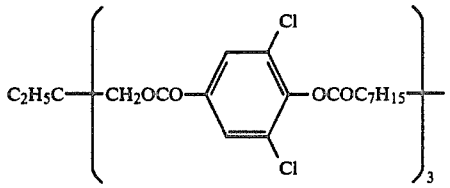

(I-127)

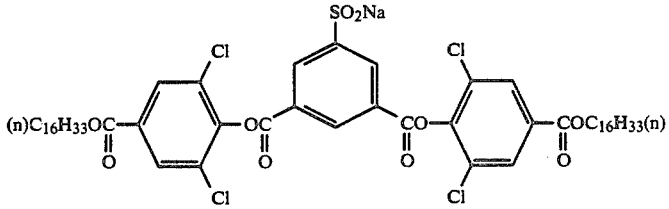

(II-1)

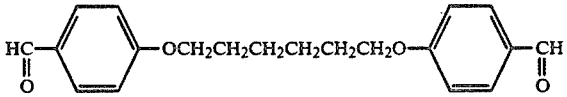

(II-2)

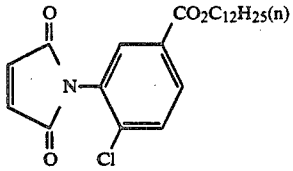

(II-3)

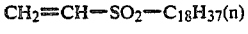

(II-4)

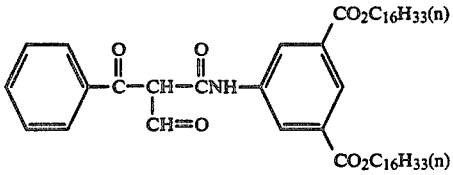

(II-5)

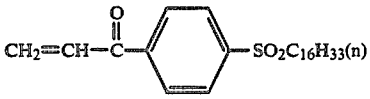

These storability-improving compounds of the present invention can be synthesized by the known methods as described, for example, in E. Müler, *Houben-Weyl Methoden Der Organischen Chemie,* Georg Thieme Verlag, Stuttgart, Band VII and IX, etc.

Examples of synthesis of typical compounds of the present invention are set forth below.

SYNTHESIS EXAMPLE 1 (Synthesis of Compound I-9)

Synthesis of 2-ethylhexyl-4-dodecylbenzenethiocarbonate (above-mentioned Compound I-9)

150 ml of chloroform and 9.9 mol (0.071 mol) of triethylamine were added and dissolved in 18 g (0.065 mol) of 4-dodecylbenzenethio and stirred at 25° C. To this was dropwise added 13.3 g (0.068 mol) of 2-ethylhexyl chlorocarbonate. After stirring for 30 minutes, a cold aqueous hydrochloric acid solution was added to the reaction mixture for liquid separation, and the chloroform layer separated was washed three times with cold water and dried with Glauber's salt. After the Glauber's salt was filtrated out, the chloroform was distilled out and the remaining precipitate was purified by column chromatography. The product was oily. Yield: 17.2 g, 61.2%.

| Result of elementary analysis ($C_{27}H_{46}O_2S_2$) | C | H | S |
|---|---|---|---|
| Measured data (%) | 74.34 | 10.66 | 14.91 |
| Calculated data (%) | 74.60 | 10.67 | 14.75 |

SYNTHESIS EXAMPLE 2 (Synthesis of Compound I-13)

(i) Synthesis of 5-(3-hexadecyloxyphenyl)-3-hydroxy-1-phenylpyrazole 60 ml of toluene and 10 g (0.12 mol) of manganese dioxide were added to 6.3 g (0.013 mol) of 4,5-dihydroxy-5-(3-hexadecyloxyphenyl)-3-hydroxy-1-phenylpyrazole and, heated and stirred for 2 hours on a steam bath. After inorganic substances were filtrated out, the remaining filtrate was concentrated and dried to a solid, and the solid product was crystallized in 20 ml of ethyl acetate. The product crystallized had a melting point of from 108° to 109° C. Yield: 5.8 g, 92.5%.

(ii) Synthesis of 3-(2-ethylhexyloxycarbonyloxy)-5-(3-hexadecyloxyphenyl)-1-phenyl-pyrazole (above-mentioned Compound I-13)

50 ml of chloroform and 1.9 ml (0.014 mol) of triethylamine were added and dissolved in 5.3 g (0.011 mol) of 5-(3-hexadecyloxyphenyl)-3-hydroxy-1-phenylpyrazole and stirred at 25° C. To this was dropwise added 2.3 g (0.012 mol) of 2-ethylhexyl chlorocarbonate. After stirring for 30 minutes, cold water was added to the reaction mixture for liquid separation, and the chloroform layer separated was washed two times with 50 ml of cold water and then dried with Glauber's salt. After the Glauber's salt was filtrated out, the chloroform was distilled out, and the remaining precipitate was purified by column chromatography. The product was oily. Yield: 5.7 g, 82%.

| Result of elementary analysis ($C_{40}H_{60}N_2O_4$) | C | H | N |
|---|---|---|---|
| Measured data (%) | 76.13 | 9.47 | 4.11 |
| Calculated data (%) | 75.91 | 9.56 | 4.43 |

SYNTHESIS EXAMPLE 3 (Synthesis of Compound I-24)

Synthesis of 4-heptyloxycarbonyloxy-pyridine (above-mentioned Compound I-24)

100 ml of chloroform and 7.3 ml (0.052 mol) of triethylamine were added and dissolved in 4.5 g (0.040 mol) of 4-hydroxypyridine-monohydrate and stirred at 25° C. To this was dropwise added 8.9 g (0.050 mol) of heptyl chlorocarbonate. After stirring for 30 minutes, a cold aqueous hydrochloric acid solution was added to the reaction mixture for liquid separation, and the chloroform layer separated was washed two times with cold water and dried with Glauber's salt. After the Glauber's salt was filtrated out, the chloroform was distilled out and the remaining precipitate was purified by column chromatography and crystallized in ethanol. The product had a melting point of from 44° to 50° C. Yield: 7.5 g, 83%.

| Result of elementary analysis ($C_{13}H_{19}NO_3$) | C | H | N |
|---|---|---|---|
| Measured data (%) | 69.52 | 8.47 | 6.03 |
| Calculated data (%) | 69.31 | 8.50 | 6.22 |

SYNTHESIS EXAMPLE 4 (Synthesis of Compound I-57)

Acetonitrile (150 ml) was added to 19.4 g of 3,3',5,5'-tetrachloro-4,4'-dihydroxybiphenylsulfone and 16.8 g of triethylamine with stirring. To the mixture, 21.2 g of 2-ethylhexyl chloroformate was added dropwise at room temperature. After continued stirring for 3 hours, extraction was conducted with ethyl acetate and the ethyl acetate layer was washed with water and dried. The concentrated ethyl acetate layer was purified by chromatography on silica gel column to obtain a white crystal of Compound I-57. Yield: 20.5 g, 58.4%. Melting point: 65°-66° C.

| Result of elementary analysis ($C_{30}H_{38}Cl_4O_8S$) | C | H | Cl | S |
|---|---|---|---|---|
| Measured data (%) | 51.41 | 5.47 | 20.21 | 4.61 |
| Calculated data (%) | 51.44 | 5.47 | 20.24 | 4.58 |

SYNTHESIS EXAMPLE 5 (Synthesis of Compound I-61)

Acetonitrile (300 ml) was added to 11.3 g of 3,3',5,5'-tetrabromobiphenylsulfone and 6.1 ml of triethylamine with stirring. To the mixture, 12.3 g of palmitic acid chloride was added dropwise at room temperature. After continued stirring for 5 hours, the reaction mixture was poured into 500 ml of water. The resulting crystal was recovered by filtration, washed with water and dried. Recrystallization with a mixed solvent of chloroform and ethyl acetate produced a crystal of Compound I-61. Yield: 17.5 g, 84.0%. Melting point: 125°-126° C.

| Result of elementary analysis ($C_{44}H_{66}Br_4O_6S$) | C | H | Br | S |
|---|---|---|---|---|
| Measured data (%) | 50.60 | 6.21 | 30.39 | 3.11 |
| Calculated data (%) | 50.68 | 6.38 | 30.66 | 3.07 |

SYNTHESIS EXAMPLE 6 (Synthesis of Compound I-67)

Acetonitrile (300 ml) was added to 14.0 g of 3,3',5,5'-chloro-4,4'-dihydroxybiphenylsulfone and 11.2 ml of triethylamine with stirring. To the mixture, 22.0 g of palmitic acid chloride was added dropwise at room temperature. After completion of the addition, the internal temperature of the reaction system was elevated to 65° to 70° C. and the mixture was stirred for 1 hour. After completion of the reaction, the reaction mixture was poured into 1,000 ml of water, and the resulting crystal was recovered by filtration, washed with water and dried. Recrystallization with a mixed solvent of chloroform and ethyl acetate produced a crystal of Compound I-61. Yield: 19.7 g, 63.3%. Melting point: 125°-126° C.

| Result of elementary analysis ($C_{44}H_{66}Cl_4O_6S$) | | | | |
|---|---|---|---|---|
| | C | H | Cl | S |
| Measured data (%) | 61.01 | 7.55 | 17.00 | 3.61 |
| Calculated data (%) | 61.10 | 7.69 | 16.40 | 3.71 |

SYNTHESIS 7 (Synthesis of Compound I-110)

10.3 ml (0.0739 mol) of triethylamine was added to a solution of 15.8 g (0.0672 mol) of ethyl 3,5-dichloro-4-hydroxybenzoate in 158 ml of acetonitrile. Under stirring at 0° C., 27.3 g (0.0739 mol) of chlorocarbonyl-2-ethyl-2-(2,4-di(1,1-dimethylpropyl)phenoxy)ethyl was added dropwise at room temperature and the mixture was stirred for one hour and a half. To the reaction mixture, 800 ml of ethyl acetate was added and the ethyl acetate layer was washed with a saturated aqueous solution of sodium chloride and dried with Glauber's salt. After the Glauber's salt was filtered off, the filtrate was concentrated under vacuum to obtain 42.1 g of Compound I-110 in a crude form. The crude product was purified by column chromatography on silica gel (800 g) using a hexane/ethyl acetate mixture as an eluting solvent under varying concentrations of 100/1 to 20/1. Compound I-110 was obtained as a colorless oil. Yield: 35.8 g, 94%.

| Result of elementary analysis ($C_{30}H_{40}Cl_2O_6$) | | | |
|---|---|---|---|
| | C | H | Cl |
| Measured data (%) | 63.68 | 7.06 | 12.23 |
| Calculated data (%) | 63.49 | 7.10 | 12.49 |

Regarding the addition of the compounds of the present invention, those having a low molecular weight or those which are easily soluble in water can be added to processing solutions so that the compounds can be introduced into photographic materials during the processing procedure. Preferably, the compounds of the present invention are added to photographic materials during the manufacture procedure. In the latter case, in general, the compound is dissolved in a single high boiling point solvent (oil) (b.p. 170° C. or more under atmospheric pressure) or in a single low boiling point solvent or in a mixed solvent comprising the oil and a low boiling point solvent, and the resulting solution is emulsified and dispersed in an aqueous solution of a hydrophilic colloid such as gelatin to obtain the compound-containing emulsion. The compounds of the present invention are preferably those which are soluble in high boiling point organic solvents The grain size of the grains in the emulsified dispersion is not specifically limitative but is preferably from 0.05 $\mu$ to 0.5 $\mu$, especially preferred from 0.1 $\mu$ to 0.3 $\mu$. Especially, in view of the effect of the present invention, the compounds of the present invention are preferably those capable of co-emulsifying with couplers. In this case, the ratio of oil/coupler by weight is preferably from 0.00 to 2.0.

The ratio of the compound of the present invention in the emulsion is from $1\times10^{-3}$ to 10 mols, preferably from $3\times10^{-2}$ to 5 mols, per mol of coupler.

As specific examples of the above-mentioned oils, there may be mentioned, for example, alkyl phthalates (e.g., dibutyl phthalate, dioctyl phthalate, diisodecyl phthalate, dimethoxyethyl phthalate, etc.), phosphates (e.g., diphenyl phosphate, triphenyl phosphate, tricresyl phosphate, dioctylbutyl phosphate, monophenyl-p-t-butylphenyl phosphate, etc.), citrates (e.g., tributyl acetylcitrate, etc.), benzoates (e.g., octyl benzoate, etc.), alkylamides (e.g., diethyllaurylamide, dibutyllaurylamide, etc.), fatty acid esters (e.g., dibutoxyethyl succinate, diethyl azelate, etc.), trimesates (e.g., tributyl trimesate, etc.), epoxy ring-containing compounds (e.g., compounds described in U.S. Pat. No. 4,540,657, etc.), phenols (e.g.,

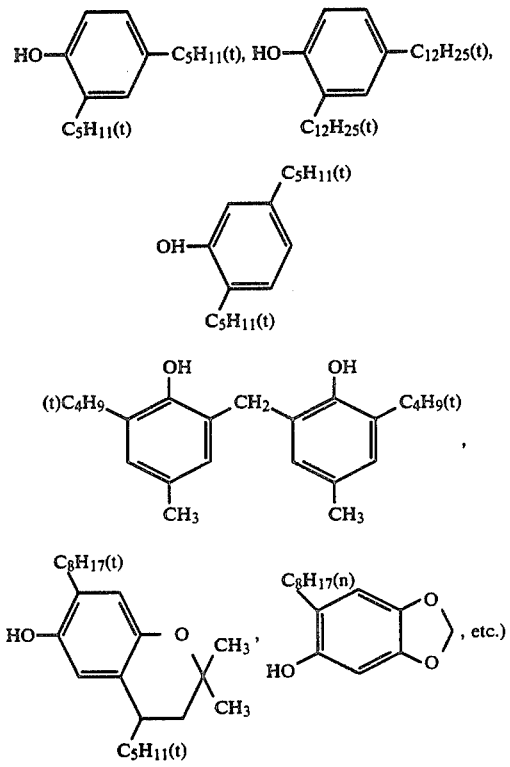

and ethers (e.g., phenoxyethanol, diethylene glycol-monophenylether, etc.).

As low boiling point solvents which are used as an auxiliary solvent, there may be mentioned organic solvents having a boiling point of from about 30° C. to about 150° C. under atmospheric pressure, for example, lower alkyl acetates such as ethyl acetate, isopropyl acetate and butyl acetate as well as ethyl propionate, methanol, ethanol, secondary butyl alcohol, cyclohexanol, fluorinated alcohols, methylisobutylketone, 8-ethoxyethyl acetate, methylcellosolve acetate, acetone, methyl acetone, acetonitrile, dioxane, dimethylformamide, dimethylsulfoxide, chloroform, cyclohexane, etc.

In place of the high boiling point organic solvents, not only oily solvents of additives such as couplers (including substances which are solid at room temperature, such as wax, etc.) but also latex polymers can be used. Otherwise, additives themselves, such as couplers, color mixing preventing agents, ultraviolet absorbents, etc., can be used as oily solvents.

As the latex polymers, those obtained from one or more monomers selected from acrylic acid, methacrylic acid and esters thereof (e.g., methyl acrylate, ethyl acrylate, butyl methacrylate, etc.), acrylamide, methacrylamide, vinyl esters (e.g., vinyl acetate, vinyl propionate, etc.), acrylonitrile, styrene, divinylbenzene, vinylalkylethers (e.g., vinyl-ethylether, etc), maleates (e.g., methyl maleate), N-vinyl-2-pyrrolidone, N-vinylpyridine, 2- and 4-vinylpyridine, etc. The monomers can be used singly or in mixtures thereof.

As examples of surfactants to be used for dispersing the solution containing the compound of the present invention singly or in the form of a mixture with a coupler into an aqueous protective colloid solution, there may be mentioned saponin as well as sodium alkyl-sulfosuccinates, sodium alkylbenzene-sulfonates, etc.

The compounds of the present invention can be used in the form of a mixture with a yellow coupler, a magenta coupler or a cyan coupler. In particular, the combined use of the compounds together with a magenta coupler is preferred for sufficiently attaining the effect of the present invention.

The couplers to be used in combination with the compound of the present invention may be either 4-equivalent or 2-equivalent to silver ion and may also be in the form of a polymer or an oligomer. In addition, the couplers for use in combination may be either single or in the form of a mixture of two or more of the couplers.

Preferred examples of the couplers for use in the present invention are those represented by the following formulae:

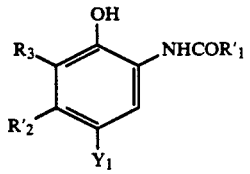
(III)

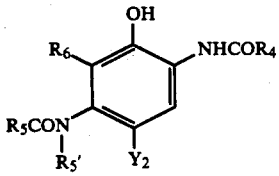
(IV)

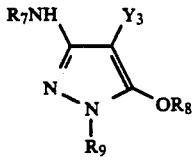
(V)

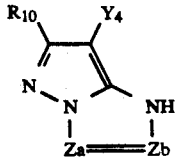
(VI)

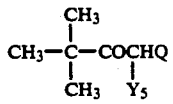

In these formulae, $R'_1$, $R_4$ and $R_5$ each represents an aliphatic group, an aromatic group, a heterocyclic group, an aromatic amino group or a heterocyclic amino group; $R'_2$ represents an aliphatic group; $R_3$ and $R_6$ each represents a hydrogen atom, a halogen atom, an aliphatic group, an aliphatic-oxy group or an acylamino group; $R_5'$ represents a hydrogen atom or has the same meaning as $R_5$; $R_7$ and $R_9$ each represents a substituted or unsubstituted phenyl group; $R_8$ represents a hydrogen atom, an aliphatic or aromatic acyl group or an aliphatic or aromatic sulfonyl group; $R_{10}$ represents a hydrogen atom or a substituent; Q represents a substituted or unsubstituted N-phenylcarbamoyl group; Za and Zb each represents a methine group, a substituted methine group or =N—; $Y_1$, $Y_2$, $Y_3$, $Y_4$ and $Y_5$ each represents a hydrogen atom or a group capable of being removed in a coupling reaction with an oxidized product of a developing agent (hereinafter referred to as a "removing group").

In the formula (III), the typical examples of the substituents and those couplers are those described in U.S. Pat. Nos. 4,518,687, 4,511,647, 3,772,002 and 4,564,590, Canadian Patent 625,822, and Japanese Patent Application (OPI) Nos. 39045/86 and 70846/87.

In the formula (IV), the typical examples of the substituents and these couplers are as described in U.S. Pat. Nos. 2,772,162, 2,895,826, 4,334,011, 4,500,635, 4,565,777, 4,124,396 and 4,613,564, and Japanese Patent Application (OPI) No. 164555/84.

In the formulae (III) and (IV), $R'_2$ and $R_3$, and $R_5$ and $R_6$ each may form a 5-, 6- or 7-membered ring as described in U.S. Pat. Nos. 4,327,173, 4,564,586 and 4,430,423, and Japanese Patent Application (OPI) No. 390441/86. Further, the typical examples of cyan couplers having an ureido group are those described in U.S. Pat. Nos. 4,333,999, 4,451,559, 4,444,872, 4,427,767 and 4,579,813, and European Patent 067,689 B1.

In the formula (V), the typical examples of the substituents and these couplers are those described in U.S. Pat. Nos. 2,311,082, 2,343,703, 2,600,788, 2,908,573, 3,062,653, 3,152,896, 3,936,015, 4,310,619 and 4,351,897.

In the formula (VI), the typical examples of the substituents and these couplers are those described in U.S. Pat. Nos. 4,500,630 and 4,540,654, Japanese Patent Application (OPI) Nos. 65245/86, 65246/86 and 147254/86, and European Patent 226,849.

In the formula (VII), the typical examples of the substituents and these couplers are those described in U.S. Pat. Nos. 4,622,287, 4,622,287, 4,623,616, 3,408,194, 3,933,501, 4,046,575, 4,133,958 and 4,401,752.

In addition, $R'_1$, $R'_2$, $R_3$ or $Y_1$; $R_4$, $R_5$, $R_6$ or $Y_2$; $R_7$, $R_8$, $R_9$ or $Y_3$; $R_{10}$, Za, Zb or $Y_4$; and Q or $Y_5$ may form a dimer or higher polymer.

The aliphatic group as referred to herein means a linear, branched or cyclic alkyl, alkenyl or alkynyl group.

Specific examples of the couplers of the formulae (III) and (IV) are set forth below.

(C-1)
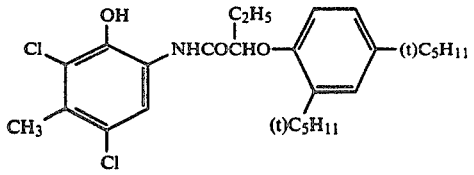
(C-2)
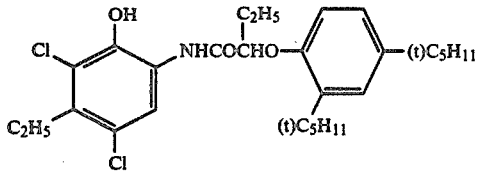
(C-3)
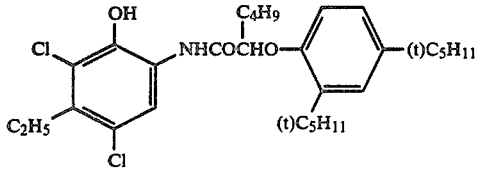
(C-4)
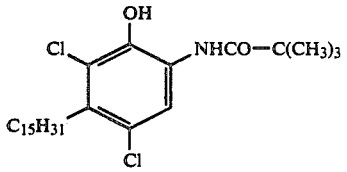
(C-5)
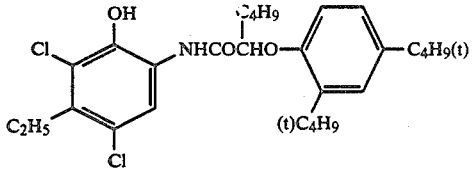
(C-6)
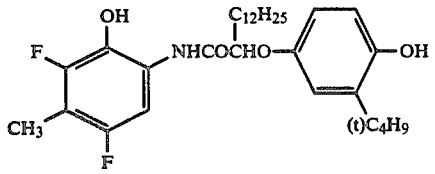
(C-7)
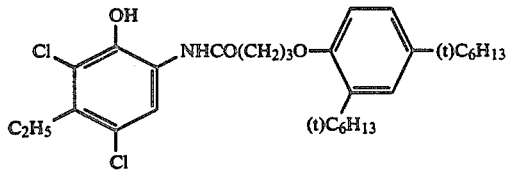
(C-8)
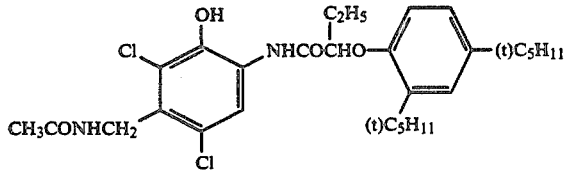

-continued
(C-9)
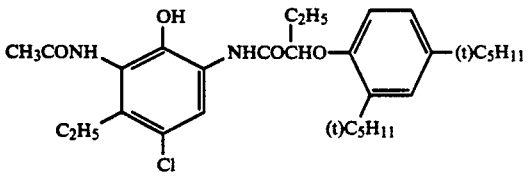
(C-10)
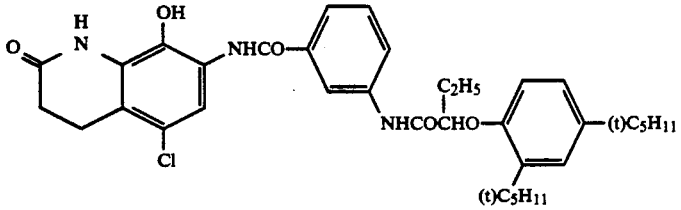
(C-11)
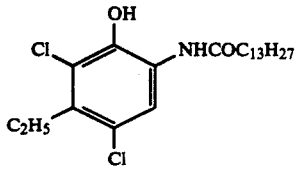
(C-12)
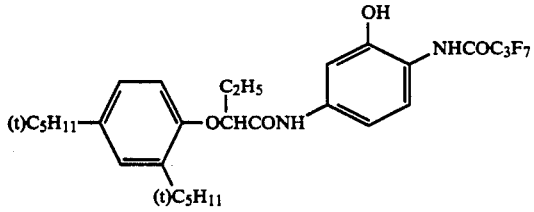
(C-13)
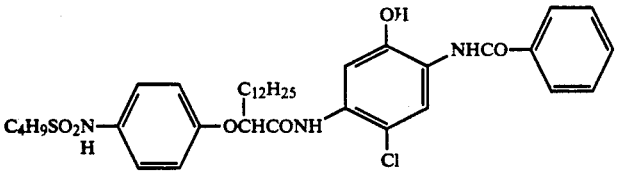
(C-14)
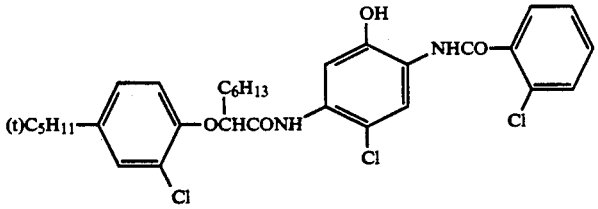
(C-15)
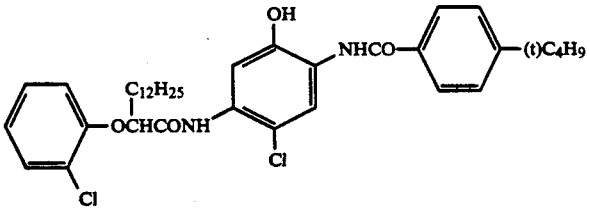
(C-16)
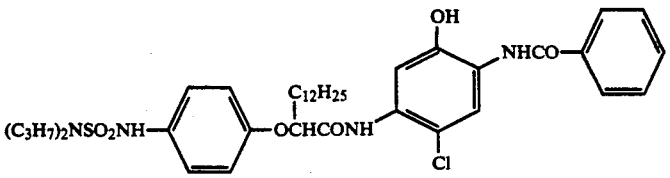

-continued
(C-17)
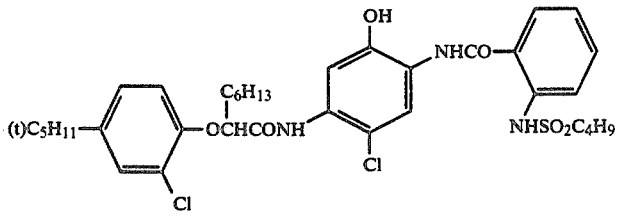
(C-18)
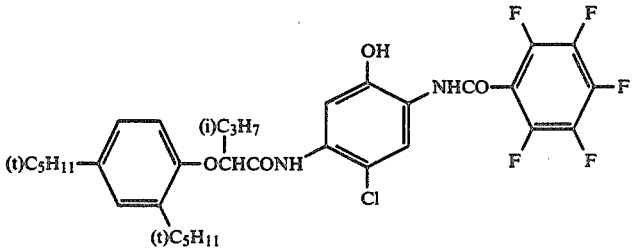
(C-19)
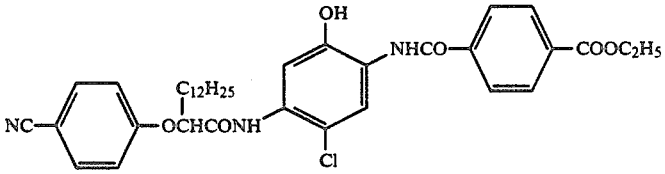
(C-20)
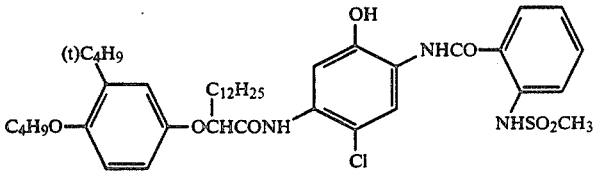
(C-21)
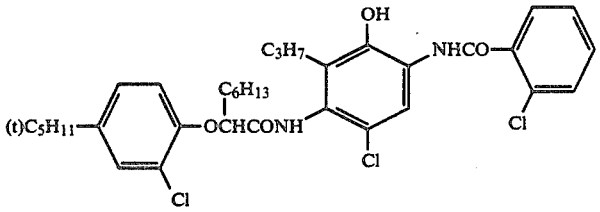
(C-22)
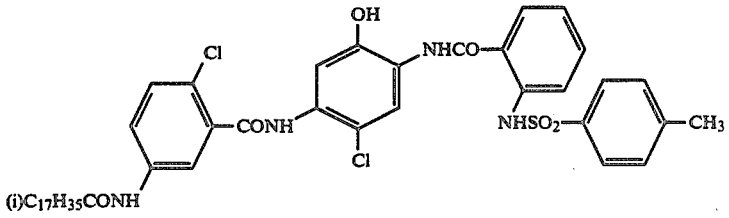
(C-23)
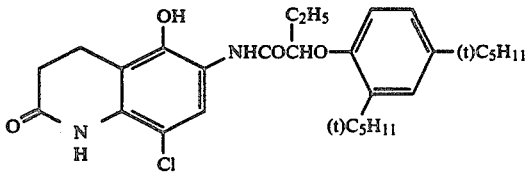

-continued
(C-24)
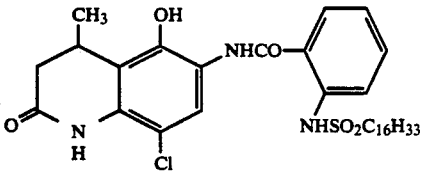
(C-25)
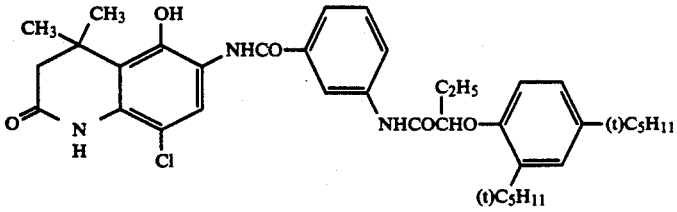
(C-26a)
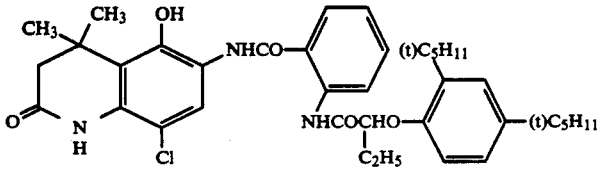
(C-26b)
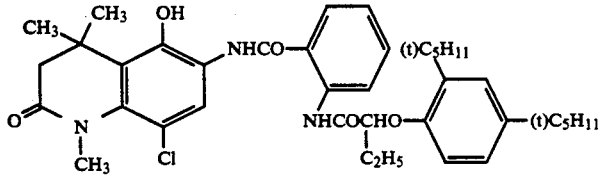
(C-27)
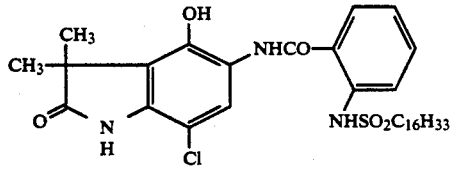
(C-28)
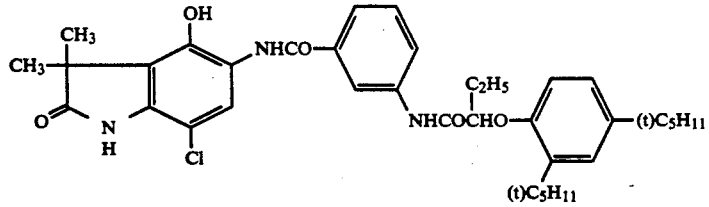
(C-29)
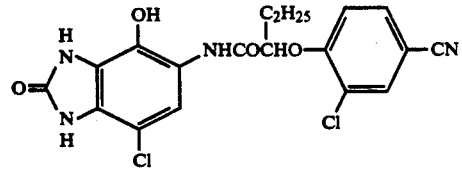
(C-30)
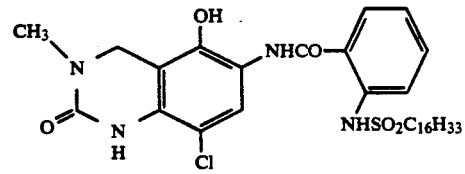

-continued
(C-31)
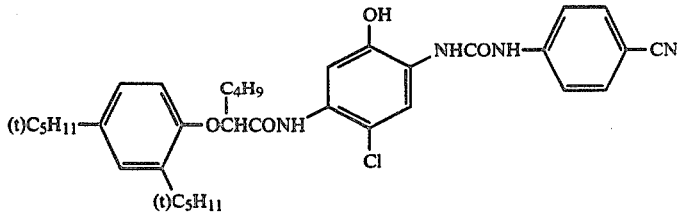
(C-32)
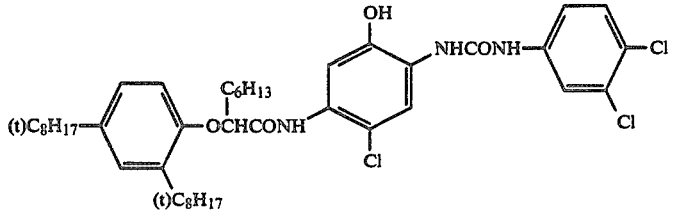
(C-33)
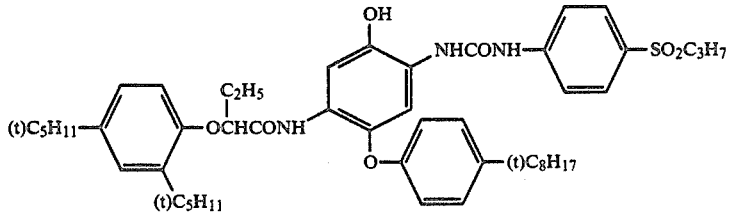
(C-34)
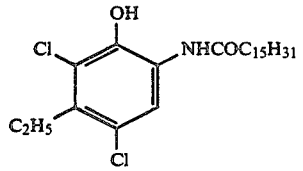
(C-35)
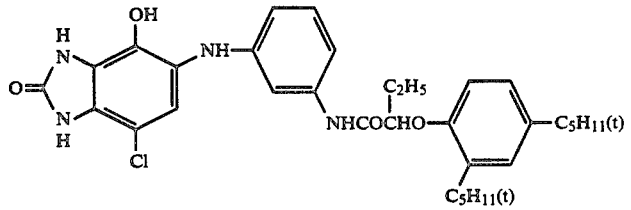
(C-36)
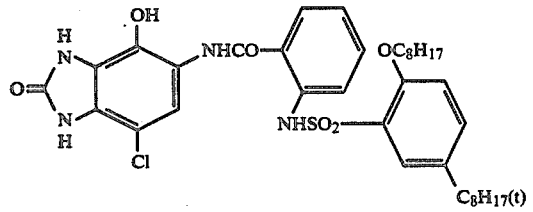
(C-37)
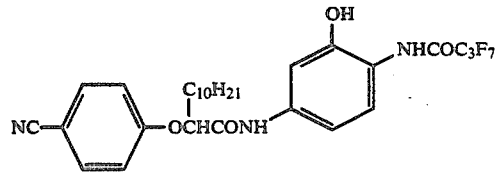

-continued
(C-38)
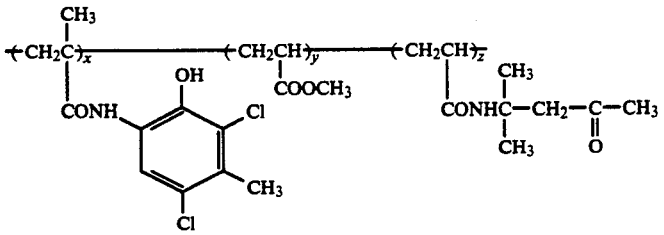
x/y/z = 50/20/30 (by weight)
(C-39)
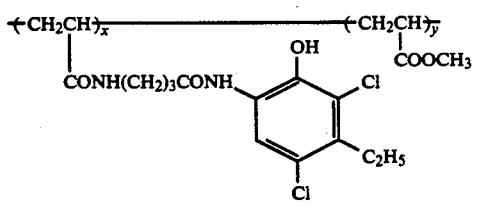
x/y = 55/45 (by weight)
(C-40)
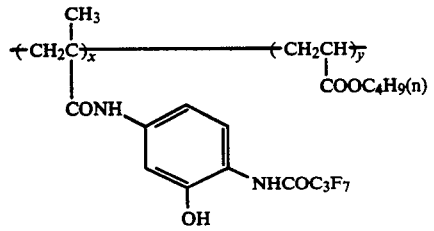
x/y = 60/40 (by weight)
(C-41)
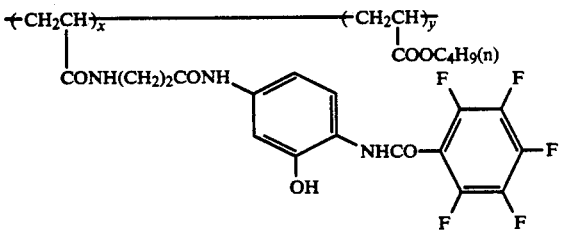
x/y = 50/50 (by weight)
(C-42)
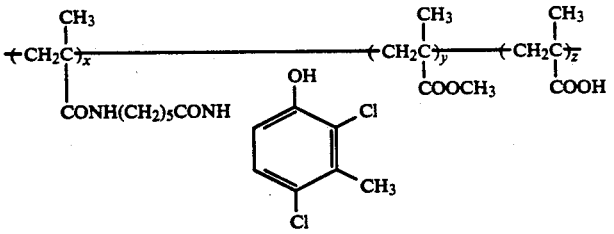
x/y/z = 55/40/5 (by weight)
(C-43)
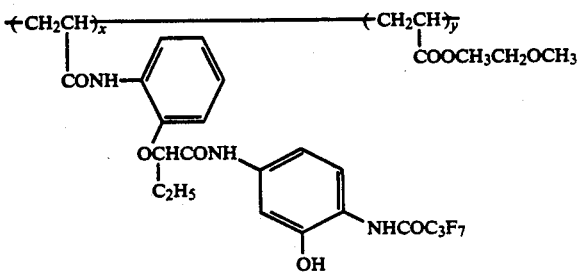
x/y = 60/40 (by weight)

-continued
(C-44)
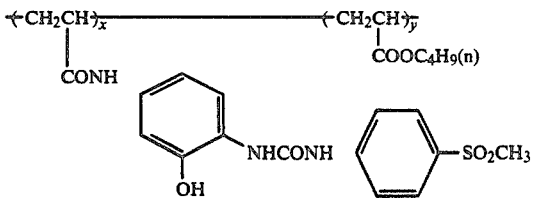
x/y = 50/50 (by weight)
(C-45)
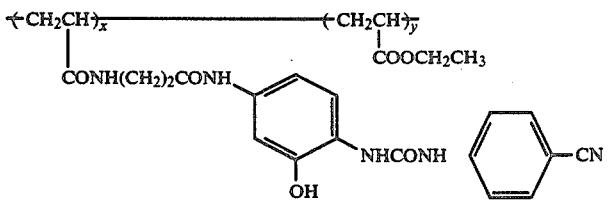
x/y = 45/55 (by weight)
(C-46)
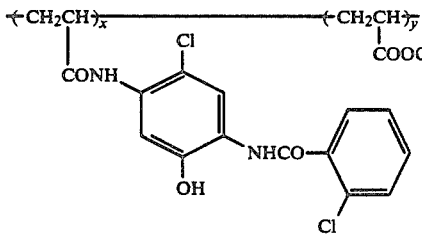
x/y = 50/50 (by weight)
(C-47)
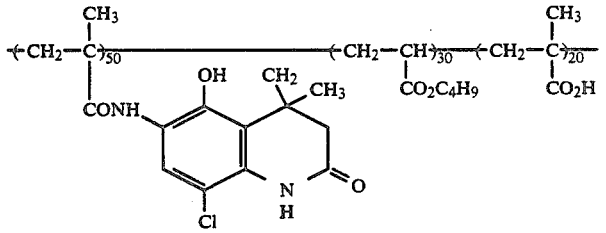
(C-48)
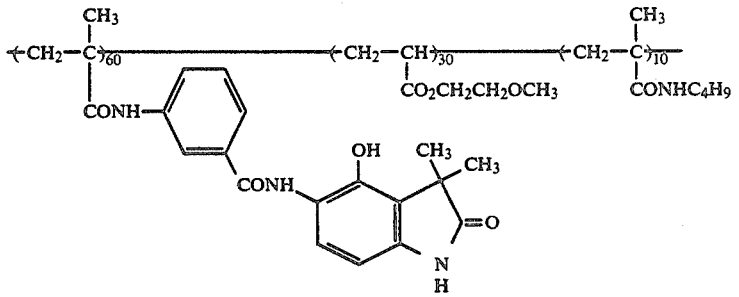
(C-49)
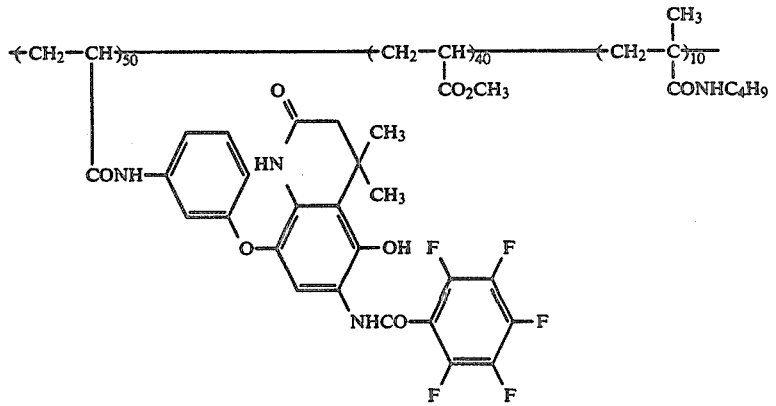

Specific examples of the couplers of the formulae (V) and (VI) are set forth below.
(M-1)
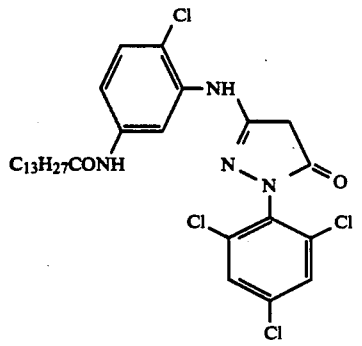
(M-2)
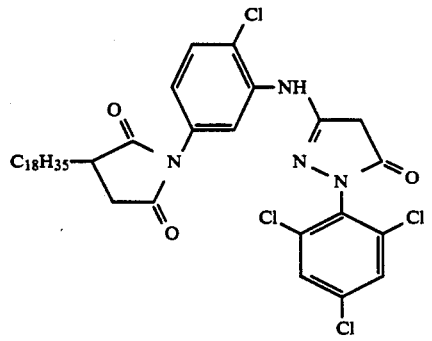
(M-3)
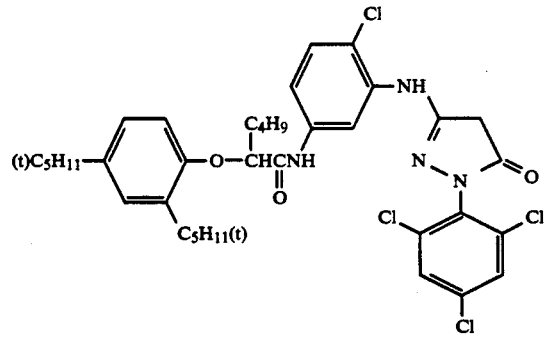
(M-4)
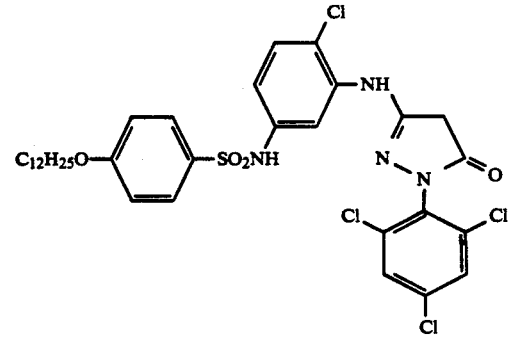

-continued
(M-5)
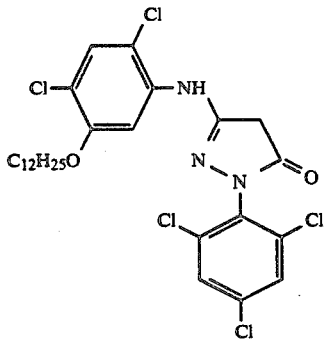
(M-6)
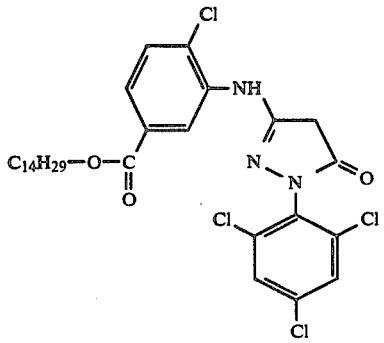
(M-7)
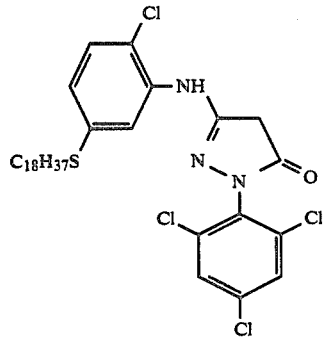
(M-8)
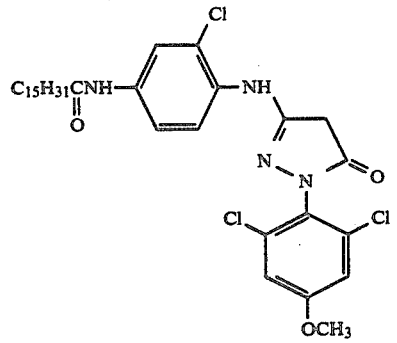
(M-9)
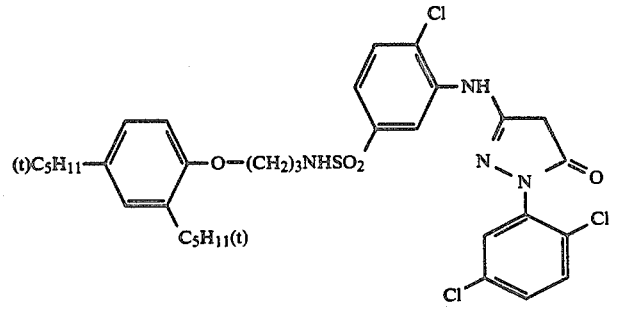

-continued
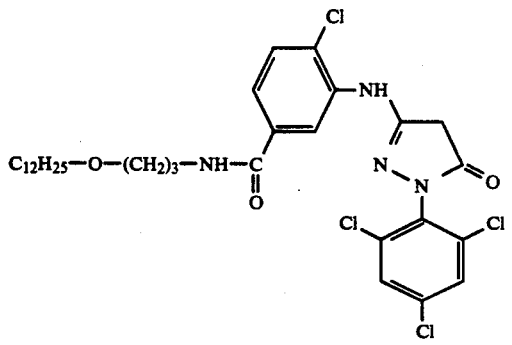
(M-10)
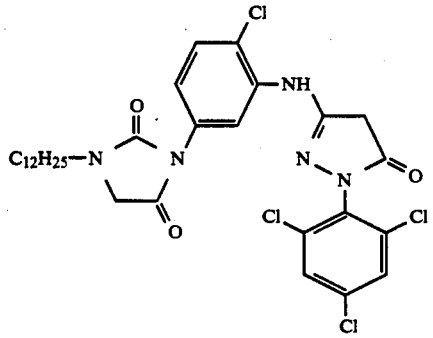
(M-11)
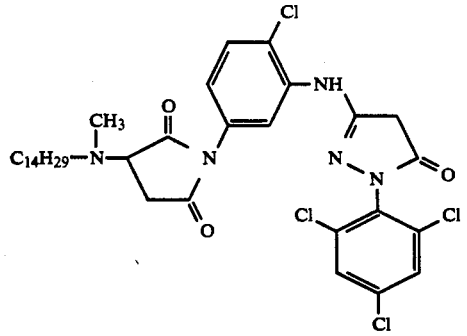
(M-12)
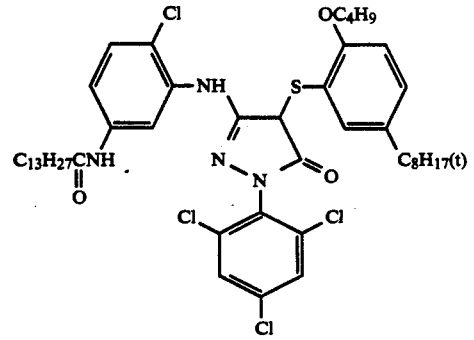
(M-13)

-continued
(M-14)
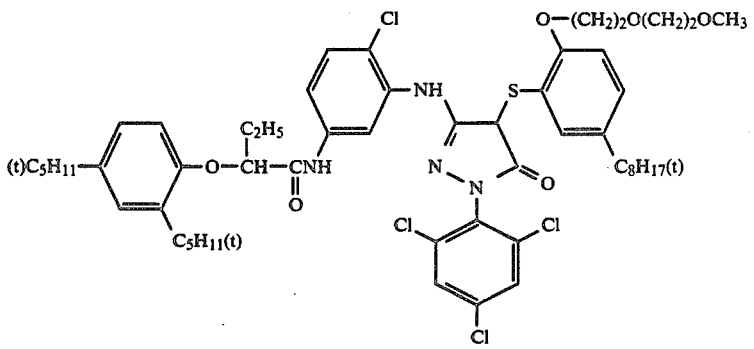
(M-15)
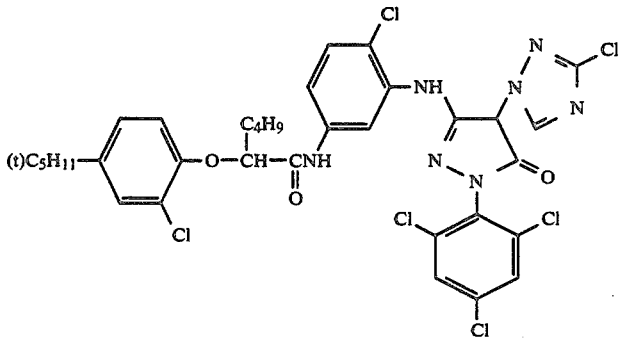
(M-16)
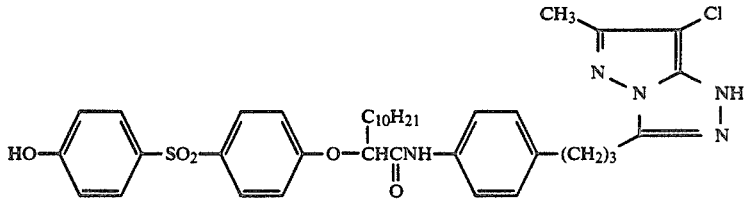
(M-17)
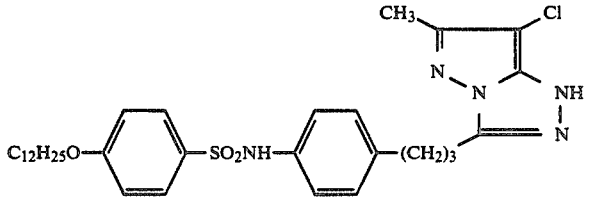
(M-18)
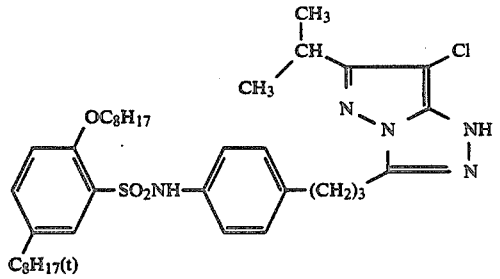
(M-19)
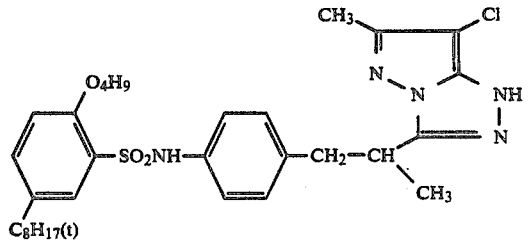

-continued
(M-20)
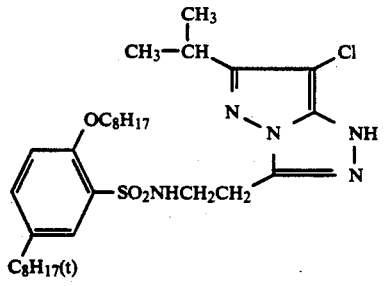
(M-21)
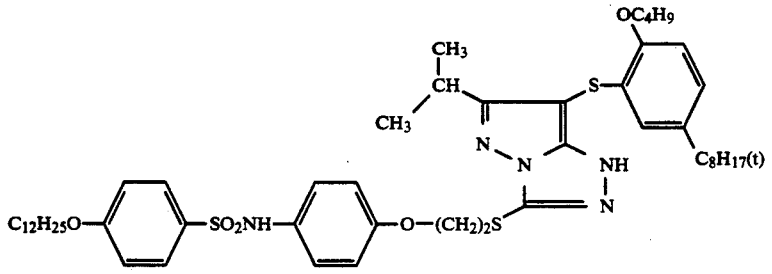
(M-22)
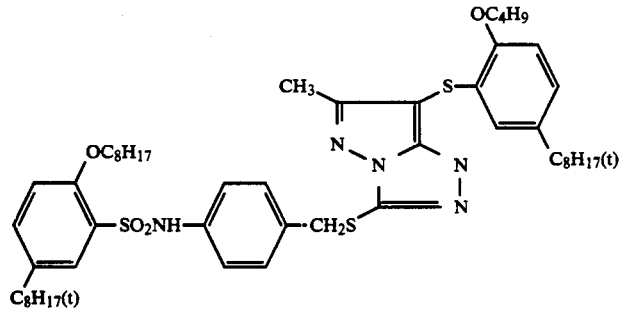
(M-23)
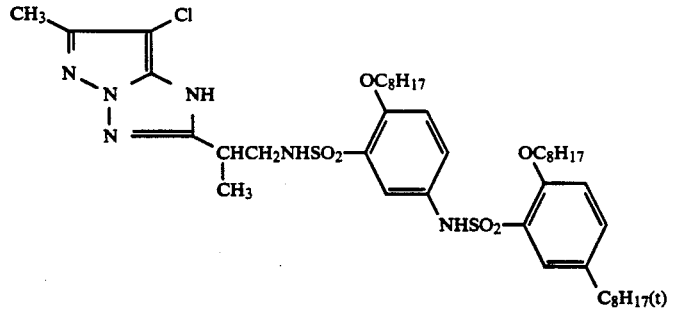
(M-24)
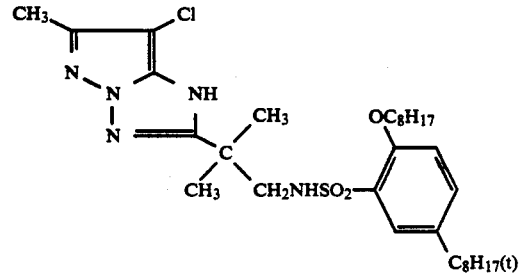

-continued
(M-25)
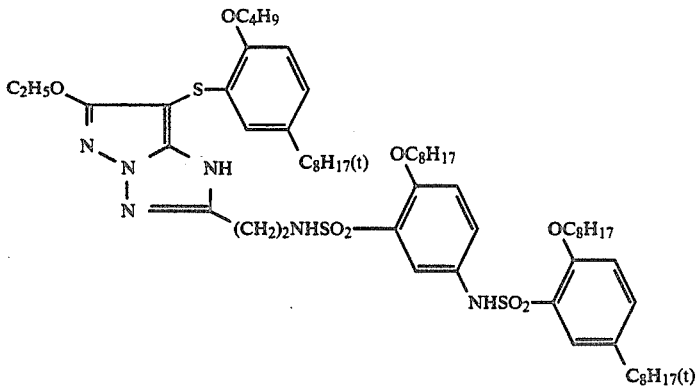
(M-26)
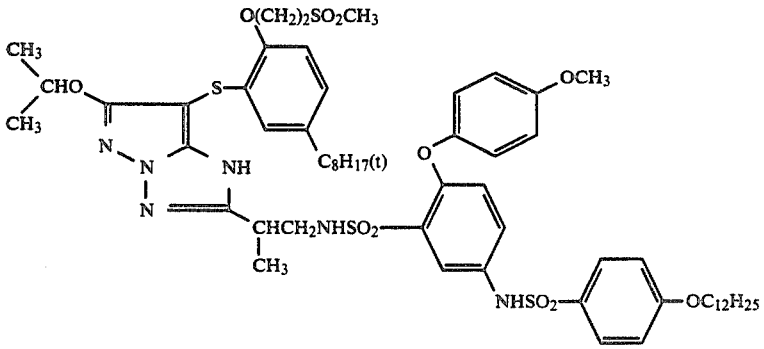
(M-27)
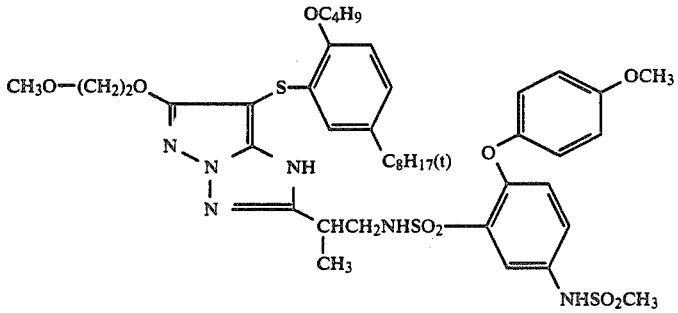
(M-28)
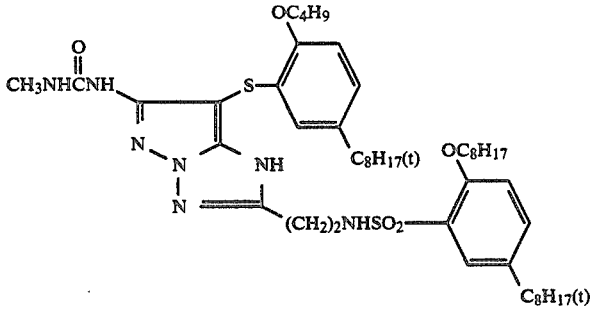
(M-29)
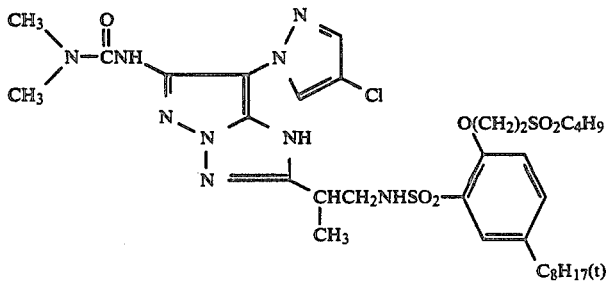

-continued
(M-30)
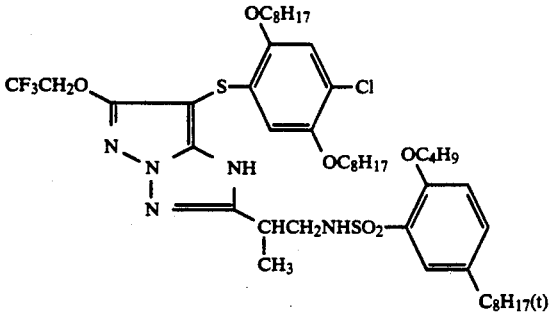
(M-31)
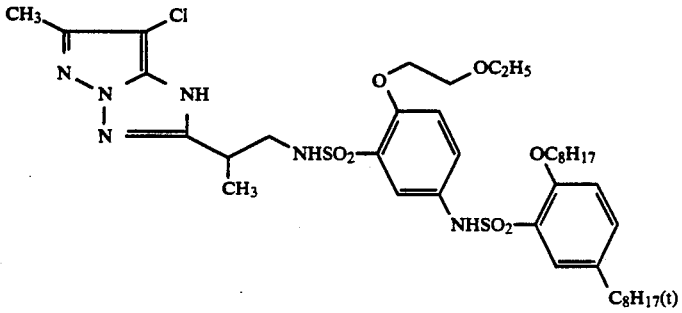
(M-32)
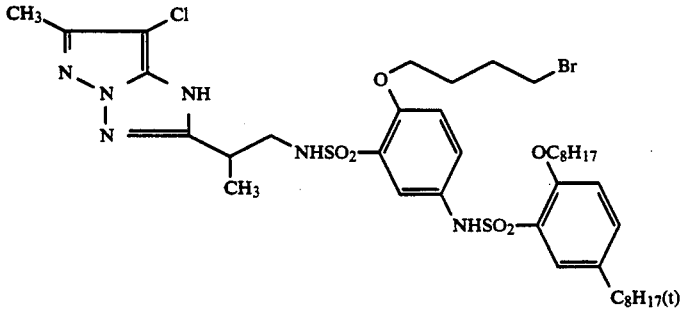
(M-33)
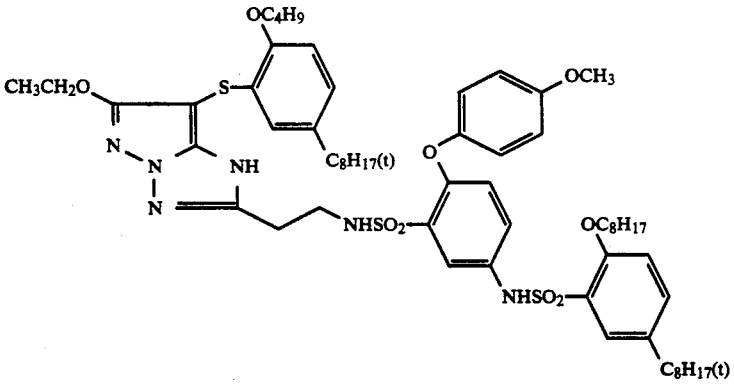
(M-34)
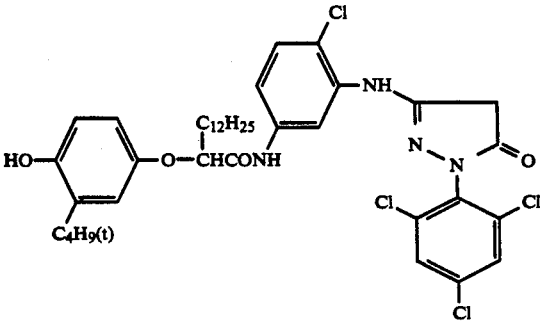

-continued
(M-35)
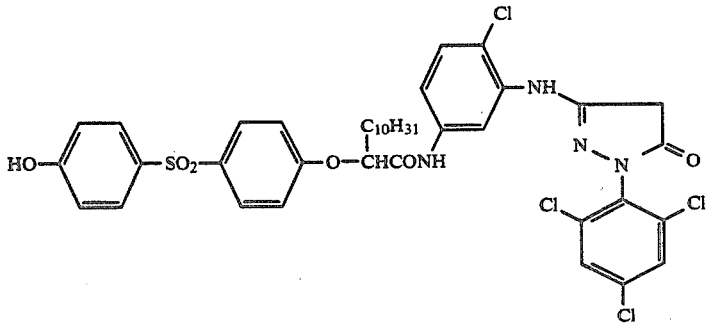
(M-36)
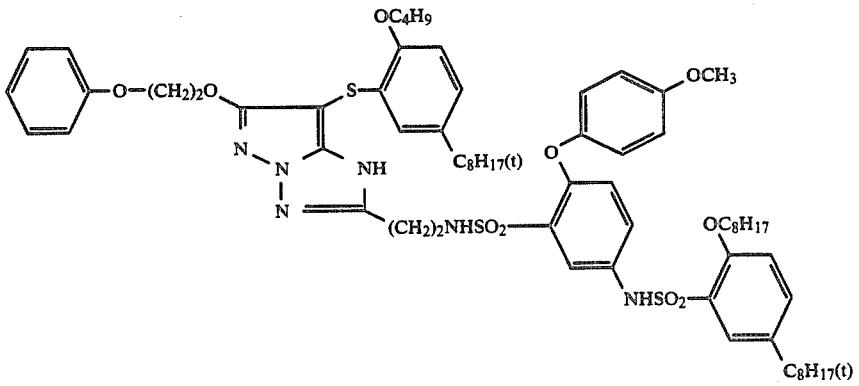
(M-37)
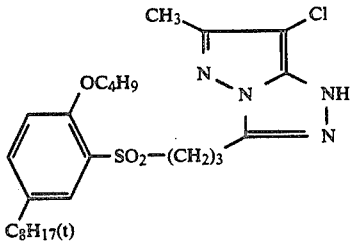
(M-38)
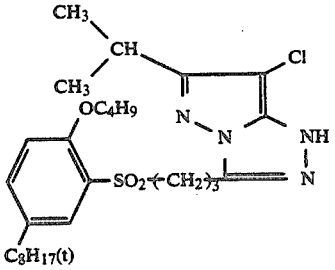
(M-39)
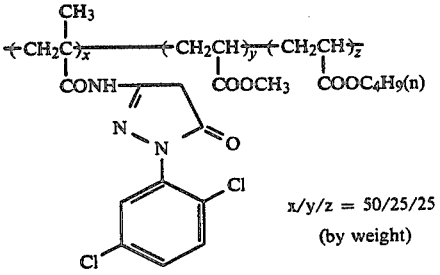
x/y/z = 50/25/25
(by weight)

-continued
(M-40)
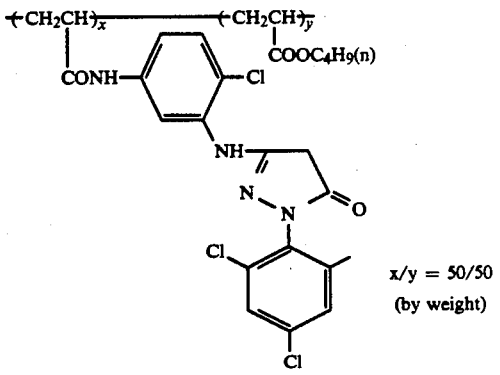
x/y = 50/50
(by weight)
(M-41)
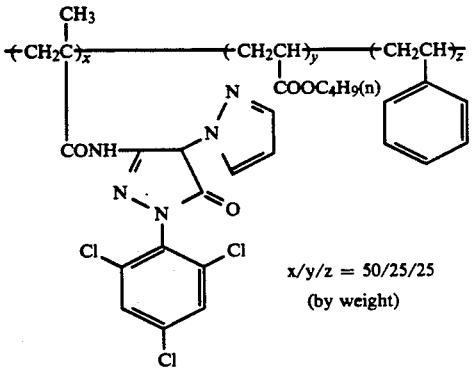
x/y/z = 50/25/25
(by weight)
(M-42)
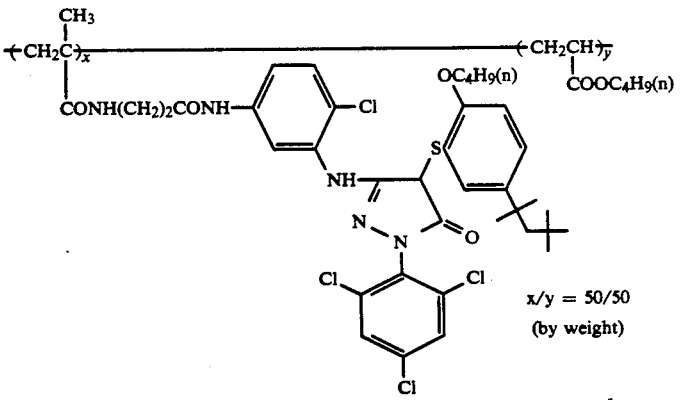
x/y = 50/50
(by weight)
(M-43)
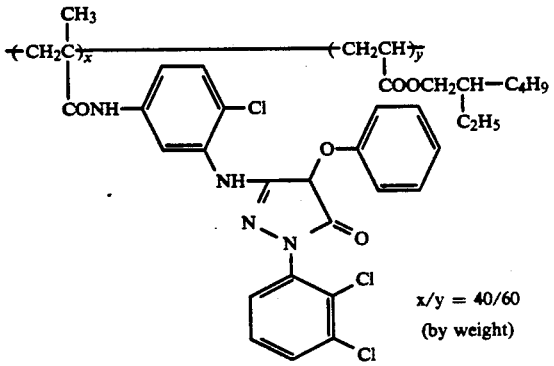
x/y = 40/60
(by weight)

-continued
(M-44)
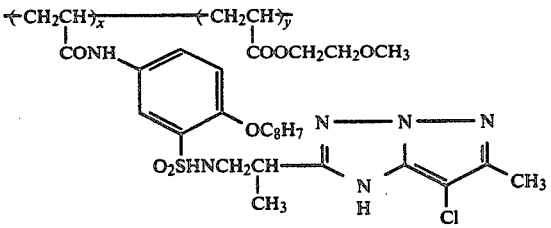
x/y = 45/55
(by weight)
(M-45)
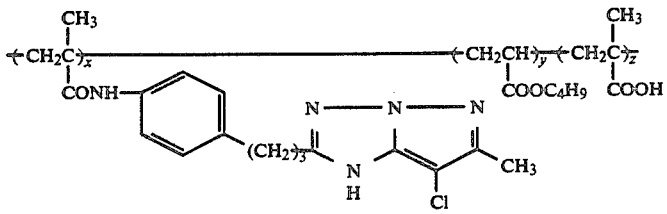
x/y/z = 50/45/5
(by weight)
(M-46)
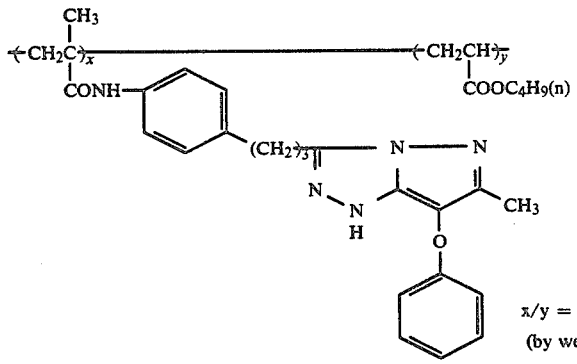
x/y = 50/50
(by weight)
(M-47)
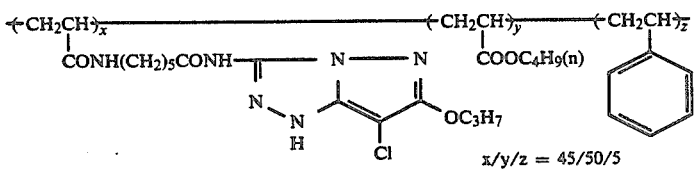
x/y/z = 45/50/5
(by weight)
(M-48)
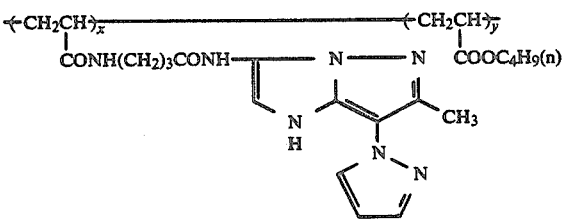
x/y = 50/50
(by weight)

-continued
(M-49)
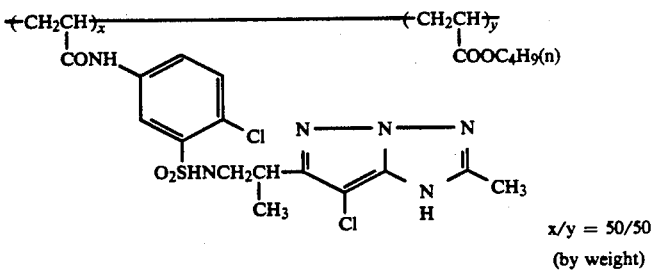
x/y = 50/50
(by weight)
(M-50)
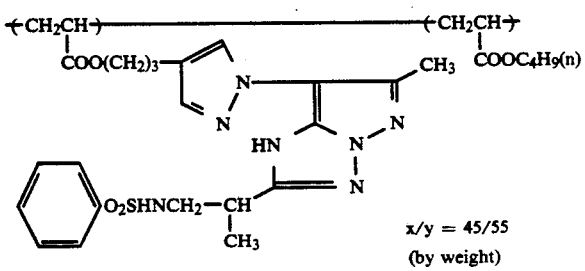
x/y = 45/55
(by weight)
Specific examples of the couplers of the formula (VII) are set forth below.
(Y-1)
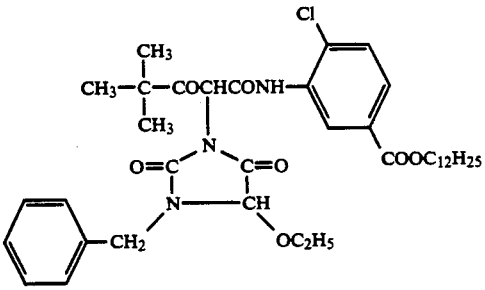
(Y-2)
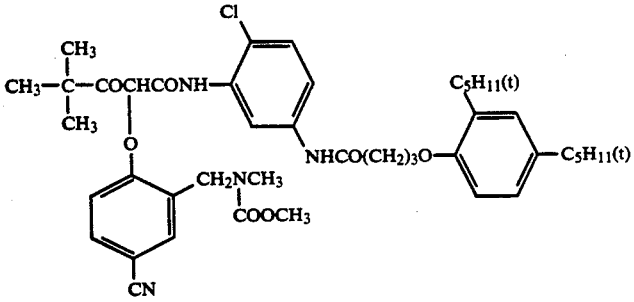
(Y-3)
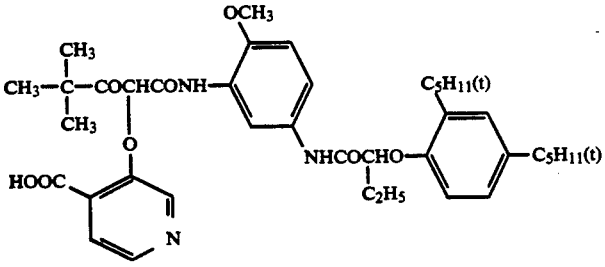

-continued
(Y-4)
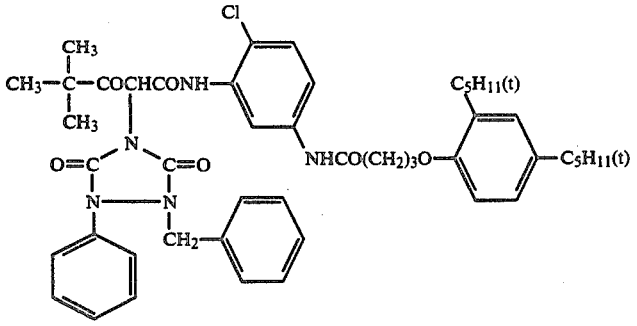
(Y-5)
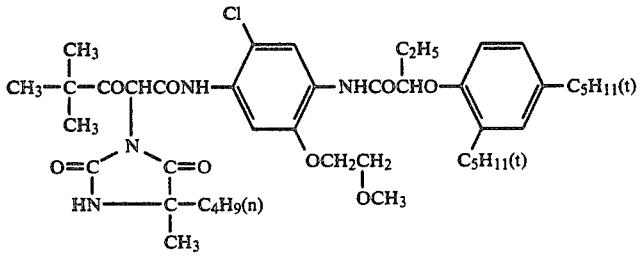
(Y-6)
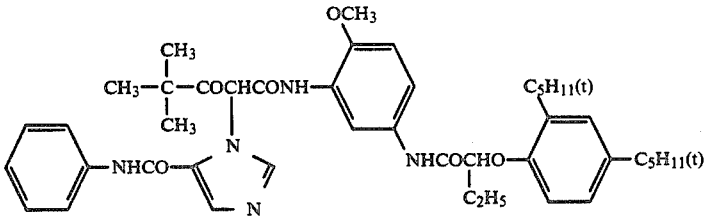
(Y-7)
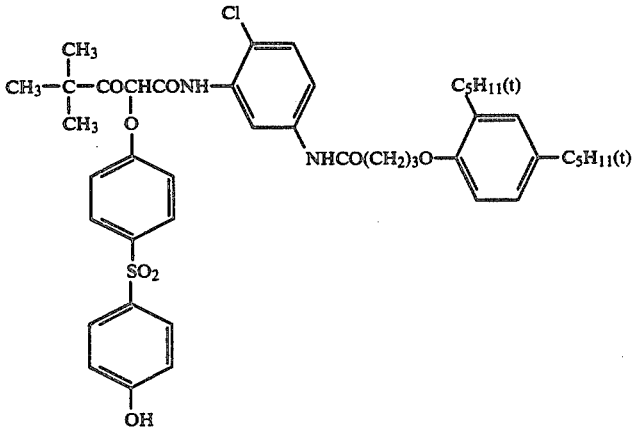

-continued
(Y-8)
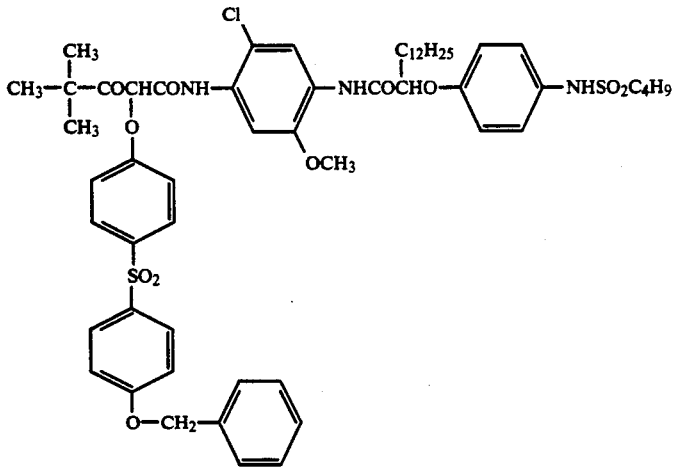
(Y-9)
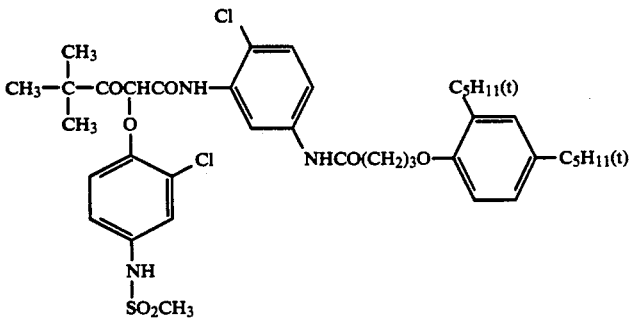
(Y-10)
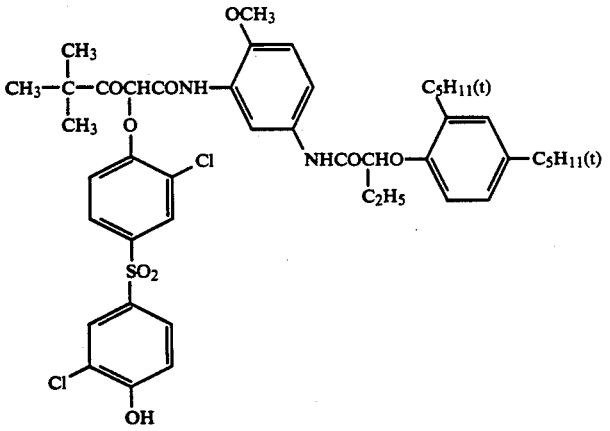
(Y-11)
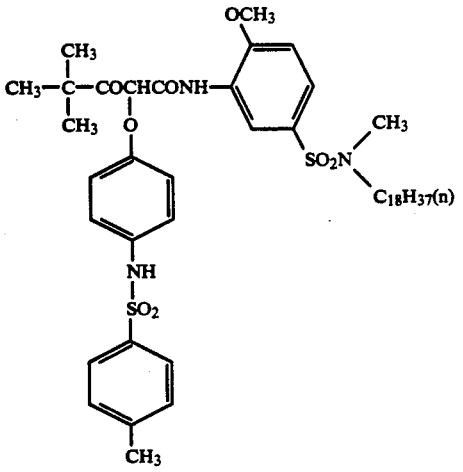

-continued
(Y-12)
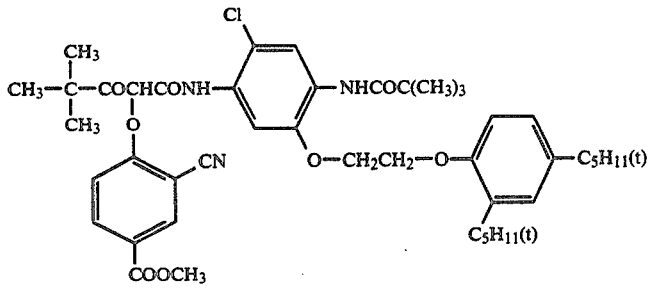
(Y-13)
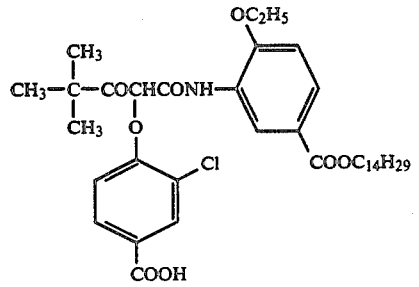
(Y-14)
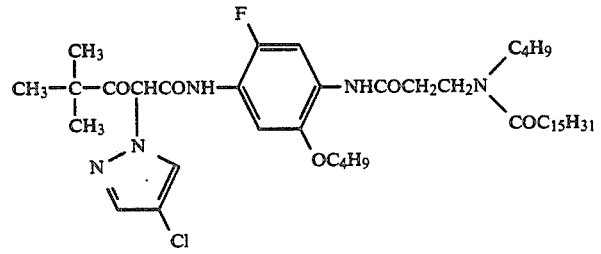
(Y-15)
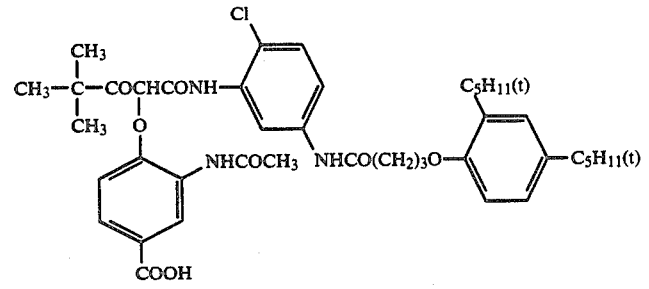
(Y-16)
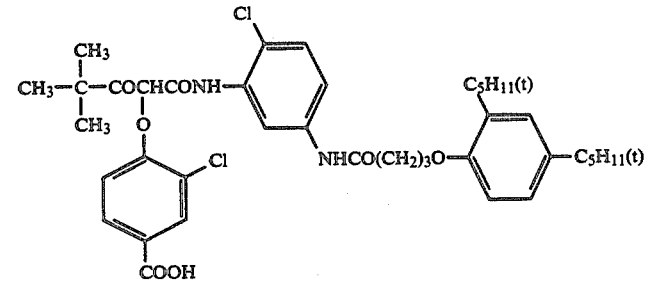
(Y-17)
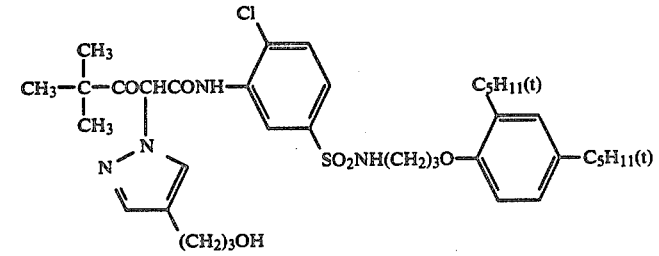

-continued
(Y-18)
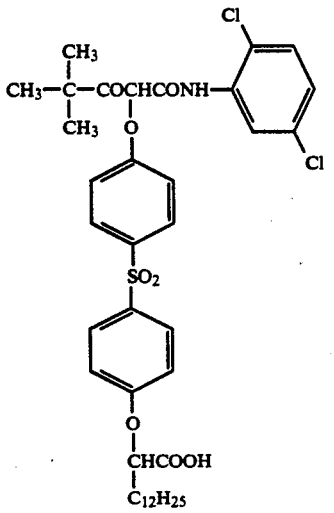
(Y-19)
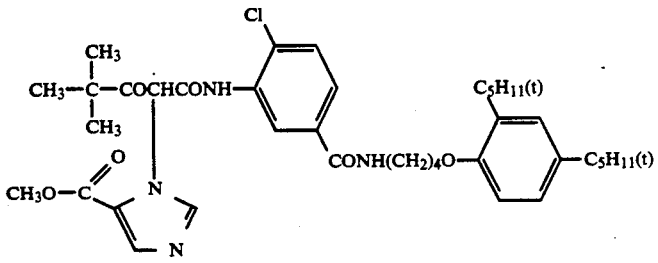
(Y-20)
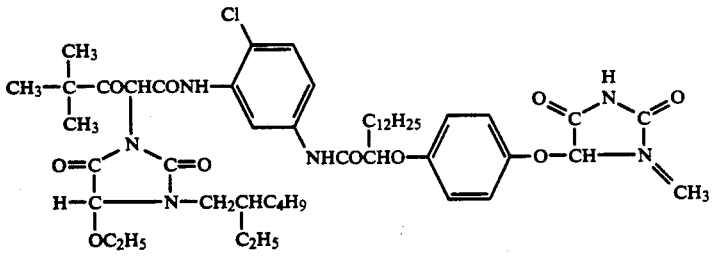
(Y-21)
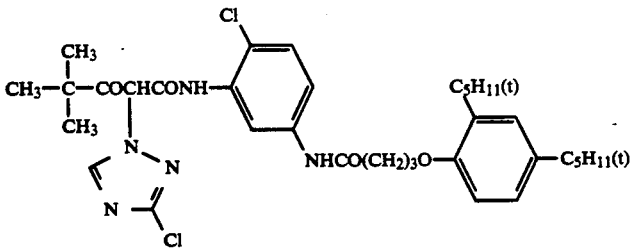
(Y-22)
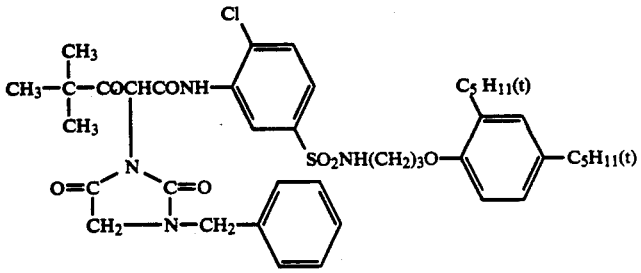

-continued
(Y-23)
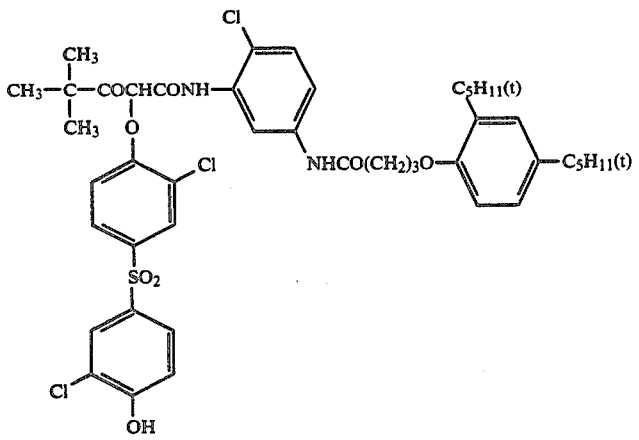
(Y-24)
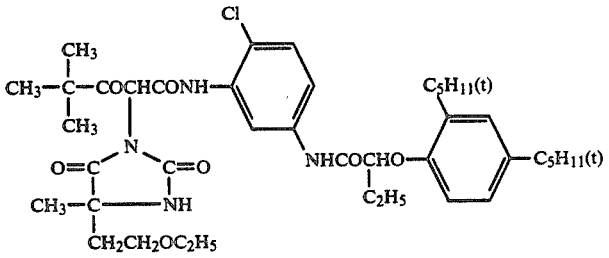
(Y-25)
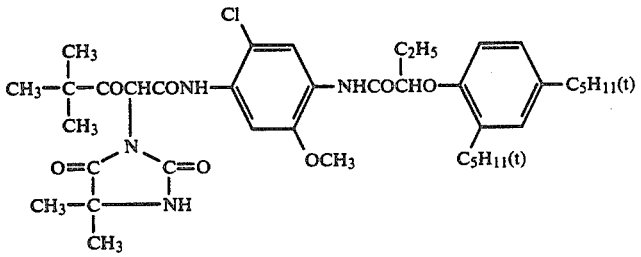
(Y-26)
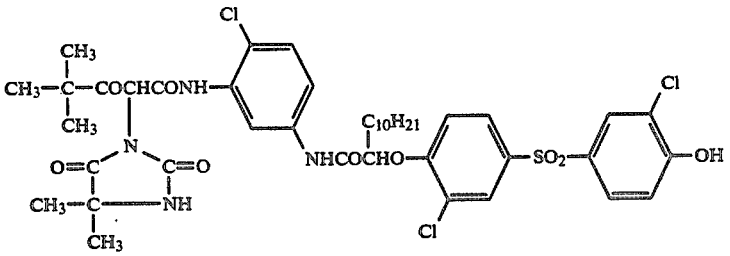
(Y-27)
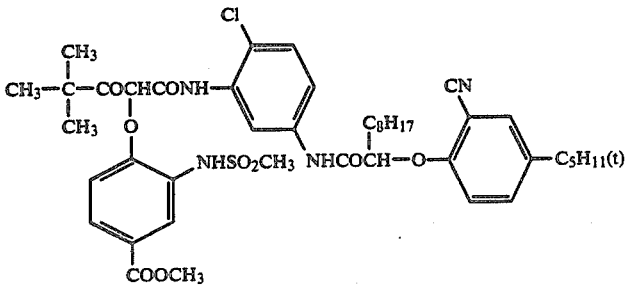

-continued
(Y-28)
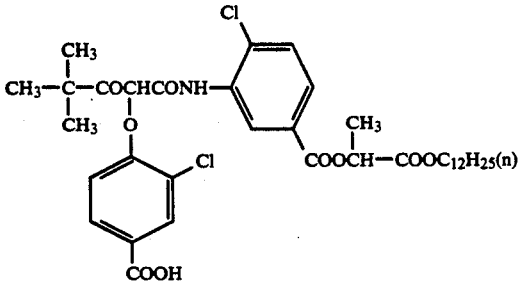
(Y-29)
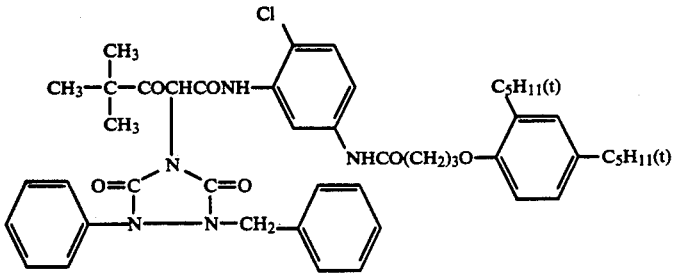
(Y-30)
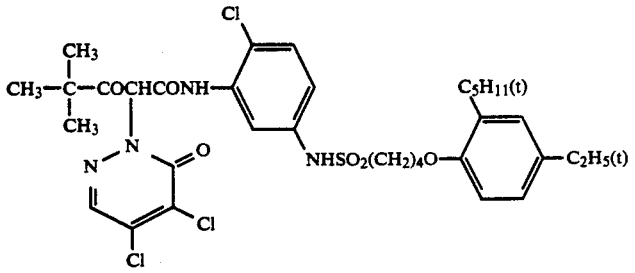
(Y-31)
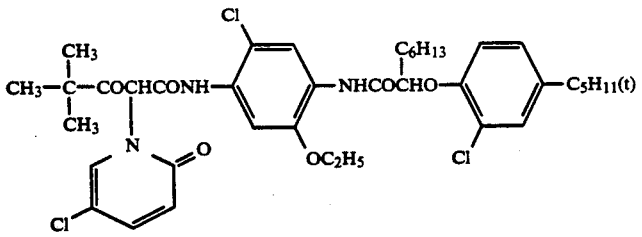
(Y-32)
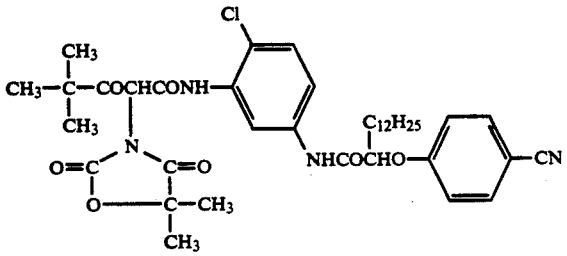

-continued
(Y-33)
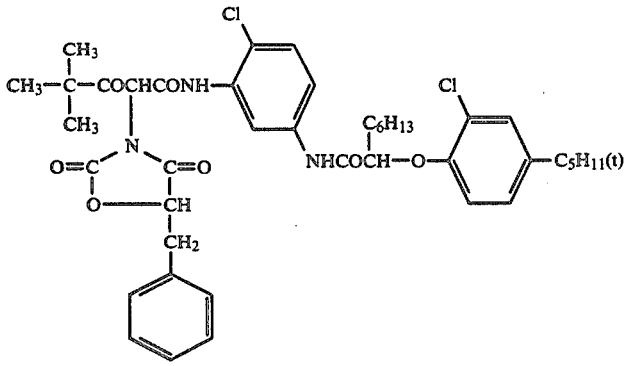
(Y-34)
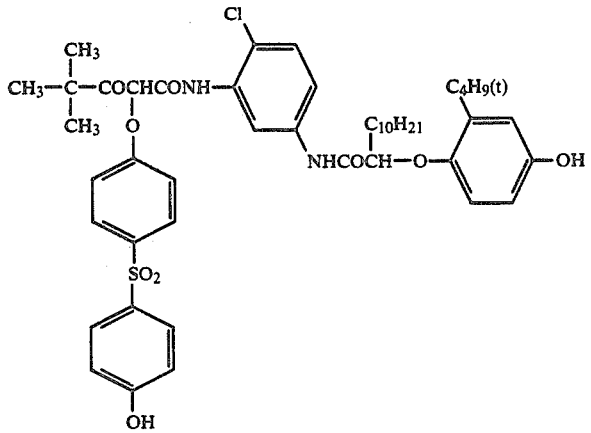
(Y-35)
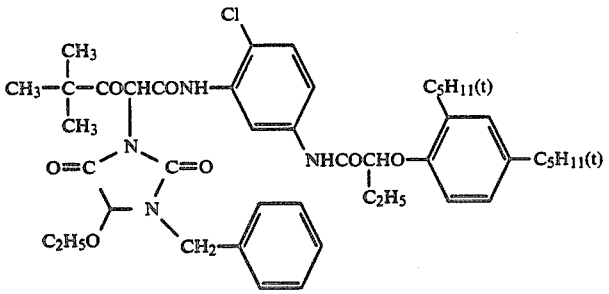
(Y-36)
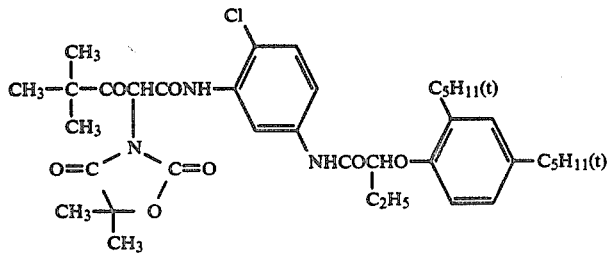

-continued
(Y-37)
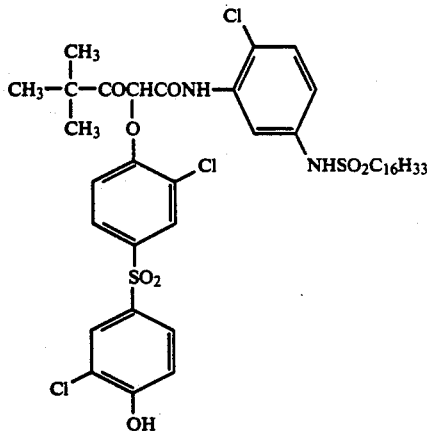
(Y-38)
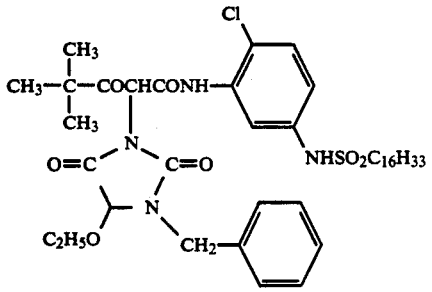
(Y-39)
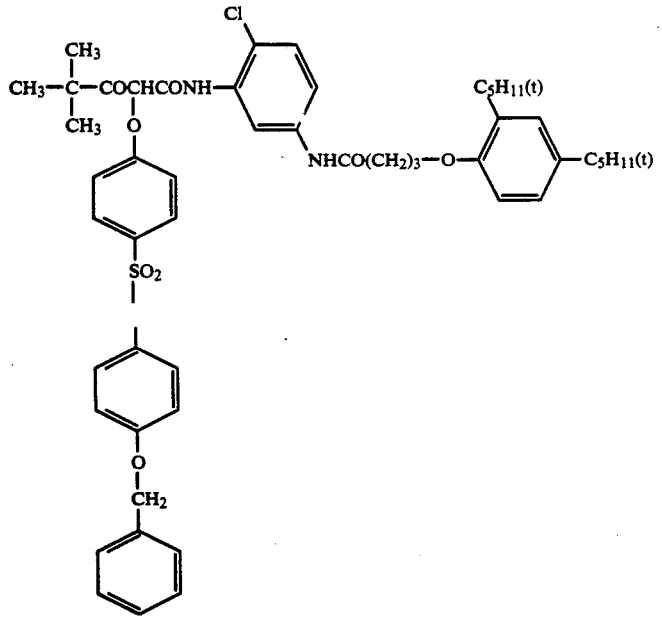
(Y-40)
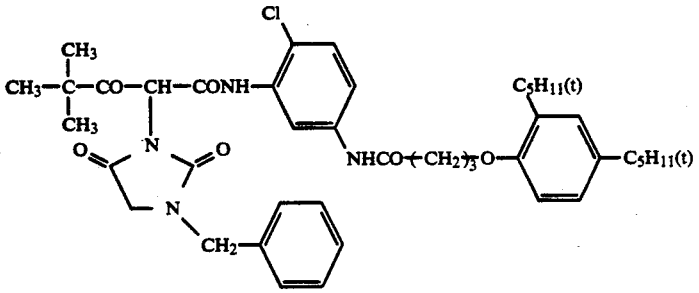

-continued
(Y-41)
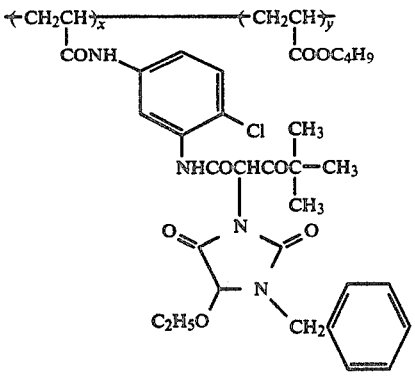
x/y = 50/50
(by weight)
(Y-42)
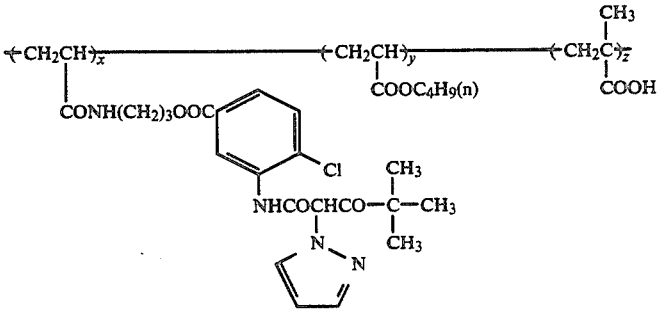
x/y/z = 50/45/5
(by weight)
(Y-43)
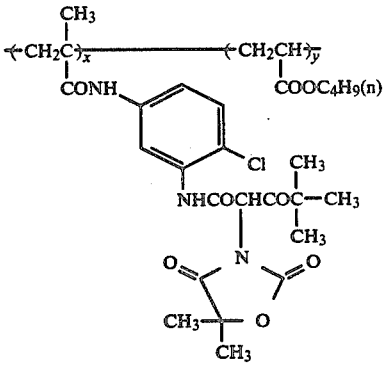
x/y = 50/50
(by weight)
(Y-44)
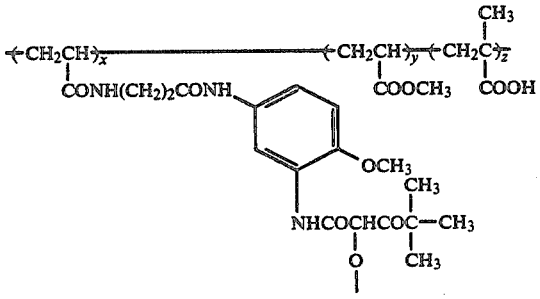

-continued

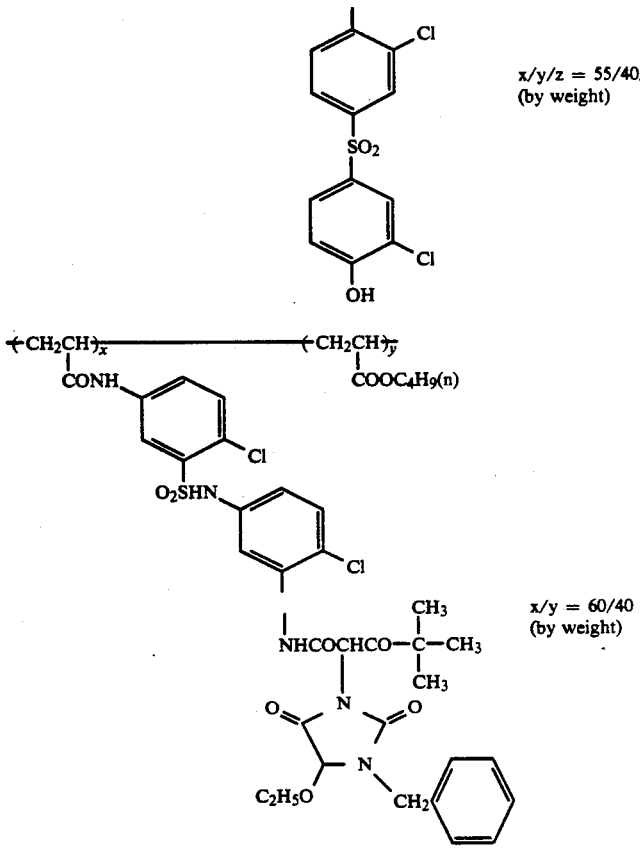

x/y/z = 55/40/5 (by weight)

(Y-45)

x/y = 60/40 (by weight)

The couplers of the formulae (III) to (VII) and other compounds as mentioned above and methods for their preparation are described in various publications, for example, as mentioned below.

The cyan couplers of the formulae (III) and (IV) can be synthesized by known methods. For instance, the cyan couplers of the formula (III) can be synthesized by the methods described in U.S. Pat. Nos. 2,423,730 and 3,772,002, etc. The cyan couplers of the formula (IV) can be synthesized by the methods described in U.S. Pat. Nos. 2,895,826, 4,333,999 and 4,327,173, etc.

The magenta couplers of the formula (V) can be synthesized by the methods described in Japanese Patent Application (OPI) Nos. 74027/74, 74028/74, 27930/73 and 33846/78, U.S. Pat. No. 3,519,429, etc. The magenta couplers of the formula (VI) can be synthesized by the methods described in Japanese Patent Application (OPI) No. 162548/84, U.S. Pat. No. 3,725,067, Japanese Patent Application (OPI) Nos. 171956/84 and 33552/85, etc.

The yellow couplers of the formula (VII) can be synthesized by the methods described in Japanese Patent Application (OPI) No. 48541/79, Japanese Patent Publication No. 10739/83, U.S. Pat. No. 4,326,024, *Research Disclosure*, RD No. 18053, etc.

These couplers are generally added to emulsions in an amount of from $2\times10^{-3}$ mol to $5\times10^{-1}$ mol, preferably from $1\times10^{-2}$ mol to $5\times10^{-2}$ mol, per mol of the silver in the emulsion layer.

The compounds of the present invention can be used together with known anti-fading agents, and especially preferred anti-fading agents are (i) aromatic compounds represented by the following formula (VIII), (ii) amine compounds represented by the following formula (IX), or (iii) metal complexes comprising a center atom of copper, cobalt, nickel, palladium or platinum and at least one organic ligand having two or more conformations.

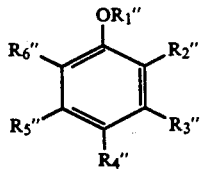

(VIII)

In the formula, $R_1''$ represents a hydrogen atom, an alkyl group, an alkenyl group, an aryl group, a heterocyclic group or a group of

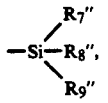

in which $R_7''$, $R_8''$ and $R_9''$ may be the same or different and each represents an alkyl group, an alkenyl group, an aryl group, an alkoxy group, an alkenoxy group or an aryloxy group; $R_2''$, $R_3''$, $R_4''$, $R_5''$ and $R_6''$ may be the same or different and each represents a hydrogen atom, an alkyl group, an alkenyl group, an aryl group, an acylamino group, an alkylamino group, an alkylthio group, an arylthio group, an alkoxycarbonyl group, an aryloxycarbonyl group, a halogen atom or —O—$R_1'''$, in which $R_1'''$ has the same meaning as $R_1''$; or $R_1''$ and $R_2''$ may be bonded together to form a 5-membered ring, a 6-membered ring or a spiro ring; or $R_2''$ and $R_3''$, or $R_3''$ and $R_4''$ may be bonded together to form a 5-membered ring, a 6-membered ring or a spiro ring.

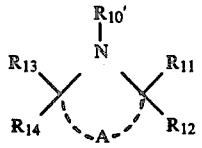

(IX)

In the formula, $R_{10}'$ represents a hydrogen atom, an alkyl group, an alkenyl group, an alkynyl group, an acyl group, a sulfonyl group, a sulfinyl group, an oxy-radical or a hydroxyl group; $R_{11}$, $R_{12}$, $R_{13}$ and $R_{14}$ may be the same or different and each represents a hydrogen atom or an alkyl group; and A represents a non-metallic atomic group necessary for forming a 5-membered, 6-membered or 7-membered ring.

In the substituents in the formulae (VIII) and (IX), those containing, even in part, an alkyl group, an aryl group or a heterocyclic group can further be substituted by substituent(s).

The typical examples of the substituents in the formulae (VIII) and (IX) are those described in Japanese Patent Application (OPI) No. 92945/87, pages 12 and 13, and the specific examples of the compounds of these-formulae are the compound Nos. (A-1) through (A-60) described in Japanese Patent Application (OPI) No. 92945/87, pages 13 to 17 and additionally the following compounds.

A-61

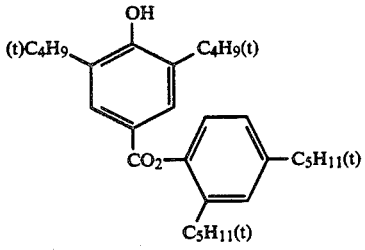

A-62

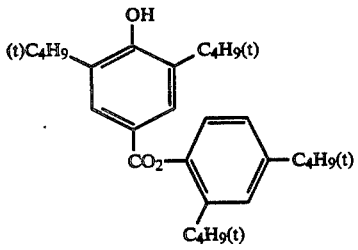

A-63

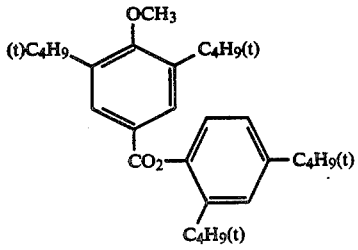

-continued

A-64

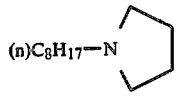

A-65

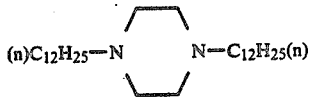

A-66

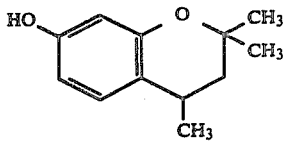

A-67

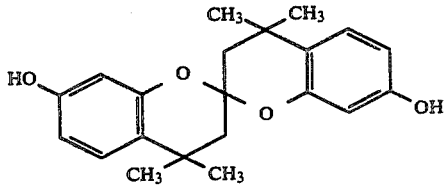

A-68

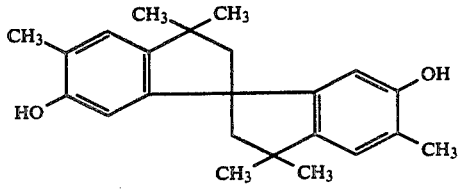

$CH_2{=}CH_2OC_{14}H_{29}(n)$ A-69

The amount of the compound of the formulae (VIII) and (IX) to be added is from 10 to 400 mol %, preferably from 30 to 300 mol %, to the coupler. On the other hand, the amount of the metal complex to be added is from 1 to 100 mol %, preferably from 3 to 40 mol %, to the coupler.

In the photographic materials prepared according to the present invention, if the hydrophilic colloid layers contain a dye, an ultraviolet absorbent, etc., these can be mordanted by a cationic polymer or the like.

The photographic materials prepared according to the present invention can contain, as a color-fog inhibitor, a hydroquinone derivative, an aminophenol derivative, a gallic acid derivative, an ascorbic acid derivative, etc.

The photographic materials prepared according to the present invention can contain an ultraviolet absorbent in the hydrophilic colloid layer. For instance, aryl group-substituted benzotriazole compounds (for example, as described in U.S. Pat. No. 3,533,794), 4-thiazolidone compounds (for example, as described in U.S. Pat. Nos. 3,314,794 and 3,352,681), benzophenone compounds (for example, as described in Japanese Patent Application (OPI) No. 2784/71), cinnamic acid ester compounds (for example, as described in U.S. Pat. Nos. 3,705,805 and 3,707,375), butadiene compounds (for example, as described in U.S. Pat. No. 4,045,229) or benzoxazole compounds (for example, as described in U.S. Pat. No. 3,700,455) can be used. Ultraviolet-absorbing couplers (for example, α-naphthol series cyan dye-forming couplers) and ultraviolet-absorbing polymers may also be used. These ultraviolet absorbents can be mordanted in specifically determined layers.

The photographic materials obtained in accordance with the present invention can contain a water-soluble dye in the hydrophilic colloid layer as a filter dye or for the purpose of irradiation prevention or for any other various purposes. Such dyes include oxonole dyes, hemioxonol dyes, styryl dyes, merocyanine dyes, cyanine dyes and azo dyes. In particular, oxonol dyes, hemioxonol dyes and merocyanine dyes are especially useful.

As the binder or protective colloid which can be used for the emulsion layers of the photographic materials of the present invention, gelatin is advantageously used, but other hydrophilic colloids can also be used singly or together with gelatin.

As gelatin, lime-processed gelatin as well as acid-processed gelatin can be used in the photographic materials of the present invention. The details of the method for the preparation of gelatins is described in Arthur Veis, *The Macromolecular Chemistry of Gelatin* (by Academic Press, 1964).

In the photographic emulsion layers of the photographic light-sensitive materials to be used in the present invention, any of silver bromide, silver iodobromide, silver iodochlorobromide, silver chlorobromide and silver chloride can be used as a silver halide.

The mean grain size (the diameter of the grain when the grain has a spherical shape or resembles a spherical shape, or the mean value based on the projected area using the edge length as the grain size when the grain is a cubic shaped grain) of the silver halide grains in the photographic emulsions is not specifically limitative but is preferably 2 $\mu$ or less.

The grain size distribution of the silver halide emulsions may be narrow or broad, but a so-called monodispersed emulsion wherein the fluctuation value is 15% or less is preferably used in the present invention.

The silver halide grains in the photographic emulsions may have a regular crystal form such as cubic or octahedral or an irregular crystal form such as spherical or tabular, or further a composite form of these crystal forms. Also, the emulsions may be a mixture comprising grains of various crystal forms. In particular, the use of normal crystal grains is preferred.

In addition, a tabular grain silver halide emulsion wherein tabular silver halide grains having an aspect ratio (length/width) of 5 or more account for 50% or more of the total projected area of the silver halide grains may also be used.

The silver halide grains may have a different inner phase and surface layer phase. In addition, these may be of a surface latent image type capable of forming latent images mainly on the surface thereof or of an internal latent image type capable of forming latent images mainly in the inside thereof.

The silver halide grains may also be formed, or physically ripened, in the presence of a cadmium salt, a zinc salt, a thallium salt, a lead salt, an iridium salt or a complex salt thereof, a rhodium salt or a complex salt thereof, an iron salt or a complex salt thereof, etc.

The silver halide emulsions are generally subjected to chemical sensitization.

The photographic emulsions for use in the photographic materials of the present invention can contain various compounds so as to prevent the generation of fog in the manufacture step of the materials or during the storage or photographic processing of the materials or so as to stabilize the photographic characteristics of the materials. For example, various kinds of compounds which are known as an antifoggant or stabilizer can be added to the emulsions, and examples of such compounds are azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole, etc.), mercaptopyrimidines, mercaptotriazines, etc.; thioketo compounds such as oxazolinethiones, etc.: azaindenes such as triazaindenes, tetrazaindenes (especially 4-hydroxy-substituted (1,3,3a,7)tetrazaindenes, etc.), pentazaindenes, etc.; benzenethiosulfonic acids, benzenesulfinic acids, benzenesulfonic acid amides, etc.

The present invention can be applied to multi-layer and multi-color photographic materials having at least two emulsion layers of different spectral sensitivities on a support. Multi-layer natural color photographic materials generally have at least one red-sensitive emulsion layer, at least one green-sensitive emulsion layer and at least one blue-sensitive emulsion layer on a support. The disposition order of these emulsion layers can be selected according to the intended use. In general, the red-sensitive emulsion layer contains a cyan-forming coupler, the green-sensitive emulsion layer contains a magenta-forming coupler, and the blue-sensitive emulsion layer contains yellow-forming coupler, but as the case may be, different combinations can be used.

As the supports for use in the present invention, conventional ones which are generally used in photographic materials can be used, including cellulose nitrate film, cellulose acetate film, cellulose acetate-butyrate film, cellulose acetate-propionate film, polystyrene film, polyethylene terephthalate film, polycarbonate film, as well as laminates comprising the said films, thin glass film, paper, etc. In addition, papers coated or laminated with baryta or an $\alpha$-olefin polymer, especially a polymer of an $\alpha$-olefin having from 2 to 10 carbon atoms, such as polyethylene, polypropylene or ethylene-butene copolymer, as well as plastic film supports whose surface is roughened so as to improve the adhesiveness with other high molecular substances, as described in Japanese Patent Publication No. 19068/72, are usable in the present invention, and these supports can yield a good result. Further, ultraviolet-setting resins can also be used.

As the support, transparent or opaque ones are selectively used in accordance with the intended object of the photographic materials. In addition, dyes or pigments can be added to the supports so as to make them transparently colored.

Opaque supports include, in addition to naturally opaque supports such as paper, those formed by adding a dye or a pigment such as titanium oxide to a transparent film; as well as surface-processed plastic films as described in Japanese Patent Publication No. 19068/72; and completely light-shielding papers or plastics to which a carbon black, a dye or the like is added. The support generally has a subbing layer. In order to further improve the adhesiveness, the surface of the support can be pre-treated, for example, by corona discharge, ultraviolet irradiation or flame-treatment.

As the color photographic materials to be used for preparing the color photographs of the present invention, conventional color photographic materials can be used, and in particular, color photographic materials for prints are especially preferred. Further, photographic materials to be processed by the color photographic process described in U.S. Pat. Nos. 3,227,550, 3,227,551 and 3,227,552 and Temporarily Published U.S. Patent U.S. B. 351,673, etc.; in particular those to be processed by a color diffusion transfer photographic process, can also be used. In order to obtain color images by conventional photographic processing, the color photographic materials are required to be subjected to color photographic development processing, after being exposed. The color photographic development processing basically comprises a color development step, a bleaching step and a fixation step. The two steps of bleaching and fixation can be carried out in one operation. Alternatively, a combination comprising color development, first fixation and then bleaching-fixation is also possible. The development step is optionally combined with various steps of prehardening, neutralization, first development (black-and-white development), image stabilization, rinsing, etc., if desired. The processing temperature is generally 18° C. or higher. Especially, the temperature is from 20° C. to 60° C. in most cases, and recently, the temperature is within the range of from 30° C. to 60° C.

The color developer is an aqueous alkaline solution containing an aromatic primary amine series color developing agent and having a pH value of 8 or more, preferably from 9 to 12.

After the step of fixation or bleaching-fixation, the photographic materials are generally subjected to rinsing in water. However, in place of the rinsing step in water, a simple step of only a so-called "stabilization" can also be effected with no substantial rinsing operation.

Preferred examples of aromatic primary amine series developing agents for use in the present invention are p-phenylenediamine derivatives, and specific examples thereof are set forth hereunder, which, however, are not limitative.

D-1: N,N-diethyl-p-phenylenediamine
D-2: 2-Amino-5-diethylaminotoluene
D-3: 2-Amino-5-(N-ethyl-N-laurylamino)toluene
D-4: 4-[N-ethyl-N-(β-hydroxyethyl)amino]aniline
D-5: 2-Methyl-4-[N-ethyl-N-(β-hydroxyethyl-)amino]aniline
D-6: N-Ethyl-N-(β-methanesulfonamidoethyl)-3-methyl-4-aminoaniline
D-7: N-(2-amino-5-diethylaminophenylethyl)methanesulfonamide
D-8: N,N-dimethyl-p-phenylenediamine
D-9: 4-Amino-3-methyl-N-methoxyethylaniline
D-10: 4-Amino-3-methyl-N-ethyl-N-β-ethoxyethylaniline
D-11: 4-Amino-3-methyl N-ethyl-N-β-butoxyethylaniline These p-phenylenediamine derivatives may also be in the form of salts such as sulfates, hydrochlorides, sulfites, p-toluenesulfonates, etc. The above-mentioned compounds are described in U.S. Pat. Nos. 2,193,015, 2,552,241, 2,566,271, 2,592,364, 3,656,950, 3,698,525, etc. The concentration of the aromatic amine developing agent to be used in actual processing is from about 0.1 g to about 20 g, more preferably from about 0.5 g to about 10 g, per liter of the developer bath solution.

The color developer for use in the present invention can contain hydroxylamines, as are well known.

The processing temperature of the color developer in the practice of the present invention is preferably from 30° C. to 50° C., more preferably from 33° C. to 42° C. The amount of the replenisher in the color development step is from 30 ml to 2000 ml, preferably from 30 ml to 1500 ml, per $m^2$ of the photographic materials being processed. In view of the necessity for reducing the amount of wastes, a small amount of the replenisher is better.

If the color developer contains benzyl alcohol, the amount of the benzyl alcohol is preferably 2.0 ml/liter or less, more preferably 0.5 ml/liter or less. No benzyl alcohol is most preferred. The color development time is preferably within 2 minutes and 30 seconds or less, more preferably within the range of from 10 seconds to 2 minutes and 30 seconds. The most preferred range is from 45 seconds to 2 minutes.

The following examples are intended to illustrate the present invention but not to limit it in any way.

Unless otherwise ,specified, all percents, ratios, etc. are by weight.

EXAMPLE 1

5 g of a dye obtained by oxidation-coupling reaction of the above-mentioned Cyan Coupler (C-1) and 4-amino-3-methyl-N-ethyl-N-β-(methanesulfonamido)ethylaniline (the dye is referred to as Dye (C-1), and the same shall apply hereinafter with respect to the naming of dyes) was dissolved in 20 ml of tricresyl phosphate and 20 ml of ethyl acetate, and the resulting solution was emulsified and dispersed in 80 g of a gelatin solution containing 8 ml of aqueous 1%-sodium dodecylbenzenesulfonate solution.

Next, sodium dodecylbenzenesulfonate was added to the emulsified dispersion as a coating auxiliary agent and then coated on a paper support both surfaces of which had been laminated with polyethylene.

The amount of the dye coated was so controlled that the color density as measured with Macbeth Densitometer RD-514 Type (Status AA Filter) was 1.0.

A gelatin protective layer (containing 1 g/$m^2$ of gelatin) was coated over the layer, to obtain Sample (A).

In the same manner as above, other Samples (A-1) through Samples (A-13) were manufactured, using the combinations as shown in the following Table 1 in the preparation of the respective emulsified dispersions.

The samples thus obtained were stored in the dark at room temperature for 2 months. In order to test the light-fastness of each sample, the samples were subjected to a color fading test for 500 hours with a xenon tester (illuminance: 100,000 luxes) provided with an ultraviolet absorbing filter (by Fuji Photo Film) cutting a light of 400 nm or less, and the color retention (percentage) was obtained for each sample. The results are set forth in Table 1.

TABLE 1

| Sample | Dye | Amount of 4-Amino-3-methyl-N-ethyl-N-β-(methanesulfonamido)ethylaniline 3/2 $H_2SO_4$ $H_2O$ added (mol % to dye) | Additive (Amount added, mol % to dye) | Color Retention (%) | Note |
|---|---|---|---|---|---|
| A | (C-1) Dye | — | — | 56 | Comparative Sample |

TABLE 1-continued

| | | | | | | |
|---|---|---|---|---|---|---|
| A-1 | " | 20 | — | | 40 | Comparative Sample |
| A-2 | " | " | (I - 1) | 50 | 57 | Sample of the Invention |
| A-3 | " | " | (I - 5) | 50 | 58 | Sample of the Invention |
| A-4 | " | " | (I - 18) | 50 | 57 | Sample of the Invention |
| A-5 | " | " | (II - 1) | 50 | 55 | Sample of the Invention |
| A-6 | (C-14) Dye | — | — | | 34 | Comparative Sample |
| A-7 | " | 20 | — | | 23 | Comparative Sample |
| A-8 | " | " | (I - 3) | 50 | 37 | Sample of the Invention |
| A-9 | " | " | (I - 10) | 50 | 37 | Sample of the Invention |
| A-10 | " | " | (II - 4) | 50 | 35 | Sample of the Invention |
| A-11 | " | " | (Comparative Compound A) | 50 | 25 | Comparative Sample |
| A-12 | " | " | (Comparative Compound B) | 50 | 26 | Comparative Sample |
| A-13 | " | " | (Comparative Compound C) | 50 | 19 | Comparative Sample |

(Comparative Compound A)
Compound described in British Patent 1,326,889 as an anti-fading agent.

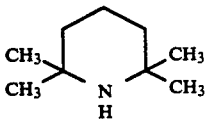

(Comparative Compound B)
Compound described in Japanese Patent Publication No. 30462/76.

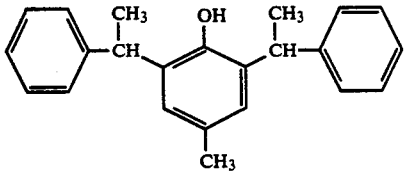

(Comparative Compound C)
Compound described in Japanese Patent Application (OPI) No. 104641/84.

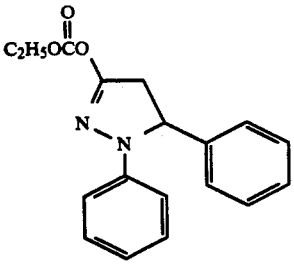

As is apparent from Table 1, the addition of the compound of the present invention is effective for improving the fastness against the deterioration of the fastness caused by the developing agent remaining in the photographic material processed. The degree of the effect could not be anticipated from any known anti-fading agents.

EXAMPLE 2

In the same manner as Example 1, except that the Dye (C-1) in the Sample (A) was replaced by a dye obtained by oxidation-coupling reaction of the Magenta Coupler (M-1) and 4-amino-3-methyl-N-ethyl-N-β-(methanesulfonamido)ethylaniline, Sample (B) was prepared. In addition, Samples (B-1) through (B-26) were also prepared, using the combinations as shown in Table 2.

These samples were stored for 2 months in the dark in the same manner as in Example 1. These were subjected to a color-fading test with a xenon tester for 200 hours, and the color retention (percentage) was obtained for each sample. The results are set forth in Table 2.

TABLE 2

| Sample | Dye | Amount of 4-Amino-3-methyl-N-ethyl-N-β-(methanesulfonamido)ethylaniline 3/2 $H_2SO_4.H_2O$ added (mol % to dye) | Additive (Amount added, mol % to dye) | | Color Retention (%) | Note |
|---|---|---|---|---|---|---|
| B | (M-1) Dye | — | — | | 49 | Comparative Sample |
| B-1 | " | 20 | — | | 21 | Comparative Sample |
| B-2 | " | " | (I - 2) | 50 | 47 | Sample of the Invention |
| B-3 | " | " | (I - 6) | 50 | 46 | Sample of the Invention |
| B-4 | " | " | (I - 13) | 50 | 51 | Sample of the Invention |
| B-5 | " | " | (Comparative Compound A) | 50 | 22 | Comparative Sample |
| B-6 | " | " | (Comparative Compound B) | 50 | 27 | Comparative Sample |
| B-7 | (M-6) Dye | — | — | | 47 | Comparative Sample |
| B-8 | " | 20 | — | | 25 | Comparative Sample |
| B-9 | " | " | (I - 1) | 50 | 46 | Sample of the Invention |
| B-10 | " | " | (II - 2) | 50 | 43 | Sample of the Invention |
| B-11 | (M-16) Dye | — | — | | 39 | Comparative Sample |
| B-12 | " | 20 | — | | 22 | Comparative Sample |
| B-13 | " | " | (I - 3) | 50 | 37 | Sample of the Invention |
| B-14 | " | " | (I - 5) | 50 | 35 | Sample of the Invention |
| B-15 | " | " | (I - 16) | 50 | 34 | Sample of the Invention |
| B-16 | " | " | (II - 1) | 50 | 30 | Sample of the Invention |
| B-17 | " | " | (II - 4) | 50 | 32 | Sample of the Invention |
| B-18 | (M-31) Dye | — | — | | 45 | Comparative Sample |
| B-19 | " | 20 | — | | 23 | Comparative Sample |
| B-20 | " | " | (I - 1) | 50 | 44 | Sample of the Invention |
| B-21 | " | " | (I - 11) | 50 | 46 | Sample of the Invention |
| B-22 | " | " | (I - 22) | 50 | 43 | Sample of the Invention |
| B-23 | " | " | (II - 4) | 50 | 42 | Sample of the Invention |
| B-24 | " | " | (Comparative Compound D) | 50 | 24 | Comparative Sample |
| B-25 | " | " | (Comparative Compound E) | 50 | 31 | Comparative Sample |
| B-26 | " | " | (Comparative Compound F) | 50 | 33 | Comparative Sample |

(Comparative Compound D)
Compound described in U.S. Pat. No. 3,764,337

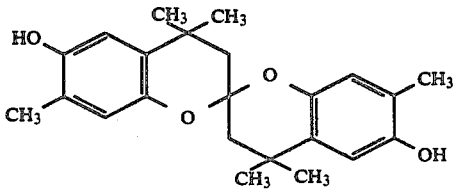

(Comparative Compound E)
Compound described in U.S. Pat. No. 3,930,866

TABLE 2-continued

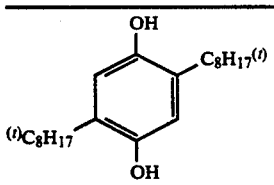

(Comparative Compound F)
Compound described in U.S. Pat. No. 3,573,050

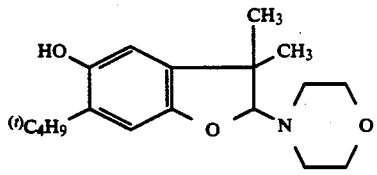

As is apparent from Table 2, the compounds of the present invention are extremely effective for preventing the deterioration of image quality caused by developing agents, although the fastness of images is deteriorated because of the existence of the developing agents remaining in the photographic materials. The effect could not be anticipated from any known compounds.

EXAMPLE 3

In the same manner as in Example 1, except that the Dye (C-1) in the Sample (A) was replaced by a dye obtained by a coupling reaction of the Yellow Coupler (Y-35) and 4-amino-3-methyl-N-ethyl-N-β-(methanesulfonamido)ethylaniline, Sample (C) was prepared. In addition, Samples (C-1) through Samples (C-12) were also prepared, using the combinations as shown in Table 3.

These samples were stored for 2 months in the dark in the same manner as in Example 1. In order to test the light-fastness of each sample, these samples were subjected to a color-fading test in the same manner as in Example 1 with a xenon tester for 800 hours. In addition, in order to test the heat-resistance of each sample, the samples were stored in the dark for 500 hours at 100° C. The results of the color retention (percentage) of each sample are shown in Table 3.

TABLE 3

| Sample | Dye | Amount of 4-Amino-3-methyl-N-ethyl-N-β-(methanesulfonamido)ethylaniline 3/2 $H_2SO_4.H_2O$ added (mol % to dye) | Additive (Amount added, mol % to dye) | | Color Retion (%) Xe light (for 800 hours) | Color Retion (%) 100° C. (for 500 hours) | Note |
|---|---|---|---|---|---|---|---|
| C | (Y-35) Dye | — | — | | 65 | 89 | Comparative Sample |
| C-1 | " | 20 | — | | 56 | 81 | Comparative Sample |
| C-2 | " | " | (I - 15) | 50 | 64 | 87 | Sample of the Invention |
| C-3 | " | " | (I - 22) | 50 | 65 | 87 | Sample of the Invention |
| C-4 | " | " | (I - 24) | 50 | 65 | 88 | Sample of the Invention |
| C-5 | " | " | (II - 1) | 50 | 64 | 89 | Sample of the Invention |
| C-6 | (Y-38) Dye | — | — | | 63 | 88 | Comparative Sample |
| C-7 | " | 20 | — | | 55 | 83 | Comparative Sample |
| C-8 | " | " | (I - 6) | 50 | 63 | 87 | Sample of the Invention |
| C-9 | " | " | (I - 7) | 50 | 63 | 88 | Sample of the Invention |
| C-10 | " | " | (I - 9) | 50 | 64 | 87 | Sample of the Invention |
| C-11 | " | " | (Comparative Compound A) | 50 | 54 | 85 | Comparative Sample |
| C-12 | " | " | (Comparative Compound B) | 50 | 55 | 82 | Comparative Sample |

As apparent from Table 3, the addition of the compound of the present invention is extremely effective for improving the fastness to light and heat, and the color fading caused by the developing agent was effectively prevented.

EXAMPLE 4

P-anisidine and the compound of the formula (I) of the present invention were dissolved in trinonyl phosphate each in a concentration of 0.03 mol/liter. 10 ml of the mixture was heated in a thermostatic bath at 80° C., whereupon the reaction was followed by high performance liquid chromatography to obtain the secondary reaction rate constant.

The secondary reaction rate constants $k_2$ of specific compounds thus obtained are shown in Table 4.

TABLE 4

| Compound | $k_2$ (l/mol sec) | Compound | $k_2$ (l/mol sec) |
|---|---|---|---|
| (I - 1) | $5 \times 10^{-5}$ | (I - 2) | $7.1 \times 10^{-1}$ |
| (I - 3) | $9.76 \times 10^{-2}$ | (I - 4) | $2.85 \times 10^{-3}$ |
| (I - 6) | $5.77 \times 10^{-5}$ | (I - 7) | $2 \times 10^{-5}$ |
| (I - 8) | $3.83 \times 10^{-4}$ | (I - 9) | $2 \times 10^{-5}$ |
| (I - 13) | $3.34 \times 10^{-5}$ | (I - 22) | $3.07 \times 10^{-4}$ |
| (I - 25) | $7.16 \times 10^{-5}$ | (I - 28) | $2.47 \times 10^{-3}$ |
| (I - 31) | $2.37 \times 10^{-3}$ | (I - 35) | $5.63 \times 10^{-3}$ |
| (I - 36) | $1.09 \times 10^{-2}$ | (I - 40) | $1.93 \times 10^{-3}$ |
| (I - 43) | $5.95 \times 10^{-3}$ | (I - 45) | $4.17 \times 10^{-3}$ |
| (I - 49) | $1.46 \times 10^{-3}$ | (I - 53) | $2.16 \times 10^{-4}$ |
| (I - 57) | $1.76 \times 10^{-2}$ | (I - 61) | $2.00 \times 10^{-2}$ |
| (I - 67) | $1.57 \times 10^{-2}$ | (I - 72) | $1.64 \times 10^{-2}$ |
| (I - 77) | $8.95 \times 10^{-4}$ | (I - 84) | $4.11 \times 10^{-3}$ |
| (I - 85) | $9.61 \times 10^{-4}$ | (I - 87) | $1.01 \times 10^{-3}$ |
| (I - 91) | $2.56 \times 10^{-3}$ | (I - 94) | $1.53 \times 10^{-3}$ |
| (I - 97) | $2.15 \times 10^{-3}$ | (I - 100) | $5.00 \times 10^{-4}$ |
| (I - 108) | $1.61 \times 10^{-3}$ | (I - 112) | $1.61 \times 10^{-3}$ |

EXAMPLE 5

Plural layers comprising the first layer (undermost layer) to the second layer (uppermost layer) as described below were coated in order on a paper support both surfaces of which had been laminated with polyethylene, to obtain a color photographic material sample.

The polyethylene-laminated paper support contained a white pigment (such as $TiO_2$) and a bluish dye (such as ultramarine) in the polyethylene in the side of the first layer.

| | |
|---|---|
| First Layer: Blue-sensitive Layer | |
| Silver chlorobromide emulsion (silver bromide: 80 mol %) | 0.35 g/m² as Ag |
| Gelatin | 1.35 g/m² |
| Yellow coupler | $6.91 \times 10^{-4}$ mol/m² |
| Color image stabilizer (A-43) | 0.13 g/m² |
| Solvent (a) | 0.02 g/m² |
| Second Layer: Color Mixing Preventing Layer | |
| Gelatin | 0.90 g/m² |
| Color mixing preventing agent (b) | $2.33 \times 10^{-4}$ mol/m² |
| Third Layer: Green-sensitive Layer | |
| Silver chlorobromide emulsion (silver bromide: 75 mol %) | 0.15 g/m² as Ag |
| Gelatin | 1.56 g/m² |
| Magenta coupler | $3.38 \times 10^{-4}$ mol/m² |
| Color image stabilizer (A-18) | 0.19 g/m² |
| Solvent (c) | 0.59 g/m² |
| Fourth Layer: Ultraviolet Absorbing Layer | |
| Gelatin | 1.60 g/m² |
| Ultraviolet absorbent (d) | $1.70 \times 10^{-4}$ mol/m² |
| Color mixing preventing agent (A-30) | $1.60 \times 10^{-4}$ mol/m² |
| Solvent (a) | 0.24 g/m² |
| Fifth Layer: Red-sensitive Layer | |
| Silver chlorobromide emulsion (silver bromide: 70 mol %) | 0.22 g/m² as Ag |
| Gelatin | 0.90 g/m² |
| Cyan coupler | $7.05 \times 10^{-4}$ mol/m² |
| Color image stabilizer (f) | $5.20 \times 10^{-4}$ mol/m² |
| Solvent (e) | 0.6 g/m² |
| Sixth Layer: Ultraviolet Absorbing Layer | |
| Gelatin | 0.54 g/m² |
| Ultraviolet absorbent (d) | $5.10 \times 10^{-4}$ mol/m² |
| Solvent (a) | 0.08 g/m² |
| Seventh Layer: Protective Layer | |
| Gelatin | 1.33 g/m² |
| Acryl-modified copolymer of polyvinyl alcohol (modification degree: 17%) | 0.17 g/m² |

As the spectral sensitizer for the respective emulsions, the following dyes were used.

Blue-sensitive Emulsion Layer:

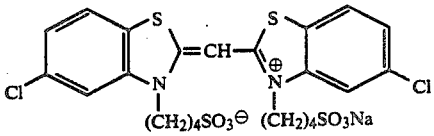

(Amount added: $2 \times 10^{-4}$ mol per mol of silver halide)

Green-sensitive Emulsion Layer:

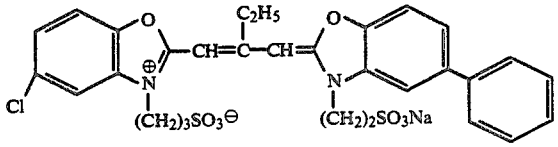

(Amount added: $2.5 \times 10^{-4}$ mol per mol of silver halide)

Red-sensitive Emulsion Layer

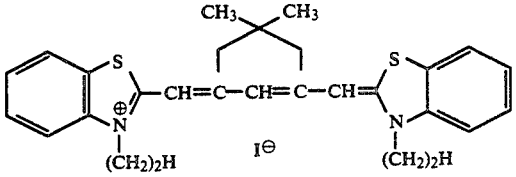

(Amount added: $2.5 \times 10^{-4}$ mol per mol of silver halide)

Solvent(a):

$(iso C_9H_{19}O)_3P{=}O$

Color Mixing Preventing Agent (b):

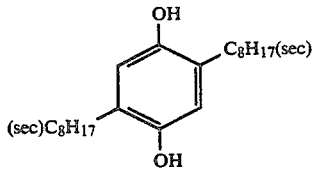

Solvent (c)

Mixture (2/1 by weight) of the following compounds $(C_8H_{17}O)_3P{=}O$, and

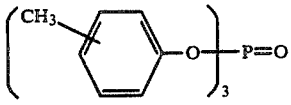

Ultraviolet Absorbent (d):

Mixture (1/5/3 by mol) of the following compounds

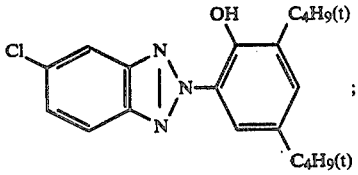

;

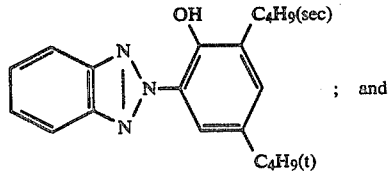

; and

-continued

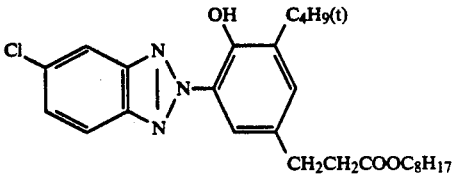

Solvent (e):

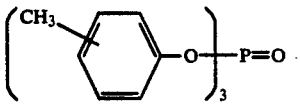

Color Image Stabilizer (f):
Mixture (1/3/3 by mol) of the following compounds

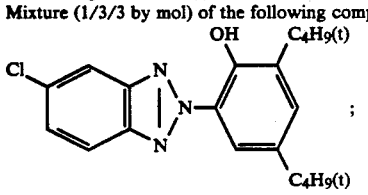

;

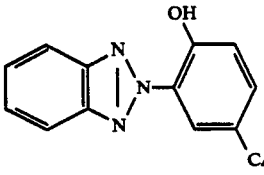

; and

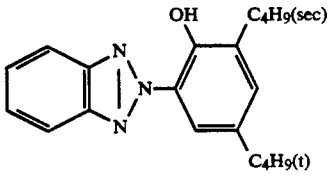

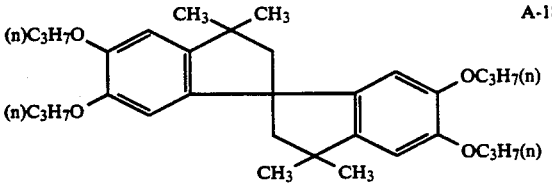

A-18

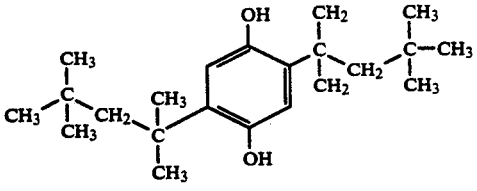

A-30

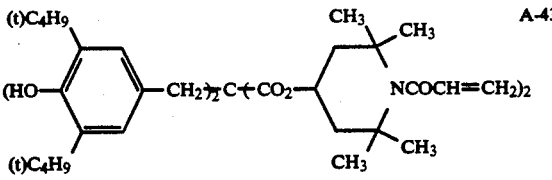

A-43

As the anti-irradiation dye for the respective layers, the following dyes were used.

Green-sensitive Emulsion Layer:

-continued

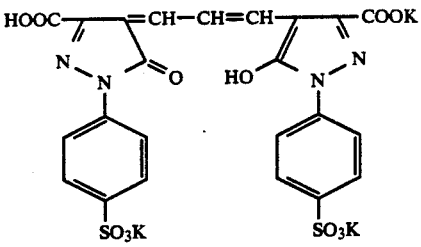

Red-sensitive Emulsion Layer

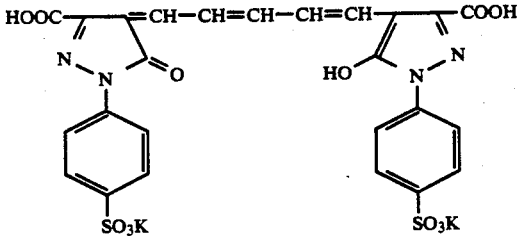

In the same manner as the preparation of the above-mentioned sample, except that the magenta coupler and the cyan coupler were removed from the third layer and the fifth layer, respectively, and the above-mentioned Compound (Y-35) was used in place of the yellow coupler in the first layer, Sample (D) was obtained. In addition, Sample (D-1) through Sample (D-25) were also prepared in the same manner as the preparation of Sample (D), except that the combination of the yellow coupler and the compound of the invention as shown in the following Table 5 was used.

Next, the samples thus prepared were exposed to light through an optical wedge and then processed in accordance with the following process (A) or (B) to form color images in the respective samples.

Process (A)

The samples exposed were subjected to running development with Fuji Color Roll Processor FMPP 1000 (partly modified) (by Fuji Photo Film Co.) under the conditions described below.

| Step | Time (seconds) | Temperature | Tank Capacity (liter) | Amount of Replenisher (ml/m$^2$) |
|---|---|---|---|---|
| Color Development | 45 | 35° C. | 88 | 150 |
| Bleach-fixation | 45 | 35° C. | 35 | 50 |
| Rinsing (1) | 20 | 35° C. | 17 | — |
| Rinsing (2) | 20 | 35° C. | 17 | — |
| Rinsing (3) | 20 | 35° C. | 17 | 250 |

The rinsing step was carried out by means of a three tank-countercurrent system, where a replenisher was replenished into the rinsing tank (3), the solution overflown from the rinsing tank (3) was introduced into the bottom of the rinsing tank (2), the solution overflown from the rinsing tank (2) was introduced into the bottom of the rinsing tank (1), and the solution overflown from the rinsing tank (1) was drained out therefrom. The amount of the processing solution as taken out from the previous bath into the next bath together with the photographic paper being processed in this system was 25 ml per m$^2$ of the paper.

The processing solutions in the respective tanks and the replenishers had the following compositions:

| | Tank Solution | Replenisher |
|---|---|---|
| Color Developer: | | |
| Water | 800 ml | 800 ml |
| Diethylenetriamine-pentaacetic acid | 3.0 g | 3.0 g |
| Benzyl alcohol | 15 ml | 17 ml |
| Diethylene glycol | 10 ml | 10 ml |
| Sodium sulfite | 2.0 g | 2.5 g |
| Potassium bromide | 0.5 g | — |
| Sodium carbonate | 30 g | 35 g |
| N-Ethyl-N-(β-methanesulfonamido-ethyl)-3-methyl-4-aminoaniline sulfate | 5.0 g | 7.0 g |
| Hydroxylamine sulfate | 4.0 g | 4.5 g |
| Brightening agent | 1.0 g | 1.5 g |
| Water to make | 1000 ml | 1000 ml |
| pH | 10.10 | 10.50 |
| Bleaching-fixation Solution: | | |
| Water | 400 ml | 400 ml |
| Ammonium thiosulfate (70 wt %) | 150 ml | 300 ml |
| Sodium sulfite | 12 g | 25 g |
| Ammonium ethylenediamine-tetra-acetic acid iron (III) | 55 g | 110 g |
| 2Na Ethylenediamine-tetraacetate | 5 g | 10 g |
| Water to make | 1000 ml | 1000 ml |
| pH (25° C.) | 6.70 | 6.50 |

-continued

| | |
|---|---|
| Rinsing Solution: | |
| Ethylenediamine-N,N,N',N'-tetramethylene-phosphonate | 0.3 g |
| Benzotriazole | 1.0 g |
| Water to make | 1000 ml |
| Sodium hydroxide to make pH | 7.5 |

Process (B):

| Step | Time | Temperature | Tank Capacity (liter) | Amount of Replenisher (ml/m²) |
|---|---|---|---|---|
| Color Development | 45 sec | 35° C. | 88 | 150 |
| Bleach-fixation | 2 min | 35° C. | 35 | 350 |
| Rinsing (1) | 1 min | 35° C. | 17 | — |
| Rinsing (2) | 1 min | 35° C. | 17 | — |
| Rinsing (3) | 1 min | 35° C. | 17 | 1300 |

The processing solutions and the replenishers were same as those used in the process (A).

Next, the yellow reflection density in the non-image part of each of the samples as processed by the above-mentioned process was measured after one hour from the processing. In addition, after being left at 80° C. (10 to 15% RH) for 7 days or after being left at 80° C. (70% RH) for 8 days, the yellow reflection density in the non-image part of each sample was also measured. The results are shown in the following Table 5.

TABLE 5

| Sample | Yellow Coupler | Additive | Amount Added (mol % to Coupler) | Process | Increment of Yellow Stain: 80° C., 7 Days | Increment of Yellow Stain: 80° C./70% RH, 8 Days | Notes |
|---|---|---|---|---|---|---|---|
| D | Y-35 | — | — | A | 0.04 | 0.11 | Comparison |
| D | " | — | — | B | 0.01 | 0.11 | " |
| D-1 | " | I - 1 | 30 | A | 0.01 | 0.02 | Invention |
| D-2 | " | I - 3 | " | A | 0.01 | 0.02 | " |
| D-3 | " | I - 5 | " | A | 0.00 | 0.03 | " |
| D-4 | " | I - 7 | " | A | 0.01 | 0.02 | " |
| D-5 | " | I - 12 | " | A | 0.01 | 0.03 | " |
| D-6 | " | I - 17 | " | A | 0.01 | 0.02 | " |
| D-7 | " | II - 1 | 50 | A | 0.00 | 0.02 | " |
| D-8 | " | Comparative Compound (G) | " | A | 0.04 | 0.10 | Comparison |
| D-9 | " | Comparative Compound (H) | " | A | 0.05 | 0.11 | " |
| D-10 | " | Comparative Compound (I) | " | A | 0.04 | 0.11 | " |
| D-11 | " | Comparative Compound (J) | " | A | 0.04 | 0.12 | " |
| D-12 | Y-10 | — | — | A | 0.06 | 0.15 | " |
| | " | — | — | B | 0.01 | 0.09 | " |
| D-13 | " | I - 2 | 30 | A | 0.01 | 0.03 | Invention |
| D-14 | " | I - 6 | " | A | 0.02 | 0.03 | " |
| D-15 | " | I - 14 | " | A | 0.01 | 0.02 | " |
| D-16 | Y-36 | — | — | A | 0.05 | 0.10 | Comparison |
| | " | — | — | B | 0.01 | 0.01 | " |
| D-17 | " | I - 15 | 30 | A | 0.01 | 0.02 | Invention |
| D-18 | " | I - 16 | " | A | 0.00 | 0.01 | " |
| D-19 | " | Comparative Compound (D) | " | A | 0.05 | 0.12 | Comparison |
| D-20 | " | Comparative Compound (E) | " | A | 0.05 | 0.09 | " |
| D-21 | " | I - 61 | 20 | A | 0.01 | 0.02 | Invention |
| D-22 | " | I - 67 | " | A | 0.01 | 0.01 | " |
| D-23 | " | I - 85 | " | A | 0.01 | 0.02 | " |
| D-24 | " | I - 87 | " | A | 0.01 | 0.01 | " |
| D-25 | " | I - 110 | " | A | 0.01 | 0.01 | " |

Comparative Compound (G):
Compound described in U.S. Pat. No. 4,483,918

TABLE 5-continued

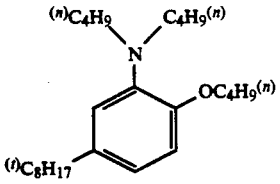

Comparative Compound (H):
Compound described in U.S. Pat. No. 4,463,085

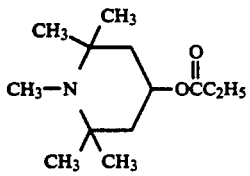

Comparative Compound (I):
Compound described in Japanese Patent Application (OPI) No. 218445/84

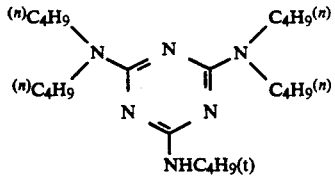

Comparative Compound (J):
Compound described in Japanese Patent Application (OPI) No. 229557/84
$C_{12}H_{23}N(CH_2CH_2OH)_2$ Table 5 indicates that in the process B where the rinsing and bleach-fixing time was long and the amount of the replenisher in the respective processing steps was sufficient, there occurred no problem of yellow stain in the samples processed, while in the process A where the processing time was short and the amount of replenisher was small, the samples processed had noticeable yellow stain. Even under such circumstances, the yellow stain was sufficiently prevented by the addition of the compound of the present invention.

On the contrary, the addition of the comparative compounds which were used in conventional means was quite ineffective for prevention of the yellow stain.

EXAMPLE 6

In the same manner as Example 5, the plural layers as mentioned in Example 5 were coated in order on a paper support both surfaces of which had been laminated with polyethylene to prepare color photographic material samples.

Specifically, the yellow coupler and the magenta coupler were removed from the first layer and the fifth layer, respectively, and the above-mentioned Compound (M-28) was used as the magenta coupler in the third layer, to obtain Sample (E). Further, Sample (E-1) through Sample (E-28) were also prepared in the same manner as the preparation of Sample (E), except that the combination of the magenta coupler and the compound of the invention as shown in the following Table 6 was used.

The samples thus prepared were exposed to light through an optical wedge and then processed for color development in accordance with the following process where the developing agent and other processing solutions used were so constituted that they would easily remain in the photographic samples processed to form stains thereon, especially for the purpose of clearly demonstrating the effect of the present invention.

| Step | Temperature | Time |
|---|---|---|
| Color Development | 33° C. | 3 min 30 sec |
| Bleach-fixation | 33° C. | 1 min 30 sec |
| Rinsing in water | 20 to 25° C. (without stirring) | 1 min |
| Drying | 50 to 80° C. | 2 min |

The respective processing solutions had the following compositions:

| | |
|---|---|
| Color Developer: | |
| 3Na.nitrilotriacetate | 2.0 g |
| Benzyl alcohol | 15 ml |
| Diethylene glycol | 10 m |
| Sodium sulfite | 0.2 g |
| Potassium bromide | 0.5 g |
| Hydroxylamine sulfate | 3.0 g |
| 4-Amino-3-methyl-N-ethyl-N-[β-methanesulfonamido)ethyl]-p-phenylenediamine sulfate | 6.5 g |
| Sodium carbonate (monohydrate) | 30 g |
| Water to make | 1000 ml |
| | (pH 10.1) |
| Bleach-fixing Solution: | |
| Above-mentioned color developer | 400 ml |
| Ammonium thiosulfate (70 wt %) | 150 ml |
| Sodium sulfite | 12 g |
| Sodium (EDTA)/Iron | 36 g |
| Disodium (EDTA) | 4 g |
| Water to make | 1000 ml |
| 1N Sulfuric acid to make | pH 7.0 |

This solution was used after being aerated for 1 hour.

(Note) The composition of the bleach-fixing solution was prepared on the presumption of such an inconvenient condition that the color developer adhered to the photographic material sample processed under a running state whereby a noticeable amount of the color developer was brought into the bleach-fixing solution together with the sample processed and hence the bleach-fixing solution composition was fatigued and deteriorated.

Next, the magenta reflection density (stain) in the non-image part of each sample was measured with a green light by a Fuji-type Auto-densitometer, after one hour from the development. Further, the magenta reflection density (stain) in the non-image part of each sample was also measured, after the samples were left at 80° C. (70% RH) for 3 days or were left at room temperature for 50 days. The results are set forth in Table 6, where the increment of the stain from that measured one hour after the color development is shown.

TABLE 6

| Sample | Magenta Coupler | Additive | Amount Added (mol % to Coupler) | Increment of Magenta Density: 80° C./70% RH, 3 Days | Increment of Magenta Density: Room Temp., 50 Days | Notes |
|---|---|---|---|---|---|---|
| E | M-23 | — | — | 0.36 | 0.28 | Comparison |
| E-1 | " | I - 2 | 30 | 0.11 | 0.01 | Invention |
| E-2 | " | I - 5 | " | 0.12 | 0.02 | " |
| E-3 | " | I - 7 | " | 0.11 | 0.01 | " |
| E-4 | " | I - 10 | " | 0.09 | 0.01 | " |
| E-5 | " | I - 14 | " | 0.09 | 0.01 | " |
| E-6 | " | I - 24 | " | 0.10 | 0.02 | " |
| E-7 | " | II - 1 | 50 | 0.13 | 0.03 | " |
| E-8 | " | (Comparative Compound G) | " | 0.32 | 0.26 | Comparison |
| E-9 | " | (Comparative Compound H) | " | 0.33 | 0.26 | " |
| E-10 | " | (Comparative Compound I) | " | 0.34 | 0.27 | " |
| E-11 | " | (Comparative Compound J) | " | 0.34 | 0.25 | " |
| E-12 | M-19 | — | — | 0.35 | 0.25 | Comparison |
| E-13 | " | I - 1 | 30 | 0.10 | 0.02 | Invention |
| E-14 | " | I - 3 | " | 0.11 | 0.02 | " |
| E-15 | " | II - 1 | 50 | 0.13 | 0.04 | " |
| E-16 | M-33 | — | — | 0.27 | 0.21 | Comparison |
| E-17 | " | I - 4 | 30 | 0.06 | 0.02 | Invention |
| E-18 | " | I - 9 | " | 0.07 | 0.02 | " |
| E-19 | " | I - 13 | " | 0.06 | 0.01 | " |
| E-20 | M-13 | — | — | 0.16 | 0.10 | Comparison |
| E-21 | " | I - 17 | 30 | 0.08 | 0.03 | Invention |
| E-22 | " | (Comparative Compound E) | " | 0.15 | 0.10 | Comparison |
| E-23 | " | (Comparative Compound F) | " | 0.17 | 0.11 | " |
| E-24 | M-23 | I - 61 | 20 | 0.05 | 0.01 | Invention |
| E-25 | " | I - 67 | " | 0.06 | 0.01 | " |
| E-26 | " | I - 85 | " | 0.07 | 0.01 | " |
| E-27 | " | I - 87 | " | 0.08 | 0.01 | " |
| E-28 | " | I - 110 | " | 0.06 | 0.01 | " |

Table 6 clearly indicates that the effect of preventing the generation of stains after storage by the use of the compounds of the invention is remarkable as compared with the use of the conventional known comparative compounds.

EXAMPLE 7

In the same manner as Example 5, the plural layers as mentioned in Example 5 were coated in order on a paper support both surfaces of which had been laminated with polyethylene to prepare color photographic material samples.

Specifically, the yellow coupler and the magenta coupler were removed from the first layer and the third layer, respectively, and the above-mentioned Compound (C-2) was used as the cyan coupler in the fifth layer, to obtain Sample (F). Further, Sample (F-1) through Sample (F-21) were also prepared in the same manner as the preparation of Sample (F), except that the combination of the cyan coupler and the compound of the invention as shown in the following Table 7 was used.

The samples thus prepared were exposed to light and processed for color development in the same manner as Example 6. After being processed, the cyan reflection density in the non-image part of each sample was measured with a red light by a Fuji-Type Auto-Densitometer. Further, the cyan reflection density in the non-image part of each sample was also measured, after the samples were left at 80° C. (70% RH) for 3 days or were left at 80° C. (dry, 10 to 15% RH) for 5 days. The results are set forth in Table 7.

TABLE 7

| Sample | Cyan Coupler | Additive | Amount Added (mol % to Coupler) | Increment of Cyan Density: 80° C., 5 Days | Increment of Cyan Density: 80° C./70% RH 3 Days | Notes |
|---|---|---|---|---|---|---|
| F | C-2 | — | — | 0.07 | 0.23 | Comparison |
| F-1 | " | I - 1 | 30 | 0.03 | 0.07 | Invention |

TABLE 7-continued

| Sample | Cyan Coupler | Additive | Amount Added (mol % to Coupler) | Increment of Cyan Density 80° C., 5 Days | 80° C./70% RH 3 Days | Notes |
|---|---|---|---|---|---|---|
| F-2 | " | I - 5 | " | 0.03 | 0.08 | " |
| F-3 | " | I - 9 | " | 0.03 | 0.07 | " |
| F-4 | " | I - 13 | " | 0.04 | 0.08 | " |
| F-5 | " | I - 17 | " | 0.03 | 0.08 | " |
| F-6 | " | II - 1 | 50 | 0.04 | 0.09 | " |
| F-7 | " | Comparative Compound A | " | 0.08 | 0.24 | Comparison |
| F-8 | " | Comparative Compound B | " | 0.07 | 0.23 | " |
| F-9 | " | Comparative Compound G | " | 0.07 | 0.24 | " |
| F-10 | " | Comparative Compound H | " | 0.08 | 0.24 | " |
| F-11 | C-25 | — | — | 0.06 | 0.22 | Comparison |
| F-12 | " | I - 3 | 30 | 0.02 | 0.06 | Invention |
| F-13 | " | I - 10 | " | 0.02 | 0.07 | " |
| F-14 | C-35 | — | — | 0.10 | 0.30 | Comparison |
| F-15 | " | I - 4 | 30 | 0.03 | 0.07 | Invention |
| F-16 | " | I - 7 | " | 0.04 | 0.06 | " |
| F-17 | C-2 | I - 61 | 20 | 0.02 | 0.03 | " |
| F-18 | " | I - 67 | " | 0.02 | 0.04 | " |
| F-19 | " | I - 85 | " | 0.03 | 0.05 | " |
| F-20 | " | I - 87 | " | 0.03 | 0.05 | " |
| F-21 | " | I - 110 | " | 0.02 | 0.03 | " |

Table 7 clearly indicates that the effect of preventing the generation of stains after storage by the use of the compounds of the invention is remarkable, and the level of the effect is high which could not be attained by any conventional technical arts.

EXAMPLE 8

In the same manner as Example 5, the first to seventh layers were coated on a paper support both surfaces of which has been laminated with polyethylene to prepare color photographic material samples.

Specifically, the above-mentioned Compound (Y-35) was used as the yellow coupled in the firstlayer, the above mentioned Compound (M-23) was used as the magenta coupler in the third layer, and a mixture (1/1 by mol) of the above mentioned Compounds (C-2) and (C-14) was used as the cyan coupler in the fifth layer, to obtain Sample (G). Further, Samples (G-1) through (G-12) were also prepared in the same manner as the preparation of Sample (G), except that the combination of the magenta coupler and the compound of the invention as shown in the following Table 8 was used.

These samples were exposed to light through an optical wedge and the processed for color development in accordance with the following process.

| Processing Steps | Temperature | Time |
|---|---|---|
| Color Development | 33° C. | 3 min 30 sec |
| Bleach-fixation | 33° C. | 1 min 30 sec |
| Rinsing in water | 33° C. | 3 min |
| Drying | 50 to 80° C. | 2 min |

The respective processing solutions had the following compositions:

| | |
|---|---|
| Color Developer: | |
| Benzyl alcohol | 12 ml |
| Diethylene glycol | 5 ml |
| Potassium carbonate | 25 g |
| Sodium chloride | 0 1 g |
| Sodium bromide | 0.5 g |
| Sodium sulfite anhydride | 2 g |
| Hydroxylamine sulfate | 2 g |
| Brightening agent | 1 g |
| 4-ethyl-N-β-methanesulfonamido-ethyl-3-methyl-4-aminoaniline sulfate | 4 g |
| Water to make | 1 liter |
| NaOH to make pH | 10.2 |
| Bleach-fixing Solution: | |
| Ammonium thiosulfate | 124.5 g |
| Sodium metabisulfite | 13.3 g |
| Sodium sulfite anhydride | 2.7 g |
| Ammonium EDTA/Iron (III) | 65 g |
| Color developer | 100 ml |
| pH was adjusted to 6.7 to 6.8 and water was added to make 1 liter. | |

Using the above-mentioned processing solution, the color development was carried out in a conventional roller-transport type developing machine whereupon the replenishment of the replenishers was effected normally and the processing solutions used had almost equilibrated compositions.

Next, the magenta reflection density (stain) in the non-image part of each sample was measured after one hour from the development. Further, the magenta reflection density (stain) in the non-image part of each sample was also measured, after the samples were left at 80° C. (70% RH) for 3 days or were left at room temperature for 50 days. The results are set forth in Table 8, where the increment of the stain from that measured in one hour after the color development is shown.

TABLE 8

| Sample | Magenta Coupler | Additive | Amount Added (mol % to Coupler) | Increment of Magenta Density 80° C./70% RH, 3 Days | Room Temp., 50 Days | Notes |
|---|---|---|---|---|---|---|
| G | M-23 | — | — | 0.18 | 0.15 | Comparison |
| G-1 | " | I - 1 | 30 | 0.05 | 0.02 | Invention |
| G-2 | " | I - 6 | " | 0.06 | 0.01 | " |

TABLE 8-continued

| Sample | Magenta Coupler | Additive | Amount Added (mol % to Coupler) | Increment of Magenta Density: 80° C./70% RH, 3 Days | Increment of Magenta Density: Room Temp., 50 Days | Notes |
|---|---|---|---|---|---|---|
| G-3 | " | I - 13 | " | 0.05 | 0.02 | " |
| G-4 | M-13 | — | — | 0.08 | 0.06 | Comparison |
| G-5 | " | I - 2 | 30 | 0.05 | 0.02 | Invention |
| G-6 | " | I - 16 | " | 0.04 | 0.02 | " |
| G-7 | " | I - 22 | " | 0.04 | 0.02 | " |
| G-8 | M-23 | I - 61 | 20 | 0.03 | 0.01 | " |
| G-9 | " | I - 67 | " | 0.02 | 0.01 | " |
| G-10 | " | I - 85 | " | 0.04 | 0.02 | " |
| G-11 | " | I - 87 | " | 0.04 | 0.01 | " |
| G-12 | " | I - 86 | " | 0.03 | 0.02 | " |

As is apparent from Table 8, the effect of preventing the generation of stains after storage by the compounds of the present invention is remarkable, and in particular, the compounds of the invention are sufficiently effective even when the composition of the development processing solution used does not vary but is constant.

EXAMPLE 10

A color photographic material (Sample H) was prepared as follows:

The following first to eleventh layers were coated on a paper support both surfaces of which had been laminated with polyethylene to obtain the color photographic material. The polyethylene coated on the side of the first layer contained titanium white as a white pigment and a slight amount of ultramarine as a bluish dye.

The light-sensitive layers had the following compositions. All the amounts coated were designated by the unit of g/m$^2$, whereas the amount of the silver halide coated was designated by the unit of g/m$^2$ as Ag.

| | |
|---|---|
| First Layer (Anti-halation Layer): | |
| Black colloidal silver | 0.01 |
| Gelatin | 0.2 |
| Second Layer (Red-sensitive Layer of Low Sensitivity): | |
| Silver iodobromide emulsion (silver iodide: 3.5 mol %, mean grain size: 0.7 μ) spectral-sensitized with Red Sensitizer Dye (*5 and *4) | 0.15 as Ag |
| Gelatin | 1.0 |
| Cyan coupler (*3) | 0.30 |
| Anti-fading agent (*2) | 0.15 |
| Coupler Solvent (*7 and *1) | 0.06 |
| Third Layer (Red-sensitive Layer of High Sensitivity): | |
| Silver iodobromide emulsion (silver iodide: 8.0 mol %, mean grain size: 0.7 μ) spectral-sensitized with Red Sensitizer Dye (*5 and *4) | 0.10 as Ag |
| Gelatin | 0.50 |
| Cyan coupler (*3) | 0.10 |
| Anti-fading agent (*2) | 0.05 |
| Coupler Solvent (*7 and *1) | 0.02 |
| Fourth Layer (Interlayer): | |
| Yellow colloidal silver | 0.02 |
| Gelatin | 1.00 |
| Color mixing preventing agent (*14) | 0.08 |
| Color mixing preventing agent solvent (*13) | 0.16 |
| Polymer latex (*6) | 0.40 |
| Fifth Layer (Green-sensitive Layer of Low Sensitivity): | |
| Silver iodobromide emulsion (silver iodide: 2.5 mol %, mean grain size: 0.4 μ) spectral-sensitized with Green Sensitizer Dye (*12) | 0.20 as Ag |
| Gelatin | 0.70 |
| Magenta coupler (*11) | 0.40 |
| Anti-fading agent A (*10) | 0.05 |
| Anti-fading agent B (*9) | 0.05 |
| Anti-fading agent C (*8) | 0.02 |

-continued

| | |
|---|---|
| Coupler solvent (*18) | 0.60 |
| Sixth Layer (Green-sensitive Layer of High Sensitivity): | |
| Silver iodobromide emulsion (silver iodide: 3.5 mol %, mean grain size: 0.9 μ) spectral-sensitized with Green Sensitizer Dye (*12) | 0.20 as Ag |
| Gelatin | 0.70 |
| Magenta coupler (*11) | 0.40 |
| Anti-fading agent A (*10) | 0.05 |
| Anti-fading agent B (*9) | 0.05 |
| Anti-fading agent C (*8) | 0.02 |
| Coupler solvent (*18) | 0.60 |
| Seventh Layer (Yellow Filter Layer): | |
| Yellow colloidal silver | 0.20 |
| Gelatin | 1.00 |
| Color mixing preventing agent (*14) | 0.06 |
| Color mixing preventing agent solvent (*13) | 0.24 |
| Eighth Layer (Blue-sensitive Layer of Low Sensitivity): | |
| Silver iodobromide emulsion (silver iodide: 2.5 mol %, mean grain size: 0.5 μ) spectral-sensitized with Blue Sensitizer Dye (*16) | 0.15 as Ag |
| Gelatin | 0.50 |
| Yellow coupler (*15) | 0.25 |
| Coupler solvent (*18) | 0.05 |
| Ninth Layer (Blue-sensitive Layer of High Sensitivity): | |
| Silver iodobromide emulsion (silver iodide: 2.5 mol %, mean grain size: 1.4 μ) spectral-sensitized with Blue Sensitizer Dye (*16) | 0.20 as Ag |
| Tenth Layer (Ultraviolet Absorbing Layer): | |
| Gelatin | 1.50 |
| Ultraviolet absorbent (*19) | 1.0 |
| Ultraviolet absorbent solvent (*18) | 0.30 |
| Color mixing preventing agent (*17) | 0.08 |
| Eleventh Layer (Protective Layer): | |
| Gelatin | 1.0 |

The compounds used in the above-mentioned layers are as follows:

(*1) Dioctyl phthalate
(*2) 2-(2-Hydroxy-3-sec-butyl-5-t-butylphenyl)benzotriazole
(*3) 2-[α-(2,4-di-t-amylphenoxy)butanamido]-4,6-dichloro-5-ethylphenol]
(*4) 5,5'-Dichloro-3,3'-di(3-sulfobutyl)-9-ethylthiacarbocyanine/Na-salt
(*5) Triethylammonium 3-[2-{2-[3-(3-sulfopropyl)naphtho-(1,2-d)thiazolin-2-ylidenemethyl]-1-butenyl}-3-naphtho(1,2-d)thiazolino]propanesulfonate
(*6) Polyethyl acrylate
(*7) Trioctyl phosphate
(*8) 2,4-Di-t-hexylhydroquinone
(*9) Di-(2-hydroxy-3-t-butyl-5-methylphenyl)methane
(*10) 3,3,3',3'-Tetramethyl-5,6,5',6'-tetrapropoxy-1,1'-bisspiroindane
(*11) 3-(2-Chloro-5-tetradecanamidoanilino)-1-(2,4,6-trichlorophenyl)-2-pyrazolin-5-one
(*12) 5,5'-Diphenyl-9-ethyl-3,3'-disulfopropyloxacarbocyanine/Na-salt
(*13) O-cresyl phosphate
(*14) 2,4-Di-t-octylhydroquinone
(*15) α-Pivaloyl-α-[(2,4-dioxo-1-benzyl-5-ethoxyhydantoin-3-

-continued

| | |
|---|---|
| | yl)-2-chloro-5-(α-2,4-dioxo-5-amylphenoxy)butan-amino]acetanilide |
| (*16) | Triethylammonium 3-[2-(3-benzylrhodanine-5-ylidene)-3-benzoxazolinyl]propanesulfonate |
| (*17) | 2,4-Di-sec-octylhydroquinone |
| (*18) | Trinonyl phosphate |
| (*19) | 5-Chloro-2-(2-hydroxy-3-t-butyl-5-t-octyl)phenyl-benzotriazole |

In the same manner as the preparation of Sample (H), except that the combination of the Magenta Coupler and the compound of the invention as shown in the following Table 9 was used in the fifth and sixth layers in place of the Magenta Coupler of Sample (H), Sample (H-1) through (H-6) were also prepared.

These samples thus prepared were exposed to light through an optical wedge and then processed for color development in accordance with the following procedure.

| Processing Steps | Temperature | Time |
|---|---|---|
| First Development (Black-and-white development) | 38° C. | 1 min 15 sec |
| Rinsing in Water | 38° C. | 1 min 30 sec |
| Reversal Exposure | 100 lux or more | 1 min or more |
| Color Development | 38° C. | 2 min 15 sec |
| Rinsing in Water | 38° C. | 45 sec |
| Bleach-fixation | 38° C. | 2 min 00 sec |
| Rinsing in Water | 38° C. | 2 min 15 sec |

The processing solutions used had the following compositions.

| | |
|---|---|
| First Developer: | |
| Penta-sodium nitrilo-N,N,N-trimetylene-phosphonate | 0.6 g |
| Penta-sodium dietylenetriamine-penta-acetate | 4.0 g |
| Potassium sulfite | 30.0 g |
| Potassium thiocyanate | 1.2 g |
| Potassium carbonate | 35.0 g |
| Potassium hydroquinone-monosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make | 1 liter |
| (pH | 9.70) |
| Color Developer: | |
| Benzyl alcohol | 15.0 ml |
| Diethylene glycol | 12.0 ml |
| 3,6-Dithio-1,8-octanediol | 0.2 g |
| Penta-sodium nitrilo-N,N,N-trimethylene-phosphonate | 0.5 g |
| Penta-sodium diethylenetriamine-penta-acetate | 2.0 g |
| Sodium sulfite | 2.0 g |
| Potassium carbonate | 25.0 g |
| Hydroxylamine sulfate | 3.0 g |
| N-Ethyl-N-(β-methanesulfonamidoethyl)-3-methyl-4-aminoaniline sulfate | 5.0 g |
| Potassium bromide | 0.5 g |
| Potassium iodide | 1.0 mg |
| Water to make | 1 liter |
| (pH | 10.40) |
| Bleach-fixing Solution: | |
| 2-Mercapto-1,3,4-triazole | 1.0 g |
| Disodium ethylenediamine-tetraacetate/di-hydrate | 5.0 g |
| Ammonium ethylenediamine-tetraacetate/Fe(III)/mono-hydrate | 80.0 g |
| Sodium sulfite | 15.0 g |
| Sodium thiosulfate (700 g/liter-solution) | 160.0 ml |
| Glacial acetic acid | 5.0 ml |
| Water to make | 1 liter |
| (pH | 6.50) |

Next, the magenta reflection density (stain) in the non-image part of each sample was measured after the development. Further, the magenta reflection density (stain) in the non-image part of each sample was also measured, after the samples were left at 80° C. (70% RH) for 3 days or were left at room temperature for 80 days. The results are set forth in Table 9, where the increment of the stain from that measured at one hour after the color development is shown.

TABLE 9

| Sample | Magenta Coupler | Additive | Amount Added (mol % to Coupler) | Increment of Magenta Density: 80° C./70% RH, 3 Days | Increment of Magenta Density: Room Temp., 80 Days | Notes |
|---|---|---|---|---|---|---|
| H | M-13 | — | — | 0.06 | 0.04 | Comparison |
| H-1 | " | I - 2 | 30 | 0.03 | 0.02 | Invention |
| H-2 | " | I - 7 | " | 0.02 | 0.01 | " |
| H-3 | " | I - 24 | " | 0.03 | 0.02 | " |
| H-4 | M-23 | — | — | 0.14 | 0.12 | Comparison |
| H-5 | " | I - 1 | 30 | 0.03 | 0.01 | Invention |
| H-6 | " | I - 6 | " | 0.04 | 0.01 | " |

As is apparent from Table 9, the effect of preventing the generation of stains after storage by the compounds of the present invention is remarkable, and the effect does not vary but is constant even when the constitution of the photographic materials to be processed and the process for the development vary.

EXAMPLE 11

A color photographic material was prepared by multiple-coating the first to the fourteenth layers (see below) on a paper support laminated with polyethylene on both sides. The polyethylene on the side to be coated with the first layer contained titanium white as a white pigment and a slight amount of ultramarine as a bluish dye.

Composition of light-sensitive layers

The compositions of the light-sensitive layers employed are indicated below in terms of components and the amounts coated, the latter being designated by the unit of g/m$^2$. The amount of silver halide coated is designated in terms of silver deposit. All of the emulsions except the one incorporated in the 14th layer were prepared by the following method.

Preparation of emulsions

Aqueous solutions of potassium bromide and silver nitrate were added simultaneously under vigorous agitation at 75° C. over a period of about 20 minutes to an aqueous solution of gelatin containing 0.3 g of 3,4-dimethyl-1,3-thiazoline-2-thione per mole of Ag. As a result, a monodispersed silver bromide emulsion comprising octahedral grains with mean size of ca. 0.40 μm was obtained. The emulsion was chemically sensitized by heating at 75° C. for 80 minutes in the presence of 6 mg of sodium thiosulfate and 7 mg of chloroauric acid (tetrahydrate) per mole of Ag. Further crystal growth was conducted in the same precipitation environment as employed above, with the previously prepared AgBr grains used as core grains. As a result of this crystal growth, a monodispersed core/shell type AgBr emulsion comprising octahedral grains with an average size of 0.7 μm was finally obtained. The coefficient of variation in grain size was ca. 10%.

The emulsion was chemically sensitized by heating at 60° C. for 60 minutes in the presence of 1.5 mg of sodium thiosulfate and 1.5 mg of chloroauric acid (tetrahydrate) per mole of Ag, so as to prepare a silver halide emulsion for internal latent image type.

| | |
|---|---|
| First Layer (Anti-halation Layer): | |
| Black colloidal silver | 0.10 |
| Gelatin | 1.30 |
| Second Layer (Interlaye): | |
| Gelatin | 0.70 |
| Third Layer (Red-sensitive Layer of Low Sensitivity): | |
| Silver bromide emulsion (mean grain size: 0.3 μm; size distribution, 8%; octahedral grain) spectrally sensitized with Red Sensitizer Dyes (ExS-1, 2 and 3) | 0.06 |
| Silver bromide emulsion (mean grain size: 0.45 μm; size distribution, 10%; octahedral grain) spectrally sensitized with Red Sensitizer Dyes (ExS-1, 2 and 3) | 0.10 |
| Gelatin | 1.00 |
| Cyan coupler (ExC-1) | 0.14 |
| Cyan coupler (ExC-2) | 0.07 |
| Anti-fading agent (Cpd-2, 3, 4 and 9 in equal amounts) | 0.12 |
| Coupler dispersant (Cpd-5) | 0.03 |
| Coupler solvent (Solv-1, 2 and 3 in equal amounts) | 0.06 |
| Fourth Layer (Red-sensitive Layer of High Sensitivity): | |
| Silver bromide emulsion (mean grain size: 0.75 μm; size distribution, 10%; octahedral grain) spectrally sensitized with Red Sensitizer Dyes (ExS-1, 2 and 3) | 0.15 |
| Gelatin | 1.00 |
| Cyan coupler (ExC-1) | 0.20 |
| Cyan coupler (ExC-2) | 0.10 |
| Anti-fading agent (Cpd-2, 3, 4 and 9 in equal amounts) | 0.15 |
| Coupler dispersant (Cpd-5) | 0.03 |
| Coupler solvent (Solv-1, 2 and 3 in equal amounts) | 0.10 |
| Fifth Layer (Interlayer): | |
| Gelatin | 1.00 |
| Color mixing preventing agent (Cpd-7) | 0.08 |
| Color-mixing preventing agent solvent (Solv-4 and 5) | 0.16 |
| Polymer Latex (Cpd-8) | 0.10 |
| Sixth Layer (Green-sensitive Layer of Low Sensitivity): | |
| Silver bromide emulsion (mean grain size: 0.28 μm; size distribution, 8%; octahedral grain) spectrally sensitized with Green Sensitizer Dyes (ExS-3 and 4) | 0.04 |
| Silver bromide emulsion (mean grain size: 0.45 μm; size distribution, 10%; octahedral grain) spectrally sensitized with Green Sensitizer Dyes (ExS-3 and 4) | 0.06 |
| Gelatin | 0.80 |
| Magenta coupler (ExM-1) | 0.10 |
| Anti-fading agent (Cpd-9) | 0.10 |
| Anti-stain agent (Cpd-10) | 0.01 |

-continued

| | |
|---|---|
| Anti-stain agent (Cpd-11) | 0.001 |
| Coupler dispersant (Cpd-5) | 0.05 |
| Coupler solvent (Solv-4 and 6 in equal amounts) | 0.15 |
| Seventh Layer (Green-sensitive Layer of High Sensitivity): | |
| Silver bromide emulsion (mean grain size: 0.9 μm; size distribution, 10%; octahedral grain) spectrally sensitized with Green Sensitizer Dyes (ExS-3) | 0.10 |
| Gelatin | 0.80 |
| Magenta coupler (ExM-1) | 0.10 |
| Anti-fading agent (Cpd-9) | 0.10 |
| Anti-stain agent (Cpd-10) | 0.01 |
| Anti-stain agent (Cpd-11) | 0.001 |
| Coupler dispersant (Cpd-5) | 0.05 |
| Coupler solvent (Solv-4 and 6 in equal amounts) | 0.15 |
| Eighth Layer (Interlayer) | |
| Same as the fifth layer. | |
| Ninth Layer (Yellow Filter Layer): | |
| Yellow colloidal silver | 0.20 |
| Gelatin | 1.00 |
| Color mixing preventing agent (Cpd-7) | 0.06 |
| Color mixing preventing agent solvent (Solv-4 and 5 in equal amount) | 0.15 |
| Polymer Latex (Cpd-8) | 0.10 |
| Tenth Layer: | |
| Same as the fifth layer. | |
| Eleventh Layer (Blue-sensitive Layer of Low Sensitivity): | |
| Silver bromide emulsion (mean grain size: 0.35 μm; size distribution, 8%; tetradecahedral grain) spectrally sensitized with Blue Sensitizer Dyes (ExS-5) | 0.07 |
| Silver bromide emulsion (mean grain size: 0.45 μm; size distribution, 10%; tetradecahedral grain) spectrally sensitized with Blue Sensitizer Dyes (ExS-5) | 0.10 |
| Gelatin | 0.50 |
| Yellow coupler (ExY-1) | 0.20 |
| Anti-stain agent (Cpd-11) | 0.001 |
| Anti-fading agent (Cpd-6) | 0.10 |
| Coupler dispersant (Cpd-5) | 0.05 |
| Coupler solvent (Solv-2) | 0.05 |
| Twelfth Layer (Blue-sensitive Layer of High Sensitivity): | |
| Silver bromide emulsion (mean grain size: 1.2 μm; size distribution, 10%; tetradecahedral grain) spectrally sensitized with Blue Sensitizer Dyes (ExS-5 and 6) | 0.25 |
| Gelatin | 1.00 |
| Yellow coupler (ExY-1) | 0.40 |
| Anti-stain agent (Cpd-11) | 0.002 |
| Anti-fading agent (Cpd-6) | 0.10 |
| Coupler dispersant (Cpd-5) | 0.05 |
| Coupler solvent (Solv-2) | 0.10 |
| Thirteenth Layer (Ultraviolet Absorbing Layer): | |
| Gelatin | 1.50 |
| Ultraviolet absorbent (Cpd-1, 3 and 13 in equal amounts) | 1.00 |
| Color mixing preventing agent (Cpd-6 and 14 in equal amounts) | 0.06 |
| Dispersant (Cpd-5) | 0.08 |
| Ultraviolet absorbent solvent (Solv-1 and 2 in equal amounts) | 0.15 |
| Anti-irradiation dye (Cpd-15 and 16 in equal amounts) | 0.02 |
| Anti-irradiation dye (Cpd-17 and 18 in equal amounts) | 0.02 |
| Fourteenth Layer (Protective Layer): | |
| Fine silver chlorobromide grains (AgCl, 97 mol %; mean size, 0.2 μm) | 0.15 |
| Modified POVAL | 0.02 |
| Gelatin | 1.50 |
| Gelatin hardener (H-1) | 0.17 |

Each of the light-sensitive layers contained $10^{-3}$ wt % of N-I-9 (as a nucleating agent) and $10^{-2}$ wt % of ExZS-1 (as a nucleation accelerator) on the basis of the silver halide deposit in each layer.

Each of the 1st to 14th layers contained Alkanol XC (product of Dupont) and a sodium alkylbenzenesulfonate as emulsification and dispersion aids, and a succinic acid ester and Magefac F-120 (product of Dainippon Ink & Chemicals, Inc.) as coating aids. Stabilizers (Cpd-19, 20 and 21) were incorporated in the silver halide or colloidal silver containing layers. The sample prepared using the above-mentioned layers was designated (I). The compounds employed in this example are identified below.

Additional samples were prepared by the same procedures as employed for the preparation of sample (I), except that the magenta couplers and Cpd-10 in the 6th and 7th layers were changed to those indicated in Table 10.

The samples thus prepared were exposed to light through an optical wedge, then processed for color development in accordance with Processing Scheme C.

In the next place, the magenta reflection density (stain) in the non-image area of each sample was measured after the development. Further, the magenta reflection density (stain) in the non-image area of each sample was also measured, after the samples were left at 80° C. (70% RH) for 3 days or were left at room temperature and 80 days. The results are set forth in Table 11, where the increment of the stain from that measured at one hour after the color development is shown.

(ExS-1)

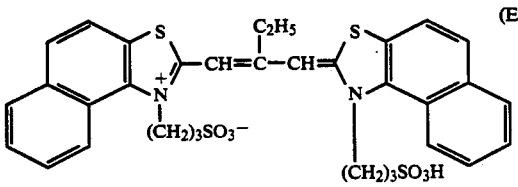

(ExS-2)

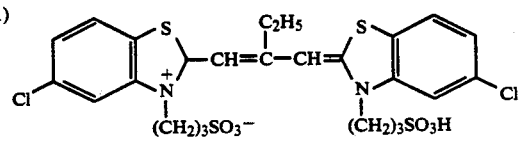

(ExS-3)

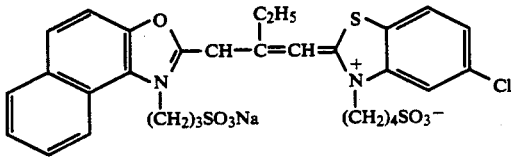

(ExS-4)

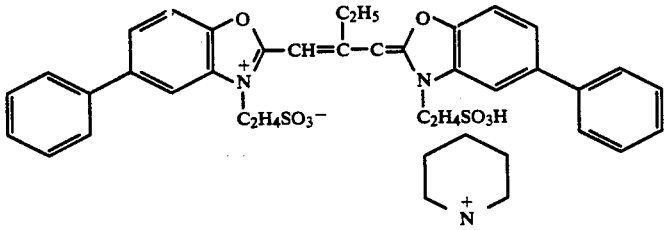

(ExS-5)

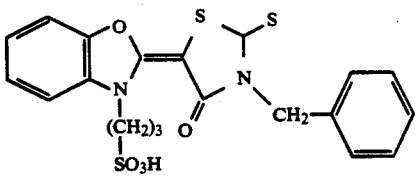

(Cpd-1)

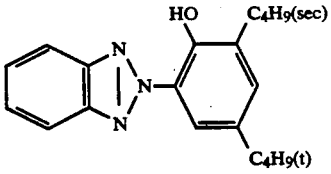

(Cpd-2)

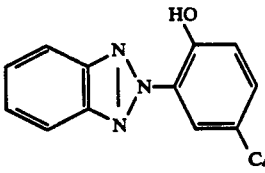

(Cpd-3)

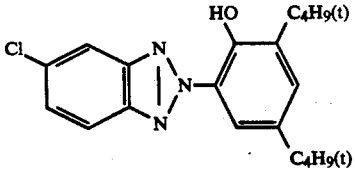

(Cpd-4)

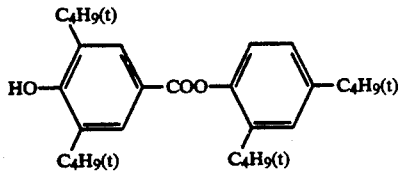

(Cpd-5)

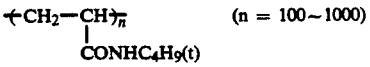

(n = 100~1000)

-continued
(Cpd-6)
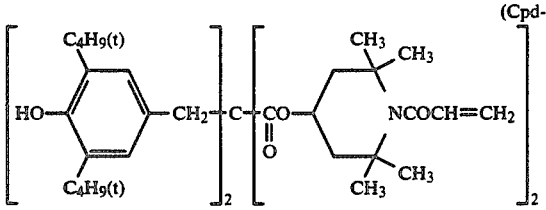
(Cpd-7)
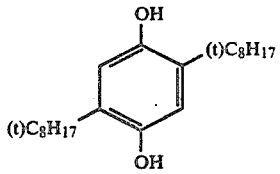
Polyethyl acrylate
(Cpd-8)
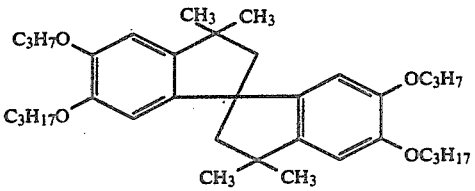
(Cpd-9)
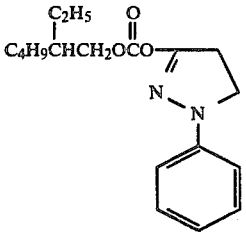
(Cpd-10)
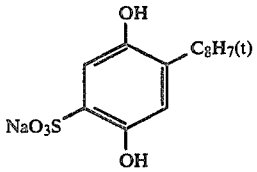
(Cpd-11)
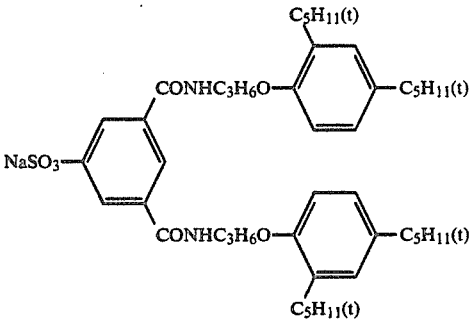
(Cpd-12)
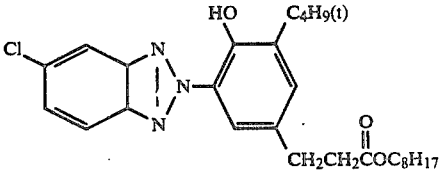
(Cpd-13)
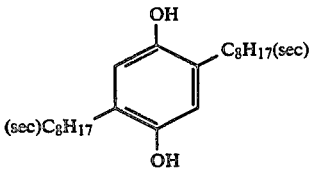
(Cpd-14)
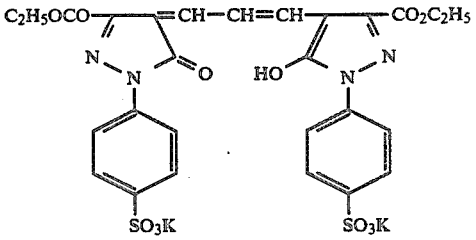
(Cpd-15)
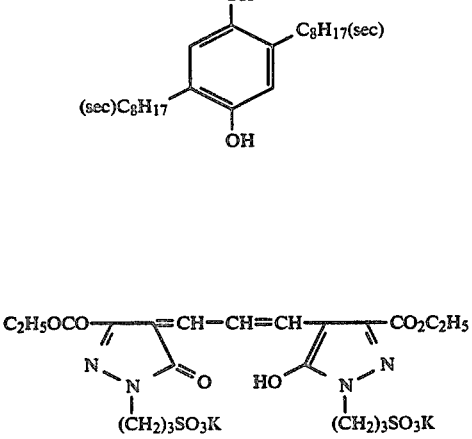
(Cpd-16)
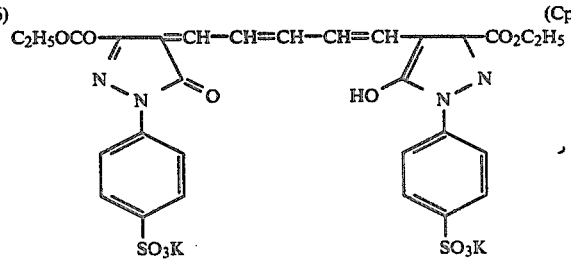
(Cpd-17)

-continued
(Cpd-18)
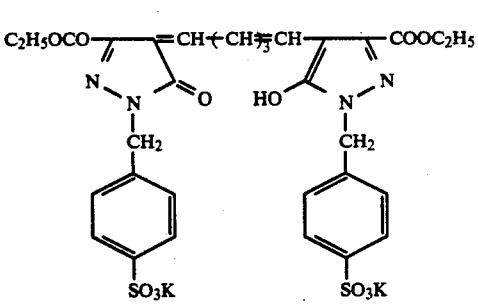
(Cpd-19)
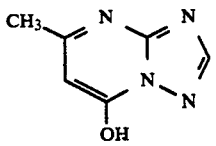
(Cpd-20)
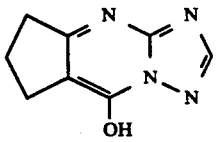
(Cpd-21)
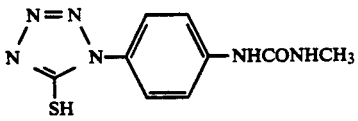
(EXC-1)
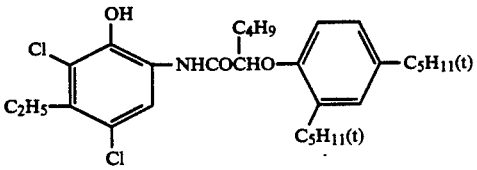
(EXC-2)
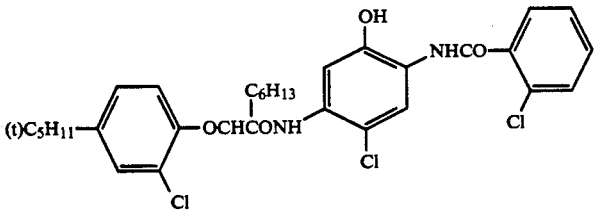
(ExM-1)
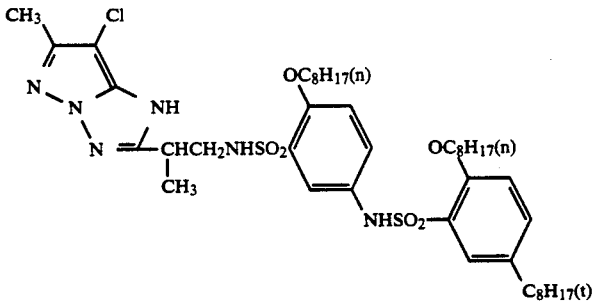
(ExY-1)
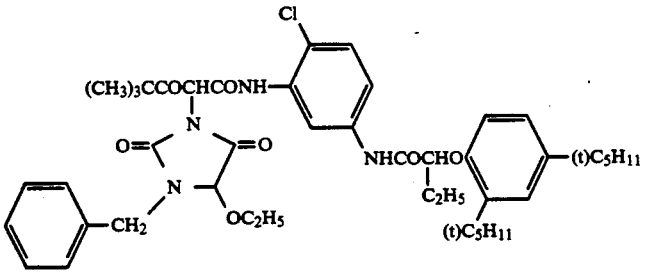
| | |
|---|---|
| Di(2-ethylhexyl)phthalate | Solv-1 |
| Trinonyl phosphate | Solv-2 |
| Di(3-methylhexyl)phthalate | Solv-3 |
| Tricresyl phosphate | Solv-4 |
| Dibutyl phthalate | Solv-5 |
| Trioctyl phosphate | Solv-6 |
| Trioctyl sebacate | Solv-7 |
| 1,2-bis(vinylsulfonylacetamido)ethane | H-1 |

-continued (N-I-9)

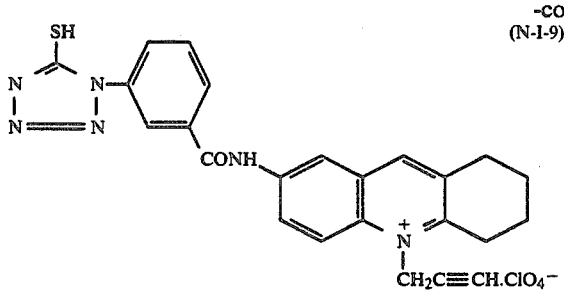

(ExZS-1)

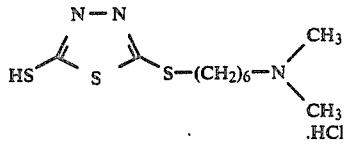

| Processing Scheme C | | |
|---|---|---|
| Steps | Time (sec) | Temperature (°C.) |
| Color development | 70 | 38 |
| Bleach Fixing | 45 | 38 |
| Rinsing in water (1) | 45 | 38 |
| Rinsing in water (2) | 45 | 38 |

Rinsing water was replensished by the "countercurrent replenishing system" in which the rinse bath (2) was replenished, with the overflow from the rinse bath (2) being introduced into the rinse bath (1).

| Color Developer | Mother Liquid |
|---|---|
| Diethylenetriaminepentaacetic acid | 0.5 g |
| 1-Hydroxyethylidene-1,1-diphosphonic acid | 0.5 g |
| Diethylene glycol | 8.0 g |
| Benzyl alcohol | 12.0 g |
| Sodium bromide | 0.7 g |
| Sodium sulfite | 2.0 g |
| N,N-diethylhydroxylamine | 3.5 g |
| Triethylenediamine(1,4-diazabicyclo-[2,2,2,2]octane) | 3.5 g |
| 3-Methyl-4-amino-N-ethyl-N-(β-methanesulfonamidoethyl)aniline | 6.0 g |
| Potassium carbonate | 30.0 g |
| Brightener (stilbene based compound) | 1.0 g |
| Pure water to make | 1000 ml |
| pH | 10.50 |

pH adjustment was achieved by addition of potassium hydroxide or hydrochloric acid.

| Bleach-fixing Solution | Mother Liquid |
|---|---|
| Ammonium thiosulfate | 110 g |
| Sodium hydrogen sulfite | 14.0 g |
| Ammonium ethylenediaminetetraacetate/ Fe(III)/dihydrate | 40.0 g |
| Ethylenediaminetetraacetic acid Disodium salt (dihydrate) | 4.0 g |
| Pure water to make | 1000 ml |
| pH | 7.0 |

pH adjustment was achieved by addition of aqueous ammonia of hydrochloric acid.

Rinsing Water

Pure water was used.

Pure water was obtained from tap water that had been subjected to an ion-exchange treatment so that all cations other than hydrogen ions and all anions except hydroxyl ions were reduced to concentrations of no more than 1 ppm.

TABLE 10

| Sample | Magenta Coupler | Additive | Amount Added (mol % to Coupler) | Increment of Magenta Density: 80° C./70% RH, 3 Days | Increment of Magenta Density: Room Temp., 80 Days | Notes |
|---|---|---|---|---|---|---|
| I | ExM-1 (M-23) | Cpd-10 | 10 | 0.05 | 0.05 | Comparison |
| I-1 | " | — | — | 0.11 | 0.10 | " |
| I-2 | " | I-61 | 10 | 0.01 | 0.01 | Invention |
| I-3 | " | I-67 | " | 0.01 | 0.01 | " |
| I-4 | " | I-85 | " | 0.02 | 0.01 | " |
| I-5 | " | I-87 | " | 0.02 | 0.02 | " |
| I-6 | " | I-110 | " | 0.01 | 0.01 | " |
| I-7 | M-27 | — | — | 0.06 | 0.05 | Comparison |
| I-8 | " | I-28 | 10 | 0.02 | 0.01 | Invention |
| I-9 | " | I-35 | " | 0.01 | 0.02 | " |
| I-10 | " | I-46 | " | 0.01 | 0.01 | " |
| I-11 | " | I-50 | " | 0.02 | 0.01 | " |
| I-12 | " | I-53 | " | 0.01 | 0.02 | " |
| I-13 | " | I-59 | " | 0.01 | 0.01 | " |
| I-14 | " | I-86 | " | 0.01 | 0.01 | " |

Substantially the same results as shown in Table 10 were attained even when the emulsions were changed from silver bromide emulsions to silver chlorobromide emulsions having varying concentrations of silver chloride (0.5 to 99.5 mol %).

The samples were subjected to a color-fading test with a xenon lamp under the same condition as employed in Example 2. All samples exhibited high resistance to color fading by light except that sample I was inferior to samples I-1 and I-7. As is clear from these results and from the data shown in Table 11, the compounds of the present invention are highly effective in preventing the occurrence of stains in magenta image during storage In addition, the compounds have a noticeable capability of improving resistance to color fading by light.

The compounds used in Examples 12 to 14 are shown below.

Sensitizing Dyes:
ExS-1
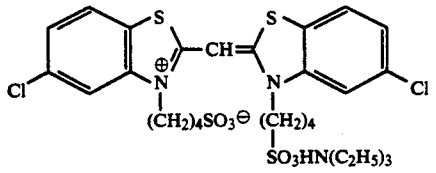
(ExS-2)
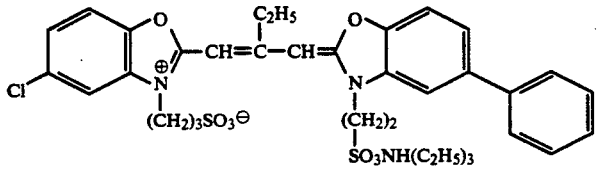
ExS-3
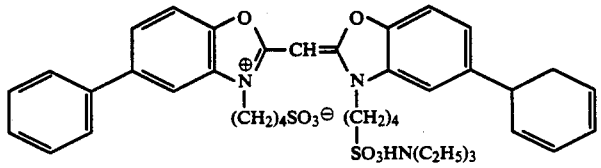
ExS-4
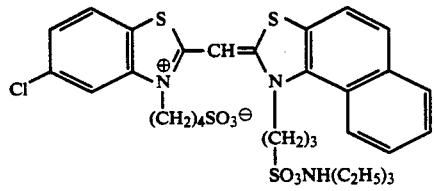
ExS-5
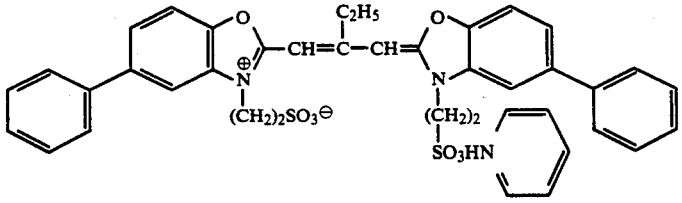
ExS-6
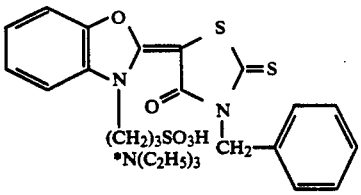
ExS-7
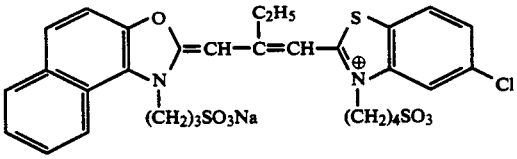
ExS-8
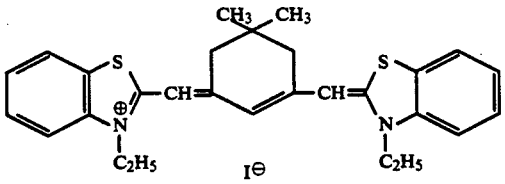
ExS-9
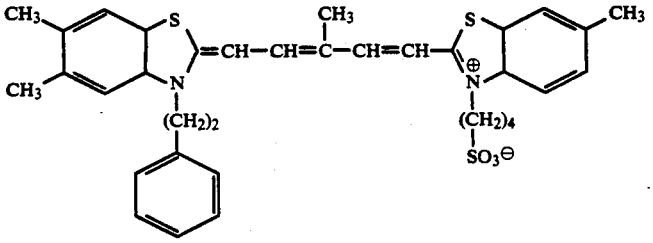

-continued
Sensitizing Dyes:
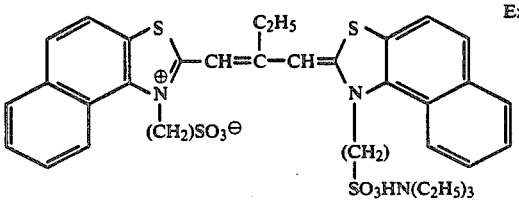
ExS-10
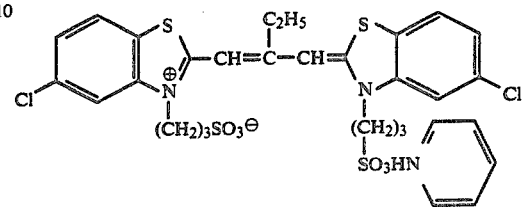
ExS-11
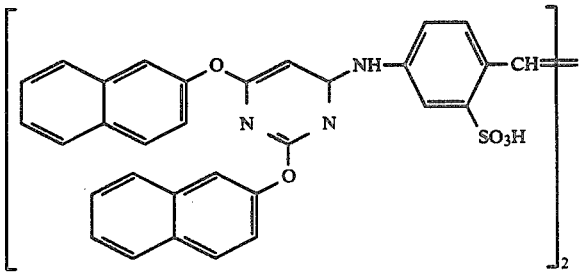
ExS-12
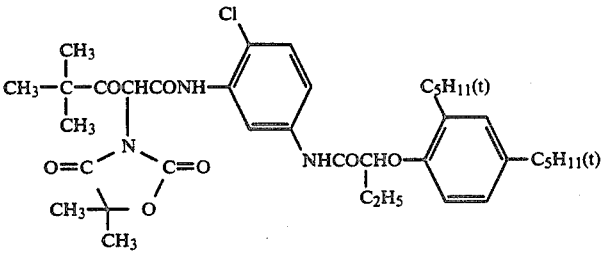
ExY-1
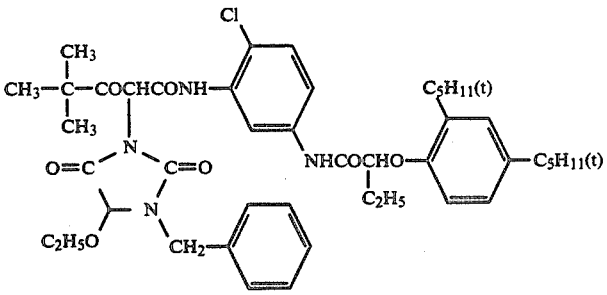
ExY-2
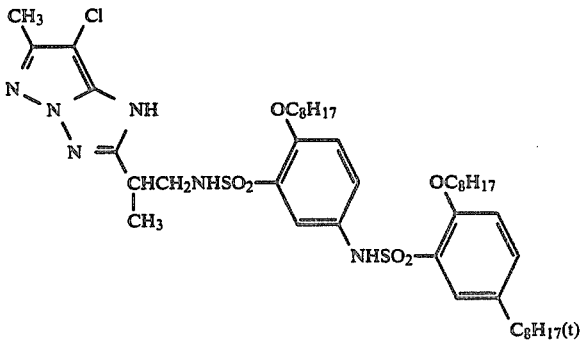
ExM-1

-continued
Sensitizing Dyes:
ExM-2
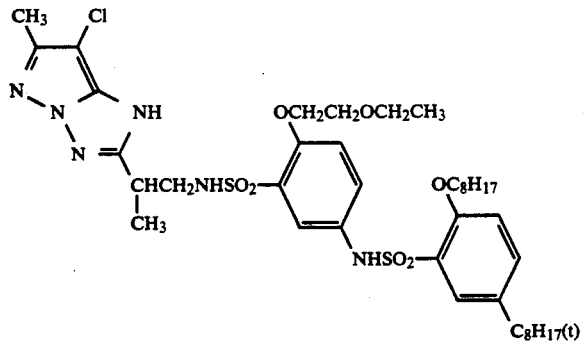
ExM-3
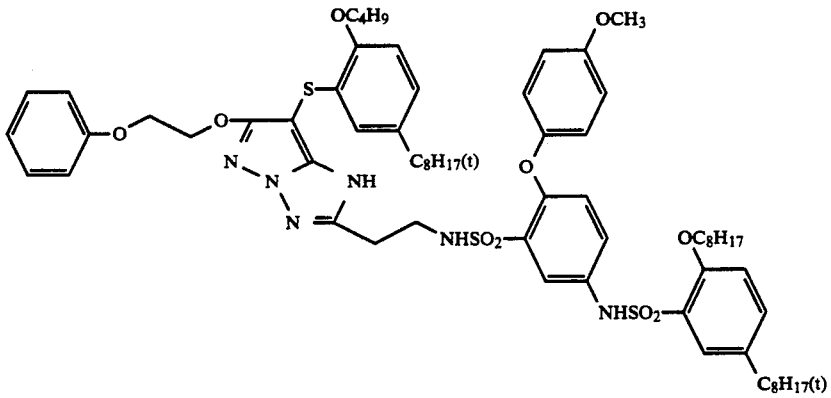
ExM-4
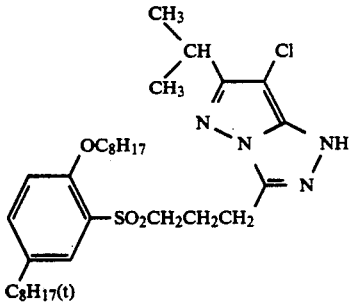
ExC-1
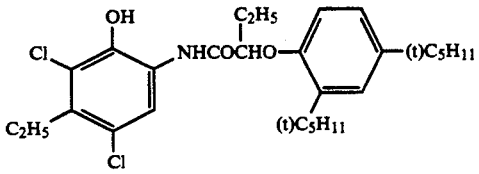
ExC-2
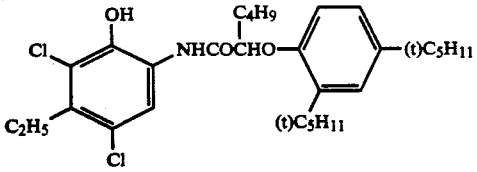
ExC-3
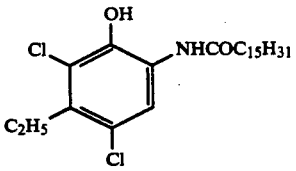
ExC-4
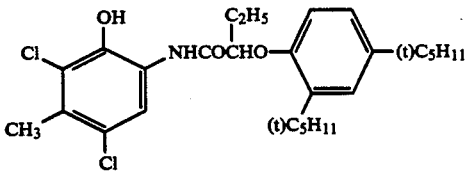
ExC-5
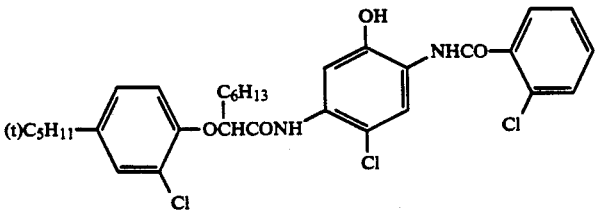

-continued
Sensitizing Dyes:
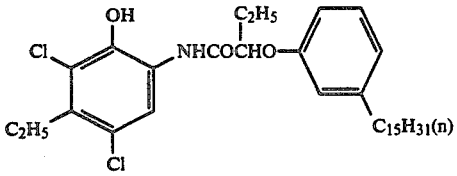
ExC-6
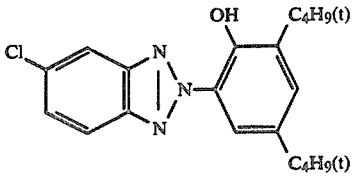
Cpd-1
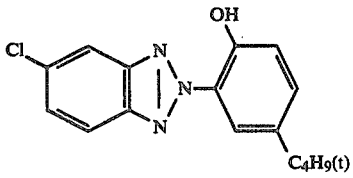
Cpd-2
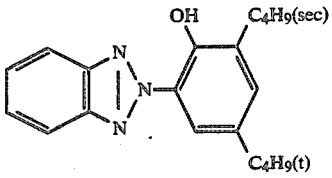
Cpd-3
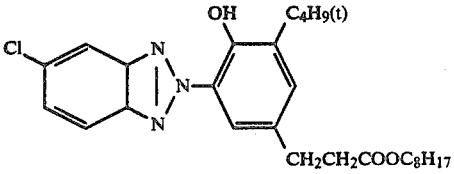
Cpd-4
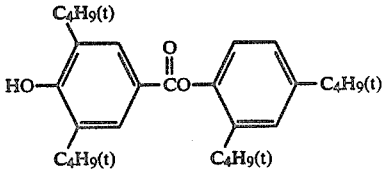
Cpd-5
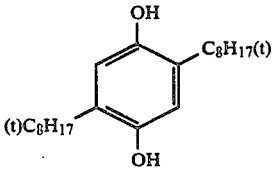
Cpd-6
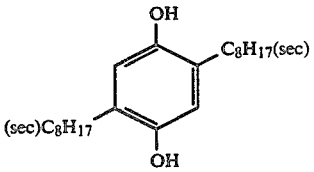
Cpd-7
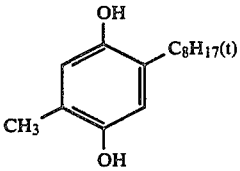
Cpd-8
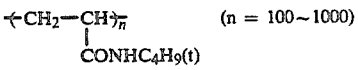
Cpd-9
Polyethyl Acrylate Latex
Cpd-10
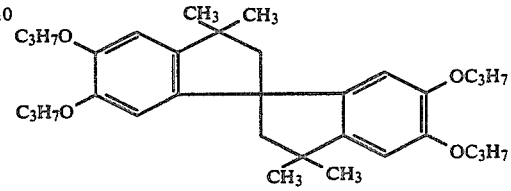
Cpd-11
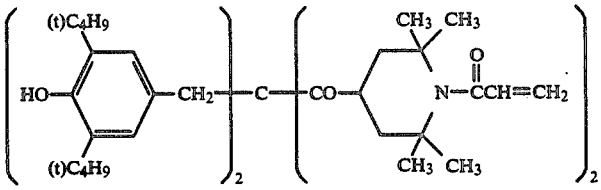
Cpd-12
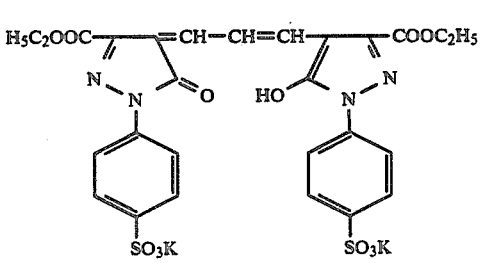
Cpd-13
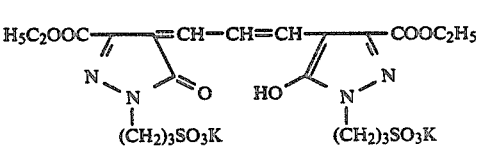
Cpd-14

-continued
Sensitizing Dyes:
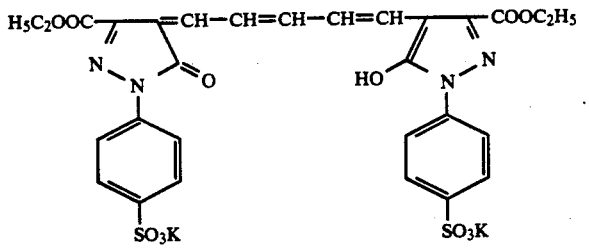
Cpd-15
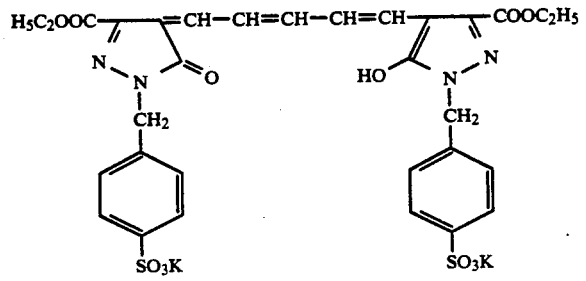
Cpd-16
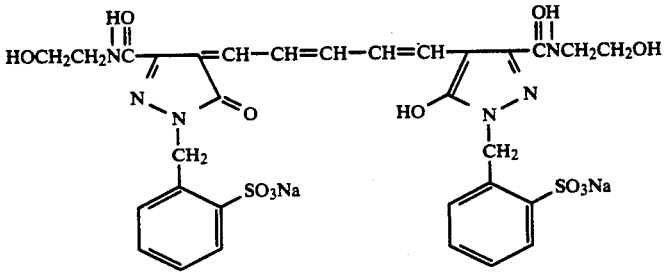
Cpd-17
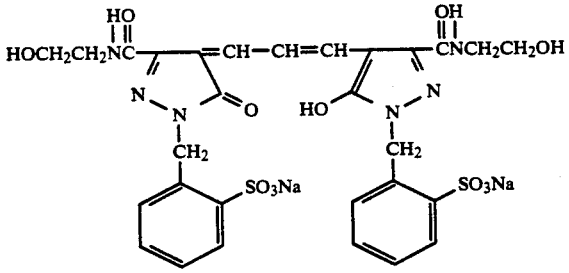
Cpd-18
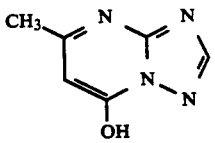
Cpd-19
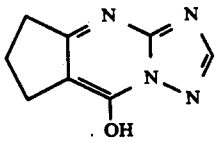
(Cpd-20)
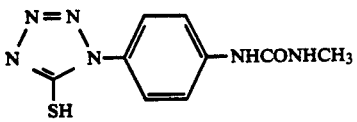
(Cpd-21)
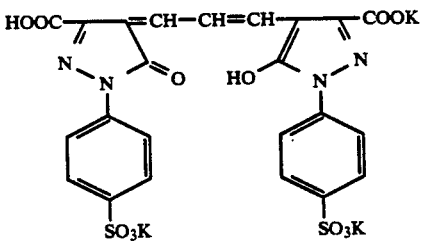
(Cpd-22)
| | |
|---|---|
| Di(2-ethylhexyl)phthalate | Solv-1 |
| Trinonyl phosphate | Solv-2 |
| Di(3-methylhexyl)phthalate | Solv-3 |
| Tricresyl phosphate | Solv-4 |
| Dibutyl phthalate | Solv-5 |

-continued

Sensitizing Dyes:

Trioctyl phosphate Solv-6

EXAMPLE 12

A multi-layered color photographic paper J was prepared by coating a plurality of layers as shown below on a paper support laminated with polyethylene on both sides. The necessary coating solutions were prepared in the following manner.

Preparation of First Layer Coating Solution 10.2 g of yellow coupler (ExY-1), 9.1 g of yellow coupler (ExY-2) and 4.4 g of a color image stabilizer (Cpd-12) were dissolved in 27.2 cc of ethyl acetate and 7.7 cc (8.0 g) of a high-boiling point solvent (Solv-5) and the resulting solution was emulsified and dispersed in 185 cc of a10% aqueous gelatin solution containing 8 cc of 10% sodium dodecylbenzenesulfonate. The resulting emulsified dispersion was mixed with emulsions EM-1 and EM-2 (see below) and a solution was made. The concentration of gelatin in the solution was so adjusted as to provide the composition indicated below. The so prepared solution was used as a coating solution for the first layer. Coating solutions for the second to seventh layers were prepared in a similar manner. A sodium salt of 1-oxy-3,5-dichloro-s-triazine was used as a gelatin hardener in each of the layers.

Layer Composition

The compositions of the individual layers are shown below, in which the numerals denote the amounts of individual components added (g/m$^2$) except that the amounts of silver halide emulsions are expressed in terms of silver deposit.

| | |
|---|---|
| Support: | |
| Polyethylene Laminated Paper (containing a white pigment ($TiO_2$) and a bluish dye in the polyethylene on the side to be coated with the first layer) | |
| First Layer (Blue-sensitive Layer): | |
| Monodispersed silver chlorobromide emulsion (EM-1) spectrally sensitized with Sensitizer Dye (ExS-1) | 0.13 |
| Monodispersed silver chlorobromide emulsion (EM-2) spectrally sensitized with Sensitizer dye (ExS-1) | 0.13 |
| Gelatin | 1.86 |
| Yellow coupler (ExY-1) | 0.44 |
| Yellow coupler (ExY-2) | 0.39 |
| Color image stabilizer (Cpd-12) | 0.19 |
| Solvent (Solv-5) | 0.35 |
| Second Layer (Color Mixing Preventing Layer): | |
| Gelatin | 0.99 |
| Color mixing preventing agent (Cpd-7) | 0.08 |
| Third Layer (Green-sensitive Layer): | |
| Monodispersed silver chlorobromide emulsion (EM-3) spectrally sensitized with Sensitizer Dye (ExS-2 and 3) | 0.05 |
| Monodispersed silver chlorobromide emulsion (EM-4) spectrally sensitized with Sensitizer Dye (ExS-2 and 3) | 0.11 |
| Gelatin | 1.80 |
| Magenta coupler (ExM-1) | 0.38 |
| Color image stabilizer (Cpd-11) | 0.20 |
| Solvent (Solv-4) | 0.12 |
| Solvent (Solv-6) | 0.25 |
| Fourth Layer (Ultraviolet Absorbing Layer): | |
| Gelatin | 1.60 |
| Ultraviolet absorber (Cpd-1/Cpd-2/Cpd-3 = 3/2/6 by weight ratio) | 0.70 |

-continued

| | |
|---|---|
| Color mixing preventing agent (Cpd-6) | 0.05 |
| Solvent (Solv-2) | 0.27 |
| Fifth Layer (Red-sensitive Layer): | |
| Monodispersed silver chlorobromide emulsion (EM-5) spectrally sensitized with Sensitizer Dye (ExS 8 and 12) | 0.07 |
| Monodispersed silver chlorobromide emulsion (EM-6) spectrally sensitized with Sensitizer Dye (ExS-8 and 12) | 0.16 |
| Gelatin | 0.92 |
| Cyan coupler (ExC-6) | 0.32 |
| Color image stabilizer (Cpd-2/Cpd-3/Cpd-4 = 3/4/2 by weight ratio) | 0.17 |
| Dispersant polymer (Cpd-9) | 0.28 |
| Solvent (Solv-4) | 0.20 |
| Sixth Layer (Ultraviolet Absorbing Layer): | |
| Gelatin | 0.54 |
| Ultraviolet absorber (Cpd-1/Cpd-3/Cpd-4 = 1/5/3 by weight ratio) | 0.21 |
| Solvent (Solv-4) | 0.08 |
| Seventh Layer (Protective Layer): | |
| Gelatin | 1.33 |
| Acryl-modified copolymer of polyvinyl alcohol (17% modification) | 0.17 |
| Liquid Paraffin | 0.03 |

The sample prepared in this example contained Cpd-15 and Cpd-22 as anti-irradiation dyes.

Each of the 1st to 7th layers contains Alkanol XC (product of Dupont) and a sodium alkylbenzenesulfonate as emulsification and dispersion aids, and a succinic acid ester and Magefacx F-120 (product of Dainippon Ink & Chemicals, Inc.) as coating aids. Silver halides were stabilized by incorporation of Cpd-19 and 21. The silver halide emulsions employed in this example are characterized below.

| Emulsion | Grain Morphology | Grain Size (μm) | Br Content (mol %) | Coefficient of Variation |
|---|---|---|---|---|
| EM-1 | cubic | 1.0 | 80 | 0.08 |
| EM-2 | cubic | 0.75 | 80 | 0.07 |
| EM-3 | cubic | 0.5 | 83 | 0.09 |
| EM-4 | cubic | 0.4 | 83 | 0.10 |
| EM-5 | cubic | 0.5 | 73 | 0.09 |
| EM-6 | cubic | 0.4 | 73 | 0.10 |

Additional samples were prepared in the same manner as described above except that the magenta coupler in the third layer (green-sensitive layer) of Sample J was replaced by equimolar amounts of the magenta couplers shown in Table 11 which were combined with selected storability-improving compounds of the present invention as indicated in Table 11.

The samples thus prepared were exposed to light through an optical wedge, then processed by the following process (I) to form color images.

Process (I)

The samples exposed were subjected to running development with a Fuji Color Paper Processor FPRP 115 (Fuji Photo Film Co., Ltd.) under the conditions described below.

Tank

-continued

| Step | Temperature (°C.) | Time | Amount of Replenisher* | Capacity (liter) |
|---|---|---|---|---|
| Color development | 37 | 3 min 30 sec | 200 ml | 60 |
| Bleach-fixing | 33 | 1 min 30 sec | 55 ml | 40 |
| Rinsing in water (1) | 24–34 | 1 min | — | 20 |
| Rinsing in water (2) | 24–34 | 1 min | — | 20 |
| Rinsing in water (3) | 24–34 | 1 min | 10 ml | 20 |
| Drying | 70–80 | 1 min | | |

[The three rinsing tanks were connected in cascade in such a way that the overflowing rinsing replenisher ran in order from tank (3) to tank (1).]

| | Tank Solution | Replenisher |
|---|---|---|
| Color Developer: | | |
| Water | 800 ml | 800 ml |
| Diethylenetriaminepentaacetic acid | 1.0 g | 1.0 g |
| Nitrilotriacetic acid | 2.0 g | 2.0 g |
| Benzyl alcohol | 15 ml | 23 ml |
| Diethylene glycol | 10 ml | 10 ml |
| Sodium sulfite | 2.0 g | 3.0 g |
| Potassium bromide | 1.2 g | — |
| Potassium carbonate | 30 g | 25 g |
| N-Ethyl-N-(β-methanesulfonamidoethyl)-3-methyl-4-aminoaniline sulfate | 5.0 g | 9.0 g |
| Hydroxylamine sulfate | 3.0 g | 4.5 g |
| Brightening agent (WHITEX 4B of Sumitomo Chemical Co., Ltd.) | 1.0 g | 2.0 g |
| Water to make | 1000 ml | 1000 ml |
| pH (at 25° C.) | 10.20 | 10.80 |
| Bleaching-fixation Solution: | | |
| Water | 400 ml | 400 ml |
| Ammonium thiosulfate (70 wt %) | 150 ml | 300 ml |
| Sodium sulfite | 13 g | 26 g |
| Ammonium ethylenediamine-tetraacetic acid iron (III) | 55 g | 110 g |
| Ethylenediaminetetraacetic acid disodium salt | 5 g | 10 g |
| Water to make | 1000 ml | 1000 ml |
| pH (at 25° C.) | 6.70 | 6.30 |

*Per square meter of the light-sensitive material.

In the next place, the magenta reflection density (stain) in the non-image area of each of the light-sensitive materials was measured after the development. Further, the magenta reflection density (stain) in the non-image area of each sample was also measured, after the samples were left at 80° C. (70% RH) for 3 days or were left at room temperature for 50 days. The results are set forth in Table 11, where the increment of the stain from that measured at one hour after the color development is shown.

As will be clear from Table 11, the compounds of the present invention are highly effective against magenta staining.

TABLE 11

| Sample | Magenta Coupler | Additive | Amount Added (mol % to Coupler) | Increment of Magenta Density: 80° C./70% RH, 3 Days | Increment of Magenta Density: Room Temp., 50 Days | Notes |
|---|---|---|---|---|---|---|
| J | ExM-1 | — | — | 0.09 | 0.07 | Comparison |
| J-1 | " | I-28 | 30 | 0.02 | 0.01 | Invention |
| J-2 | " | I-35 | " | 0.02 | 0.01 | " |
| J-3 | " | I-46 | " | 0.01 | 0.02 | " |
| J-4 | " | I-50 | " | 0.01 | 0.01 | " |
| J-5 | ExM-2 | — | — | 0.09 | 0.06 | Comparison |
| J-6 | " | I-61 | 20 | 0.01 | 0.01 | Invention |
| J-7 | " | I-67 | " | 0.01 | 0.01 | " |
| J-8 | " | I-85 | " | 0.02 | 0.01 | " |
| J-9 | " | I-87 | " | 0.02 | 0.02 | " |
| J-10 | " | I-110 | " | 0.01 | 0.01 | " |
| J-11 | ExM-3 | — | — | 0.06 | 0.03 | Comparison |
| J-12 | " | I-53 | 30 | 0.01 | 0.01 | Invention |
| J-13 | " | I-59 | 10 | 0.02 | 0.01 | " |
| J-14 | " | I-86 | " | 0.01 | 0.01 | " |
| J-15 | ExM-4 | — | — | 0.08 | 0.07 | Comparison |
| J-16 | " | I-61 | 20 | 0.01 | 0.01 | Invention |
| J-17 | " | I-67 | " | 0.01 | 0.01 | " |
| J-18 | " | I-110 | " | 0.02 | 0.01 | " |

EXAMPLE 13

A sample prepared as in Example 12 was exposed to light through an optical wedge and subsequently processed by one of the following processes (II) to (V). Evaluation of resistance to magenta staining that was conducted as in Example 12 showed that the comparative samples experienced increased magenta staining whereas the samples incorporating the compounds of the present invention were substantially free from detectable stain.

Process (II):

| Step | Temperature (°C.) | Time |
|---|---|---|
| Color development | 38 | 1 min and 40 sec |
| Bleach-fixing | 30–34 | 1 min and 00 sec |
| Rinsing in water (1) | 30–34 | 20 sec |
| Rinsing in water (2) | 30–34 | 20 sec |
| Rinsing in water (3) | 30–34 | 20 sec |
| Drying | 70–80 | 50 sec |

[The three rinsing tanks were connected in cascade in such a way that the overflowing rinsing solution ran in order from tank (3) to tank (1).]

| | |
|---|---|
| Color Developer: | |
| Water | 800 ml |
| Diethylenetriaminepentaacetic acid | 1.0 g |
| 1-Hydroxyethylidene-1,1-diphosphonic acid (60 wt %) | 2.0 g |
| Nitrilotriacetic acid | 2.0 g |
| 1,3-Diamino-2-propanol | 4.0 g |
| 1,4-Diazabicyclo[2,2,2]octane | 6.0 g |
| Potassium bromide | 0.5 g |
| Potassium carbonate | 30 g |
| N-Ethyl-N-(β-methanesulfonamidoethyl)-3-methyl-4-aminoaniline sulfate | 5.9 g |
| N,N-diethylhydroxylamine sulfate | 4.0 g |
| Brightening agent (UVITEX-CK of Ciba-Geigy A.G.) | 1.5 g |
| Water to make | 1000 ml |
| pH (at 25° C.) | 10.25 |

-continued

| Bleach-fixing Solution: | |
|---|---|
| Water | 400 ml |
| Ammonium thiosulfate (70 wt %) | 200 ml |
| Sodium sulfite | 20 g |
| Ammonium ethylenediaminetetraacetic acid Iron (III) | 60 g |
| Ethylenediaminetetraacetic acid disodium salt | 10 g |
| Water to make | 1000 ml |
| pH (at 25° C.) | 7.00 |
| Rinsing Solution | |
| Ion-exchanged water (Ca, Mg ≦ 3 ppm each) | |

Process (III):

| Step | Temperature (°C.) | Time (sec.) | Amount of Replenisher* (ml) | Tank Capacity (liter) |
|---|---|---|---|---|
| Color development | 35 | 45 | 161 | 17 |
| Bleach-fixing | 30–36 | 45 | 215 | 17 |
| Stabilizing (1) | 30–37 | 20 | — | 10 |
| Stabilizing (2) | 30–37 | 20 | — | 10 |
| Stabilizing (3) | 30–37 | 20 | — | 10 |
| Stabilizing (4) | 30–37 | 30 | 248 | 10 |
| Drying | 70–85 | 60 | | |
| [The four stabilizing tanks were connected in cascade in such a way that the overflowing stabilizing replenisher ran in order from tank (4) to tank (1).] | | | | |

*Per square meter of the light-sensitive material.

The processing solutions had the following compositions.

| Color Developer: | Tank Solution | Replenisher |
|---|---|---|
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Potassium bromide | 0.6 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| Diethylhydroxylamine | 4.2 g | 6.0 g |
| Brightening agent (4,4'-diamino-stilbene based compound) | 2.0 g | 2.5 g |
| Water to make | 1000 ml | 1000 ml |
| pH (at 25° C.) | 10.05 | 10.45 |
| Bleach-fixing Solution (Same for both Tank Solution and Replenisher): | | |
| Water | | 400 ml |
| Ammonium thiosulfate (70 wt %) | | 100 ml |
| Sodium sulfite | | 17 g |
| Ammonium Ethylenediaminetetraacetic acid iron (III) | | 55 g |
| Ethylenediaminetetraacetic acid disodium salt | | 5 g |
| Glacial acetic acid | | 9 g |
| Water to make | | 1000 ml |
| pH (at 25° C.) | | 5.40 |
| Stabilizing Solution (Same for both Tank Solution and Replenisher): | | |
| Formaldehyde (37% aq. sol.) | | 0.1 g |
| Formaldehyde-sulfurous acid adduct | | 0.7 g |
| 5-Chloro-2-methyl-4-isothiazolin-3-one | | 0.02 g |
| 2-Methyl-4-isothiazolin-3-one | | 0.01 g |
| Copper sulfate | | 0.005 g |
| Water to make | | 1000 ml |

-continued

| Color Developer: | Tank Solution | Replenisher |
|---|---|---|
| pH (at 25° C.) | | 4.0 |

Process (IV)

The samples exposed were subjected to running development with Fuji Color Roll Processor FMPP 1000 (partly modified) (by Fuji Photo Film Co.) under the conditions described below.

| Step | Time (seconds) | Temperature | Tank Capacity (liter) | Amount of Replenisher (ml/m²) |
|---|---|---|---|---|
| Color Development | 45 | 35° C. | 88 | 150 |
| Bleach-fixation | 45 | 35° C. | 35 | 50 |
| Rinsing (1) | 20 | 35° C. | 17 | — |
| Rinsing (2) | 20 | 35° C. | 17 | — |
| Rinsing (3) | 20 | 35° C. | 17 | 250 |

The rinsing step was carried out by means of a three tank-countercurrent system, where a replenisher was replenished into the rinsing tank (3), the solution overflown from the rinsing tank (3) was introduced into the bottom of the rinsing tank (2), the solution overflown from the rinsing tank (2) was introduced into the bottom of the rinsing tank (1), and the solution overflown from the rinsing tank (1) was drained out therefrom. The amount of the processing solution as taken out from the previous bath into the next bath together with the photographic paper being processed in this system was 25 ml per m² of the paper.

The processing solutions in the respective tanks and the replenishers had the following compositions:

| Color Developer: | Tank Solution | Replenisher |
|---|---|---|
| Water | 800 ml | 1000 ml |
| Diethylenetriamine-pentaacetic acid | 3.0 g | 3.0 g |
| Benzyl alcohol | 15 ml | 17 ml |
| Diethylene glycol | 10 ml | 10 ml |
| Sodium sulfite | 2.0 g | 2.5 g |
| Potassium bromide | 0.5 g | — |
| Sodium carbonate | 30 g | 35 g |
| N-Ethyl-N-(β-methanesulfonamidoethyl)-3-methyl-4-aminoaniline.sulfate | 5.0 g | 7.0 g |
| Hydroxylamine sulfate | 4.0 g | 4.5 g |
| Brightening agent | 1.0 g | 1.5 g |
| Water to make | 1000 ml | 1000 ml |
| pH | 10.10 | 10.50 |
| Bleaching-fixation Solution: | | |
| Water | 400 ml | 400 ml |
| Ammonium thiosulfate (70 wt %) | 150 ml | 300 ml |
| Sodium sulfite | 12 g | 25 g |
| Ammonium ethylenediamine-tetraacetic acid iron (III) | 55 g | 110 g |
| 2Na Ethylenediamine-tetraacetate | 5 g | 10 g |
| Water to make | 1000 ml | 1000 ml |
| pH (25° C.) | 6.70 | 6.50 |
| Rinsing Solution | | |
| Ethylenediamine-N,N,N',N'-tetramethylene-phosphonate | | 0.3 g |
| Benzotriazole | | 1.0 g |
| Water to make | | 1000 ml |
| Sodium hydroxide to make | | pH 7.5 |

Process (V):

| | Tank | Amount of |
|---|---|---|

-continued

| Step | Time | Temperature | Capacity (liter) | Replenisher (ml/m²) |
|---|---|---|---|---|
| Color Development | 45 sec | 35° C. | 88 | 150 |
| Bleach-fixation | 2 min | 35° C. | 35 | 350 |
| Rinsing (1) | 1 min | 35° C. | 17 | — |
| Rinsing (2) | 1 min | 35° C. | 17 | — |
| Rinsing (3) | 1 min | 35° C. | 17 | 1300 |

The processing solutions and the replenishers were same as those used in the process (IV).

EXAMPLE 14

Additional samples were prepared as in Example 12 except that the silver halide emulsions (EM-1 to EM-6) employed in the light-sensitive materials prepared in Example 12 were respectively replaced by silver halide emulsions (EM-7 to EM-12) characterized below, or that couplers ExC-1 to ExC-6 were used as cyan couplers.

| Emulsion | Grain Morphology | Grain Size (μm) | Cl Content (mol %) | Coefficient of Variation | Sensitizer Dye |
|---|---|---|---|---|---|
| EM-7 | cubic | 1.1 | 99.0 | 0.1 | (ExS-4) |
| EM-8 | cubic | 0.8 | 99.0 | 0.1 | (ExS-4) |
| EM-9 | cubic | 0.45 | 98.5 | 0.09 | (ExS-3, 5) |
| EM-10 | cubic | 0.34 | 98.5 | 0.09 | (ExS-3, 5) |
| EM-11 | cubic | 0.45 | 98.5 | 0.09 | (ExS-8, 12) |
| EM-12 | cubic | 0.34 | 98.4 | 0.10 | (ExS-8, 12) |

The performance of the samples was evaluated as in Example 12 and the compounds of the present invention proved to be equally effective in preventing the occurrence of stains in magenta image irrespective of variations in emulsions or couplers in layers other than magenta-forming layers.

The effect of the present invention is apparent from the above description, which is summarized as follows: In accordance with the present invention using the compounds capable of forming a chemically inactive and substantially colorless compound by forming a chemical bond with an aromatic amine series color developing agent that remains in the photographic materials after being processed for color development, the deterioration of the image quality of the color photographs prepared and the generation of stains in the photographs, which would occur after being stored for a long period of time, can effectively be prevented. This effect can sufficiently be attained even when the photographic materials are processed with processing solutions from which a noticeable amount of components of the processing solutions would enter into or adhere onto the photographic materials processed, such as processing solutions under running state, rinsing solutions containing a small amount of water or water-free rinsing solutions, substantially benzyl alcohol-free color developers, etc. or when the photographic materials are processed with other processing solutions which would be a burden on color development.

While the invention has been described in detail and with reference to specific embodiments thereof, it will be apparent to one skilled in the art that various changes and modifications can be made therein without departing from the spirit and scope thereof.

What is claimed is:

1. A color photograph containing in at least one photographic layer on a support a storability-improving compound selected from compounds of general formulae (I-a), (I-b), (I-c) and (I-d) and having a secondary reaction rate constant $k_2$ (80° C.) with p-anisidine in the range of from $1\times10^{-1}$ liter/mol.sec to $1\times10^{-5}$ liner/mol.sec.

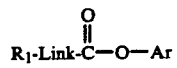
(I-a)

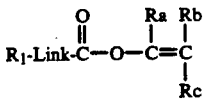
(I-b)

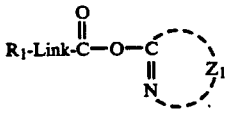
(I-c)

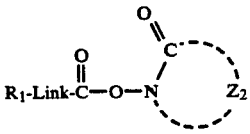
(I-d)

where $R_1$ represents an aliphatic group, an aromatic group or a heterocyclic group; Link is a single bond or —O—; Ar denotes an aromatic group, except that no group useful as a photographic reducing agent is released as a result of a result of reaction with an aromatic amine series developing agent, Ra, Rb and Rc, which may be the same or different, each represents a hydrogen atom, or an aliphatic group or a heterocyclic group; Ra, Rb and Rc may further represent an alkoxy group, an aryloxy group, a heterocyclic oxy group, an alkylthio group, an arylthio group, an heterocyclic thio group, an amino group, an alkylamino group, an acyl group, an amino group, a sulfonamido group, a sulfonyl group, an alkoxycarbonyl group, a sulfo group, a carboxyl group, a hydroxyl group, an acyloxy group, a ureido group, a urethane group, a carboamoyl group or a sulfamoyl group, provided that Ra and Rb, or Rb and Rc, may combine to form a 5- to 7-membered hetero ring, which hetero ring may be further substituted by a substituent, or form a spiro ring, a bicyclo ring, or may be fused with an aromatic ring; $Z_1$ and $Z_2$ denote the non-metallic atomic group necessary for forming a 5- to 7-membered hetero ring, which hetero ring may be further substituted by a substituent, or form a spiro ring, a bicyclo ring, or may be fused with an aromatic ring, except that $Z_1$ is not such a group that it releases a 1-phenyl-3-pyrazolide, as a result of reaction with an aromatic amine series developing agent.

2. A color photograph as claimed in claim 1, wherein the compound of formula (I) contained in the photographic material contains compound of general formula (I-a) or (I-b) having the total number of at least 13 carbon atoms.

3. A color photograph as claimed in claim 1, wherein the photographic layer contains the storability-improving compound together with a yellow coupler, a magenta coupler or a cyan coupler.

4. A color photograph as claimed in claim 3, wherein the coupler is selected from compounds of general formulae (III), (IV), (V), (VI) and (VII):

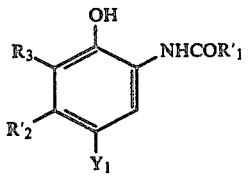
(III)

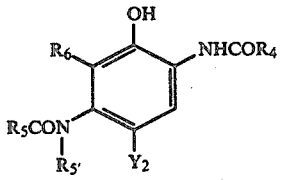
(IV)

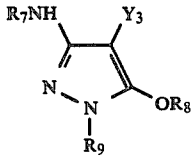
(V)

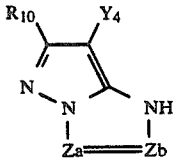
(VI)

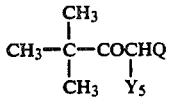
(VII)

in which $R'_1$, $R_4$ and $R_5$ each represents an aliphatic group, an aromatic group, a heterocyclic group, an aromatic amino group or a heterocyclic amino group; $R'_2$ represents an aliphatic group; $R_3$ and $R_6$ each represents a hydrogen atom, a halogen atom, an aliphatic group, an aliphatic-oxy group or an acylamino group; $R_5'$ represents a hydrogen atom or has the same meaning as $R_5$; $R_7$ and $R_9$ each represents a substituted or unsubstituted phenyl group; $R_8$ represents a hydrogen atom, an aliphatic or aromatic acyl group or an aliphatic or aromatic sulfonyl group; $R_{10}$ represents a hydrogen atom or a substituent; Q represents a substituted or unsubstituted N-phenylcarbamoyl group; Za and Zb each represents a methine group, a substituted methine group or =N—; $Y_1$, $Y_2$, $Y_3$, $Y_4$ and $Y_5$ each represents a hydrogen atom or a group capable of being removed in coupling reaction with an oxidized product of a developing agent; $R'_2$ and $R_3$, and $R_5$ and $R_6$ each may form a 5-, 6- or 7-membered ring; $R'_1$, $R'_2$, $R_3$ or $Y_1$; $R_4$, $R_5$, $R_6$ or $Y_2$; $R_7$, $R_8$, $R_9$ or $Y_3$; $R_{10}$, Za, Zb or $Y_4$; and Q or $Y_5$ each may form a dimer or a higher polymer.

5. A color photograph as claimed in claim 3, wherein the photographic layer further contains an anti-fading agent together with the storability-improving compound.

6. A color photograph as claimed in claim 5, wherein the anti-fading agent is an aromatic compound of a general formula (VIII):

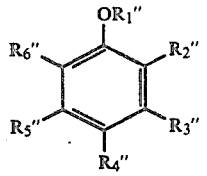
(VIII)

wherein $R_1''$ represents a hydrogen atom, an alkyl group, an alkenyl group, an aryl group, a heterocyclic group or a group of

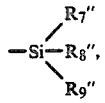

where $R_7''$, $R_8''$ and $R_9''$ may be the same or different and each represents an alkyl group, an alkenyl group, an aryl group, an alkoxy group, an alkenoxy group or an aryloxy group; $R_2''$, $R_3''$, $R_4''$, $R_5''$ and $R_6''$ may be the same or different and each represents a hydrogen atom, an alkyl group, an alkenyl group, an aryl group, an acylamino group, an alkylamino group, an alkylthio group, an arylthio group, an alkoxycarbonyl group, an aryloxycarbonyl group, a halogen atom or —O—$R_1'''$, where $R_1'''$ has the same meaning as $R_1''$; or $R_1''$ and $R_2''$ may be bonded together to form a 5-membered ring, a 6-membered ring or a spiro ring; or $R_2''$ and $R_3''$, or $R_3''$ and $R_4''$ may be bonded together to form a 5-membered ring, a 6-membered ring or a spiro ring.

7. A color photograph as claimed in claim 6, wherein the amount of the compound of formula (VIII) to be added is from 10 to 400 mol % to the coupler.

8. A color photograph as claimed in claim 6, wherein the amount of the compound of formula (VIII) to be added is from 30 to 300 mol % to the coupler.

9. A color photograph as claimed in claim 5, wherein the anti-fading agent is an amine compound of a general formula (IX):

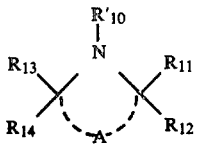
(IX)

in which $R'_{10}$ represents a hydrogen atom, an alkyl group, an alkenyl group, an alkynyl group, an acyl group, a sulfonyl group, a sulfinyl group, an oxy-radical or a hydroxyl group; $R_{11}$, $R_{12}$, $R_{13}$ and $R_{14}$ may be the same or different and each represents a hydrogen atom or an alkyl group; and A represents a non-metallic atomic group necessary for forming a 5-membered, 6-membered or 7-membered ring.

10. A color photograph as claimed in claim 9, wherein the amount of the compound of formula (IX) to be added is from 10 to 400 mol % to the coupler.

11. A color photograph as claimed in claim 9, wherein the amount of the compound of formula (IX) to be added is from 30 to 300 mol % to the coupler.

12. A color photograph as claimed in claim 5, wherein the anti-fading agent is a metal complex comprising a center atom of copper, cobalt, nickel, palladium or platinum and at least one organic ligand having two or more conformations.

13. A color photograph as claimed in claim 12, wherein the amount of the metal complex to be added is from 1 to 100 mol % to the coupler.

14. A color photograph as claimed in claim 12, wherein the amount of the metal complex to be added is from 3 to 40 mol % to the coupler.

15. A method for preparation of color photographs comprising the steps of:

(A) image-wise exposing to light a color photographic material containing at least one photographic layer on a support, wherein the material contains a silver halide emulsion layer and a color image-forming coupler capable of forming a dye by an oxidation-coupling reaction with an aromatic amine series color developing agent; and (B) processing the resulting image-wise exposed photographic material of step (A) with a color developer containing an aromatic amine series color developing agent, in the presence of a storability-improving compound selected from compounds of general formula (I-a), (I-b), (I-c) and (I-d) and having a secondary reaction rate constant $k_2$ (80° C.) with p-anisidine in the range of from $1\times10^{-1}$ liter/mol.sec to $1\times10^{-5}$ liter/mol.sec:

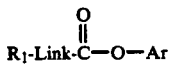
(I-a)

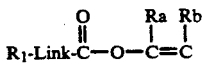
(I-b)

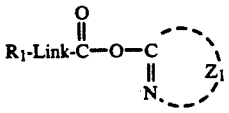
(I-c)

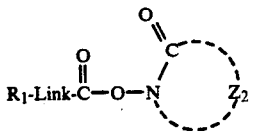
(I-d)

wherein $R_1$ represents an aliphatic group, an aromatic group or a heterocyclic group; Link is a single bond or —O—; Ar denotes an aromatic group, except that no group useful as a photographic reducing agent is released as a result of reaction with an aromatic amine series developing agent; Ra, Rb and Rc, which may be the same or different, each represents a hydrogen atom, or an aliphatic group or a heterocyclic group; Ra, Rb and Rc may further represent an alkoxy group, an aryloxy group, a heterocyclic oxy group, an alkylthio group, an arylthio group, a heterocyclic thio group, an amino group, an alkylamino group, an acyl group, an amino group, a sulfonamide group, a sulfonyl group, an alkoxycarbonyl group, a sulfo group, a carboxyl group, a hydroxyl group, an acyloxy group, a ureido group, a urethane group, a carbamoyl group or a sulfamoyl group, provided that Ra and Rb, or Rb and Rc, may combine to form a 5- to 7-membered hetero ring, which hetero ring may be further substituted by a substituent, or form a spiro ring, a bicyclo ring, or may be fused with an aromatic ring; $Z_1$ and $Z_2$ denote the non-metallic atomic group necessary for forming a 5- to 7-membered hetero ring, which hetero ring may be further substituted by a substituent, or form a spiro ring, a bicyclo ring, or may be fused with an aromatic ring, except that $Z_1$ is not such a group that it releases a 1-phenyl-3-pyrazolidone, as a result of reaction with an aromatic amine series developing agent.

16. A method for preparation of color photographs as claimed in claim 15, wherein the photographic material contains the storability-improving compound in at least one photographic layer.

17. A method for preparation of color photographs as claimed in claim 16, wherein the content of the said storability-improving compound in the photographic material is within the range of from $1\times10^{-2}$ to 10 mols per mol of the color image-forming coupler.

18. A method for preparation of color photographs as claimed in claim 15, wherein said color developer contains benzyl alcohol in an amount of 2.0 ml/liter or less.

19. A method for preparation of color photographs as claimed in claim 15, wherein said color developer contains benzyl alcohol in an amount of 0.5 ml/liter or less.

20. A method for preparation of color photographs as claimed in claim 15, wherein said color developer contains no benzyl alcohol.

21. A method for preparation of color photographs as claimed in claim 15, wherein the color development time is within 2 minutes and 30 seconds or less.

22. A method for preparation of color photographs as claimed in claim 15, wherein the color development time is within the range of from 10 seconds to 2 minutes and 30 seconds or less.

23. A method for preparation of color photographs as claimed in claim 15, wherein the color development time is within the range of from 45 seconds to 2 minutes.

* * * * *